US010864428B2

(12) United States Patent
Ramirez

(10) Patent No.: US 10,864,428 B2
(45) **Date of Patent: *Dec. 15, 2020**

(54) SPORT PERFORMANCE GLOVES

(71) Applicant: John C. Ramirez, Redlands, CA (US)

(72) Inventor: John C. Ramirez, Redlands, CA (US)

( * ) Notice: Subject to any disclaimer, the term of this patent is extended or adjusted under 35 U.S.C. 154(b) by 491 days.

This patent is subject to a terminal disclaimer.

(21) Appl. No.: 15/650,786

(22) Filed: Jul. 14, 2017

(65) Prior Publication Data

US 2017/0312616 A1 Nov. 2, 2017

Related U.S. Application Data

(63) Continuation of application No. 14/742,626, filed on Jun. 17, 2015, now Pat. No. 9,962,594.

(51) Int. Cl.

| | |
|---|---|
| ***A63B 71/14*** | (2006.01) |
| ***A41D 19/015*** | (2006.01) |
| ***A63B 57/30*** | (2015.01) |
| ***A41D 27/28*** | (2006.01) |
| ***A41D 31/14*** | (2019.01) |
| ***A41D 31/12*** | (2019.01) |
| *A63B 71/00* | (2006.01) |

(52) U.S. Cl.

CPC ..... *A63B 71/146* (2013.01); *A41D 19/01547* (2013.01); *A41D 19/01564* (2013.01); *A41D 27/28* (2013.01); *A41D 31/12* (2019.02); *A41D 31/14* (2019.02); *A63B 57/353* (2015.10); *A63B 71/141* (2013.01); *A41D 2600/10* (2013.01); *A63B 2071/0063* (2013.01); *A63B 2209/10* (2013.01); *A63B 2243/007* (2013.01)

(58) Field of Classification Search

CPC ... A63B 71/146; A63B 71/141; A63B 57/353; A63B 2071/0063; A63B 2209/10; A63B 2243/007; A41D 31/14; A41D 31/12; A41D 19/01564; A41D 19/01547; A41D 27/28

See application file for complete search history.

(56) References Cited

U.S. PATENT DOCUMENTS

| | | | | | |
|---|---|---|---|---|---|
| 1,358,824 | A | * | 11/1920 | Burden | A41D 19/015 2/163 |
| 2,242,318 | A | * | 5/1941 | Mosier | A41D 19/00 2/159 |
| 2,513,030 | A | * | 6/1950 | Lazarian | A41D 19/0013 2/159 |
| 2,907,047 | A | * | 10/1959 | Steinberg | A63B 71/146 2/161.3 |
| 3,394,408 | A | * | 7/1968 | Bush | A63B 71/146 2/159 |
| 4,045,824 | A | * | 9/1977 | Weppler | A41D 19/0013 2/163 |
| 5,184,353 | A | * | 2/1993 | Goldwitz | A63B 71/146 2/160 |

(Continued)

*Primary Examiner* — Katharine Gracz

(57) ABSTRACT

According to the various features characteristics and embodiments of the present invention which will become apparent as the description thereof proceeds, the present invention provides partially fingered gloves intended to increase the overall performance in sports activities including but limited to football and golf. Primarily because of its unique finger configurations, and/or grip enhancers, and/or hand protective properties, as well as providing an strategically located aperture exposing a portion of a user's forefinger, the present invention makes a glove more operable in various sports activities.

20 Claims, 28 Drawing Sheets

(56) References Cited

U.S. PATENT DOCUMENTS 5,228,142 A * 7/1993 Yoswein-McGreen ..... A41D 19/00 2/169
5,761,745 A * 6/1998 Sato ..... A63B 71/146 2/161.2
5,991,926 A * 11/1999 Lakusiewicz .... A41D 19/01558 2/161.1
6,055,669 A * 5/2000 Albert ..... A63B 71/148 2/161.1
6,189,150 B1 * 2/2001 Jones-Roberson ..... A41D 19/01529 2/163
6,279,163 B1 * 8/2001 Hale ..... A63B 21/065 2/160
6,519,776 B1 * 2/2003 Davenport ..... A63B 71/146 2/161.2
6,651,255 B1 * 11/2003 Schild ..... A41D 19/015 2/160
7,735,153 B1 * 6/2010 Romiti ..... A41D 19/01558 2/163
7,895,670 B2 * 3/2011 Kleinert ..... A41D 19/01582 2/161.1
2003/0208833 A1 * 11/2003 Gold ..... A41D 19/02 2/161.1
2004/0025224 A1 * 2/2004 Albert ..... A41D 19/01558 2/159
2004/0199978 A1 * 10/2004 Cass ..... A41D 19/01564 2/161.3
2007/0079421 A1 * 4/2007 Davis ..... A63B 69/00 2/163
2008/0235850 A1 * 10/2008 Cabauy ..... A41D 19/01558 2/161.8
2009/0144880 A1 * 6/2009 Desjardin ..... A63B 71/146 2/161.1
2010/0186140 A1 * 7/2010 Ramirez ..... A41D 19/0017 2/161.1
2012/0137401 A1 * 6/2012 Ramirez ..... A41D 19/0017 2/161.1

* cited by examiner

SPORT PERFORMANCE GLOVES

FIELD OF THE INVENTION

The present invention relates to sports apparatus and equipment, and uses thereof, used in playing the game of various sports. The present invention and its glove embodiments enhance the overall performance in athletic tasks and/or execution commonly associated during sports play, particularly in, but not limited to, football and golf by configuring to meet the specific requirements of a football quarterback's throwing hand or a golfer's dominant or weak hand, for example. The present invention unique finger configurations completely cover the thumb, forefinger, and middle finger of a user's hand, including the fingertips; said forefinger stall also comprises an aperture along the digital segment of the forefinger stall leaving at least a portion of the proximal phalangeal of a user's forefinger uncovered. Moreover, at least one of the remaining two fingers—the ring finger and the pinkie finger—are at least partially covered.

Furthermore, the present invention may offer grip enhancers on the palm area, the thumb segment and/or on any existing finger segments. Additionally, the present invention may offer protective properties on the dorsal segment of the glove and/or throughout any wrist portion thereof.

BACKGROUND OF THE INVENTION

An important goal in playing sports in to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

In FOOTBALL, for example, there are gloves that offensive and defensive Tackles can wear, that have thick padding around part of the hand. Offensive Receivers can purchase more expensive, all closed-finger, thin gloves to enhance their ability to catch and grip a football.

The use of gloves in football is so widespread that nearly every football player uses them, with the notable exception of football quarterbacks. You rarely see a quarterback wear gloves, even if just to keep warm. Most quarterbacks choose to play football without gloves, especially on their dominant (throwing) hand. This is largely because prior art consists of generic full-fingered gloves which are uncomfortable and burdensome on a quarterback's throwing hand, particularly on those fingers a quarterback places over the football laces. In addition, the full-fingered gloves prevent a quarterback to have any significant 'feel' of the football.

This ability to feel is critical when playing the position of quarterback. When the quarterback receives the ball from the teammate playing the Center position, the quarterback especially during a pass play, has to quickly find the laces on the football by feeling and not looking at the football. The quarterback has to look for an open player to pass to, and cannot therefore look down at the football to find the football laces.

This need to 'feel' a ball with a hand has therefore resulted in quarterbacks having to make a difficult choice. Although clearly these players would benefit from added grip enhancers on the throwing hand to increase their passing receptions or to decrease fumbles, for example, prior art gloves force a quarterback to choose between all feel and no feel. Virtually all quarterbacks have chosen to maintain feel and therefore sacrifice the ability to better grip the football. It is no surprise that quarterback fumbles remain a significant problem in football, even at the highest performance levels, and currently remains an insoluble problem in the sport for amateurs and professionals alike.

Playing the position of quarterback without the help of gloves, however, can also be an inferior choice. The website Instructables.com provides a good description of one popular conventional way to hold and throw a football.

"The instructable documents on how to correctly throw a football.

Step 1: Hand placement.

a. Place hand on ball with index finger [forefinger] closest to the tip of the ball.

b. Place middle finger off the end of the white laces.

c. Place ring finger inbetween second and third laces from the back.

d. Place pinky finger between fourth and fifth laces from the back.

e. Wrap thumb around ball."

(instructables.com/id/how-to-throw-football/)

Whereas the fingers over the laces have a solid grip on the ball—primarily due to the football laces on the ball—digital segments off the laces are virtually unsupported and therefore have a relatively weaker grip, creating a weak overall grip on the football when using this football grip preference (see FIG. 7 for an example of a conventional method of how a quarterback typically grips a football).

This weak overall grip becomes more pronounced when added stress is placed on a quarterback's thumb, forefinger, or middle finger. When a quarterback, intending to pass the football, suddenly has to scramble, for example, or if the quarterback 'pumps' the ball (goes through all the motions and speed of throwing the ball but doesn't actually release the ball), the grip strength of the thumb and forefinger can determine whether or not a quarterback fumbles the football. In fact, even a quarterback's middle finger would have minimal grip capabilities after pumping the football, because while the middle finger can push off the lace that it is bumping up against on its side adjacent to the ring finger, when the quarterback begins to pull back the football, the middle finger would not be able to bump up against any laces because the middle finger is not 'in between' the football laces.

Unfortunately, one need only view the statistics to see that fumbles persist as an insoluble problem, even at the professional level today. In the entire 2010 National Football League (NFL) season, there were only ten players who had 9 or more fumbles in the season. All ten players were quarterbacks (The Official NFL Record & Fact Book, 2011).

Under the 'tips' section of Wikihow.com, it further describes proper football throwing form: "A proper throw will feel like it's only utilizing the thumb, Index [forefinger], and middle finger. Good release will 'roll' off of your Index and middle finger, to impart more spin; you may snap your wrist through as you follow through to the hip. The other three fingers on your hand stabilize the ball as its being flung. They should not be used to impart spin on the ball. The most important finger to throwing a spiral is the Index finger; it is the finger that holds the most leverage in putting spin on the ball." The conventional way of playing the position of quarterback therefore requires an ability to have solid grip and control with the forefinger, a finger that is not able to be placed over the football laces; the resulting glove-less grip creates a strong hold on the ball by all the fingers except the thumb as well as the forefinger and at times the middle finger—the most important digital segments when throwing a football. On a wet football field, during extreme weather conditions (hot or cold), that weaker or looser grip makes for a much more difficult completed pass, less success at throwing a spiral, and inconsistency and inaccuracy in passing.

Passing the ball is a significant part of the sport of football, sometimes throwing as much as 103 times in a single game (e.g., Seattle vs. San Diego, 2002). Thus, developing a solution to enhance one's ability of better controlling a football and completing a pass reception would substantially impact the sport.

There have been some attempts through the years to solve the problems of inconsistencies and turnovers in the sport of football. For example, changes have been made to the actual football in order to make the ball easier to handle. Changes to the shape and size, as well as the addition of grip enhancing materials to the ball—such as the addition of PVC dots—have made it possible to make the ball more grippable. The ability of the quarterback to maintain control of the football was still problematic because of the lack of any grip enhancing device for the player to use; gloves that could be placed on the throwing hand such that a football quarterback could now more significantly control a ball with his arm, thereby creating an overall grip of the football throughout the football. As a result of this unmet need, inconsistencies and turnovers were still high in the sport.

The introduction and subsequent proliferation in the use of gloves found some success but even with these advancements, however, fumbles and incompletes still persist today, partly because none of the prior art gloves could be useful, and are therefore inoperable, to football quarterbacks.

Consequently, there is also a need for a sport glove of some kind which permits the quarterback to hold a football more securely. These problems may be addressed by providing a new sports glove that is configured to properly address the grip and feel requirements of the throwing hand of a quarterback, such as the present invention.

Quarterbacks are also now starting to intentionally run more (hereinafter called 'rushing') with the football creating an even greater need to configure a glove to meet the specific needs of a quarterback. New art is therefore required to meet this new need by offering a uniquely configured glove to meet the specialized needs of today's quarterbacks such as offering superior grip enhancing abilities, critical not only in ball control, but also in quarterback rushing successes.

Quarterback injuries can also become a significant problem in the sport. Protecting the quarterback from injury is so important that rules have been established to try and minimize those injuries. Gloves have proven useful in protecting other users playing other positions in football, but prior art gloves have not been configured for use by quarterbacks. To be sure, many quarterback injuries take place on the quarterback's throwing hand, primarily on the back portion of the hand, on the side of the hand or palm area, or on the fingers of the throwing hand.

Prior art configuration problems cease to protect a quarterback's throwing hand. As is well known, repeated exposure to hand injury can cause damage to the systems of the hand, such as the nervous system, the muscular system or the skeletal system. Therefore, there is not only an opportunity for new art, but there is an increasing concern and need to solve this configuration problem, not only for professionals but also for children and teenagers playing this football position.

Consequently, there is also a need for a protective sports glove of some kind which permits the quarterback to hold a football securely and still provide adequate protection of the throwing hand against impacts from opposing players.

Over the last decade or two, quarterbacks have clearly increasingly chosen to rush for yardage and act more like a running back at times. The top five NFC Conference quarterbacks, for example, rushed for a total of 1,562 yards in the 2010 season. It is also no surprise, therefore, that there were a total of 731 fumbles in the entire NFL that season, and fully over 25% of all those fumbles were attributed to quarterbacks (2010 NFL Season). As this trend continues, especially with more popular offensive formations such as 'the wildcat' and 'spread' formation, these grip-enhancing shortcomings will undoubtedly be more pronounced. Previous failures to create gloves to support a quarterback's throwing hand, not only while throwing the football but also while rushing with the football, is becoming a growing significant problem in need of a solution at the professional level and therefore certainly at the collegiate and amateur levels.

There is therefore a need for significant advances in the sport of football to assist quarterbacks, a position that touches and controls the football more than any other position in the sport. New art needs to be offered, such as the present invention, to meet the needs of quarterbacks by developing a glove that is configured to meet the unique needs of that position.

In the field of GOLF, to be sure, there exists much prior art in the form of gloves for a golfer's weak (non-dominant) hand. In fact, most active golf players wear a glove on their weak hand, and go without a glove for their strong hand (if one were to go to any major store to buy golf gloves, they would be sold and packaged in singles—one glove—not sold in pairs). Gloves are prevalent in golf largely because of the role that hand grip plays in a golfer's overall performance.

Although there are many types of full-fingered gloves for a golfer's weak-hand, they all attempt to maximize a golfer's weak-hand grip without regard to a golfer's weak hand feel, and hand coordination needs. It is no surprise, therefore, that prior art consists of full-fingered (all fingers are covered), closed palm gloves. As a result, a typical golfer must rely on his/her weak-hand to provide most of the grip support, and on his strong-hand to provide all of the 'feel' in his golf swing. There is, therefore, an opportunity to invent a device—and improve prior art—that could offer some 'feel' ability for the weak hand, without significantly diminishing that enhanced grip ability that gloves offer. This would increase overall hand control of a golfer's club swing, and therefore greater success in competition.

One very popular grip, for example, is called the interlocking grip method. When you use this grip method, the forefinger of the golfer's weak-hand is placed over and wrapped around the strong (dominant) hand's pinkie finger. With this grip, clearly the role of the interlocked fingers has to do with grip as well as with coordination and feel to more effectively control the golf swing and to provide greater overall golf swing consistency. There is, therefore, no real need to cover all of the weak-hand's forefinger, which touches the dominant hand's interlocked pinkie finger, and uncovering part of the forefinger would actually significantly increase overall coordination by allowing the uncovered portion of the weak hand's forefinger to touch the skin of the dominant hand's pinkie finger. Embodiments of the present invention would therefore offer significant improvement to prior art.

Whereas weak-hand support products seem to be crowded in the sport of golf, there is a long existing need for a device that could offer added support for a golfer's strong hand without significantly diminishing its ability to adequately feel the golf club. Inventing a solution to this problem could, among other things, allow for greater golf swing control and consistency, and create an entirely new market to support a golfer's strong-hand.

There is therefore an opportunity to invent a device that could offer some 'feel' ability for the dominant hand, while significantly enhancing the grip ability of that same hand. This would increase overall hand control of a golfer's club swing by allowing a golfer to have added grip capabilities on both hands, and therefore greater success in competition.

In Golf magazine's April 2005 article titled "Fix Your Grip," golf instructor Charlie King provides an overview of how to grip a golf club. "Good golf starts with your grip. The proper hold on the club helps you do three crucial things: Hinge your wrists, control the clubface at impact and support the club throughout the swing. Here are three simple grip tips." As King continues, his third tip is "both hands; solid at the top. An effective grip sets the face square at the top, with the shaft parallel to the target line. You should feel most of the club's weight in your left thumb and right forefinger. Now you're ready to turn it loose." Although prior art seems to be crowded in offering a glove for the weak-hand to support and better control the club weight placed on the thumb of the weak hand, there remains an unmet need for added support on or around the forefinger of the strong (dominant) hand.

Additionally, constant swinging of a golf club at real swing speeds often results in soreness on and between the thumb and forefinger of a golfer's strong hand wearing no glove. This soreness can often also come from the rubbing or slipping between the club handle and the portion between the thumb and forefinger of the strong hand, suggesting a need to find a way to increase the grip of a golfer's strong hand, as well as protect this hand from soreness. This is especially important in the sport of golf because even the smallest of slipping—during the golf swing or upon impact of the golf ball—can create enormous inconsistencies and inaccuracies, critical issues in determining overall performance in golf.

A further reason why golfers are not using gloves on their dominant hand has to do with the fact that golf gloves are not uniquely configured to best conform to a golfer's preferred golf grip method. For example, golfers are not using gloves on their dominant hand because the dominant hand's pinkie finger is often used to touch and feel the non-dominant hand when holding the golf club using the traditional overlap grip; this is done to help with the coordination of movement of both hands to preferably act in unison throughout the golf swing. Therefore, at least a portion of the dominant hand's pinkie finger is preferably uncovered in order to maintain necessary feel. Because the dominant hand is responsible for most of the feeling in the golf swing, it also becomes necessary to maintain some level of high sensitivities on a portion of the dominant hand's ring finger and forefinger as well.

A preferred configuration for the golfer's strong hand would be, for example, a glove which could increase the grip capabilities of the dominant hand's thumb and a significant portion of the forefinger, while offering some level of feel along the ring finger and the pinkie finger. The dominant hand's forefinger would require a unique blend of grip and sensitivity capabilities. Providing added grip capabilities along the forefinger's fingertips would allow a use to better maintain control, while providing an aperture along the palmar portion of the forefinger would simultaneously allow the user to maintain tactile sensitivities whereby at least a portion of the forefinger's skin would still touch the handle of a golf club, for example. The glove's thumb stall would further provide a palmar portion which covers a user's entire thumb's palmar section, a critical feature in providing a solid grip along one end of the overlapping grip. This new type of sports glove would thus offer the ability of a wearer to simultaneously have significant grip and feel throughout the grip of a sports apparatus such as football or golf club.

Consequently, there are clear indications that an entirely new market exists for a device that could support a golfer's strong hand. In particular, there remains an unmet need that would provide multiple benefits, such as better overall grip and more coordination with both hands during the practice or play of golf, and in various other sports activities. The present invention solves the above mentioned problems by, among other things, providing a glove configured for use on the dominant hand that can increase grip abilities on areas primarily responsible for the gripping a golf club, while allowing portions of the other fingers to be uncovered and able to maintain necessary feeling capabilities.

DETAIL DESCRIPTIONS OF THE INVENTION

The present invention provides a glove having dorsal (back) and palmar (front) portions for overlaying respective back and palm regions of a human hand, and dorsal and palmar portions having distal and proximal ends with a plurality of digital segments (or stalls) projecting from said distal ends. The digital segment of the thumb overlays a user's entire thumb including the fingertip of said thumb, the digital segment of the forefinger overlays a user's entire forefinger including the fingertip of said forefinger, the digital segment of the middle finger overlays a user's entire middle finger including the fingertips of said middle finger. Additionally, at least one more finger stall exists which covers at least a portion of either the ring finger or the pinkie finger. The present invention unique finger configurations offer unique glove configurations offer new and unexpected results to sports gloves, especially in the sport of football and golf.

In one preferred aspect, a digital segment exists whereby the pinkie finger is also completely enclosed. In another embodiment, the pinkie finger is completely uncovered. Preferably, at least a portion of the pinkie finger's proximal phalanx is covered.

In another preferred aspect, a digital segment exists whereby the ring finger is also completely enclosed. In another embodiment, the ring finger is completely uncovered. Preferably, at least a portion of the ring finger's proximal phalanx is covered.

In at least one embodiment, digital segments exist whereby the ring finger and pinkie finger are each completely covered (enclosed), including their fingertips.

Additionally, many though not all embodiments will further comprise an aperture along the glove's forefinger stall whereby said aperture exposes a portion of a user's forefinger. The aperture offers a user the ability to have heightened tactile sensitivities by exposing the skin of said forefinger, critical especially in the sport of football and golf.

Accordingly, embodiments provide a novel glove that can now make gloves operable for use on a football quarterback's dominant hand and on a golfer's dominant or weak hand, for example.

In another preferred aspect, the present invention also comprises a grip enhancing means, such as for example, PVC dots, on a portion or portions of the palmar surface area of the glove, such as for example, on any thumb and finger stalls, along any portion of any metacarpophalangeal joints, and/or between the thumb and forefinger area, generally defined by the metacarpal of the forefinger and extending up along the metacarpal of the thumb, and therebetween, or on any portion of the middle finger stall as such for example, around the aperture.

In at least one embodiment, the entire palmar surface comprises a grip enhancing means throughout the glove's palmar portion surface area.

The grip enhancing means permits the individual to better grip a ball or an object or device, and can create, for example, a higher coefficient of friction than on the rest of the palmar portion of the glove. This could give, for example, a football quarterback or a golfer multiple benefits such as increased control of a ball or device thereby enhancing performance and overall success at performing a sports task.

In general, the grip enhancing means of the present invention may be integral to the glove or may be affixed to the glove surface by, for example, forming a grip enhancing panel and applying the panel onto a portion of the glove. The grip-enhancing means of this embodiment may be formed on a finger stall and could comprise, for example, a high friction textured surface with a more narrow width, say about 1.5 to three centimeters. This and other embodiments may include a plurality of projections or a plurality of depressions on the surface of the grip enhancing panel formed from, for example, one of a vinyl material, a rubber material, or a neoprene material, creating a grip enhancing means. The material forming the panel could then be applied to said stalls using any standard bonding methods, such as adhesion or stitching. The plurality of projections can preferably be provided, for example, on at least one centimeter by one centimeter of any finger stalls. The projections could preferably extend out less than 1/10 of a centimeter, but could range generally from 1/20 of a centimeter to several centimeters.

In general, the grip enhancing panel forming the grip enhancing means may preferably be formed from an elastic material or fabric, including but not limited to, a knitted fabric, for example, LYCRA, rayon, neoprene, a rubber material, a vinyl material, a PVC material, a nitrile material, or the like.

The grip enhancing means comprised of a grip enhancing panel provides a higher and more effective coefficient of friction than the rest of the glove body, preferably providing a Shore A Durometer Coefficient of Friction of at least 1.5; More preferably, the grip enhancing means comprised of a grip enhancing panel provides a Shore A Durometer Coefficient of Friction of between 1.5 and 4.5.

Once the grip-enhancing surface on the panel has been formed, the panel may then be applied to the palmar surface of the glove by any standard methods, such as by stitches or adhesives, for example.

The grip enhancing means may further comprise of tackifiers strategically placed along the palmar portion of the glove body, thus providing very high grip capabilities to a user.

Tackifier resins, tackifier coatings, and tackified materials such as tackified leathers and synthetic leather are well known in the art and commonly used in sports, but not on gloves for Football Quarterbacks or on Golf Gloves. Tackified leather, for example, although providing extremely effective gripping abilities it does not have much flexibility or elastic properties, significantly limiting a user's ability to bend or clench the tackified portion of the glove. Consequently, Football Quarterbacks and Golfers, who often have to clench fingers, cannot use prior art tackified gloves.

Embodiments of the present invention have overcome prior art configuration deficiencies by placing tackifiers and tackified materials on strategically placed locations whereby a user's grip is significantly improved while minimizing the flexibility challenges. Embodiments accomplish this primarily by providing a grip enhancing means comprised of: tackifiers or a tackified material overlaying a user's metacarpophalangeal joint whereby said tackifiers or tackified materials do not extend to overlay more than one metacarpophalangeal joint; tackifiers or tackified materials overlaying a user's phalanx whereby said tackifiers or tackified materials do not extend to overlay more than one metacarpophalangeal joint; tackifiers or tackified materials overlaying a user's pinkie finger metacarpal whereby said tackifiers or tackified materials does not extend to overlay more than the user's pinkie finger metacarpal. In many embodiments, the grip enhancing means will comprise of a grip enhancing panel that is affixed to strategic locations of the glove body whereby said grip enhancing panel is formed of a tackified material, such as impregnating a leather with a tackifier resin. Thus, the grip enhancing means of the present invention may also comprise of tackifier resins, such as rosins and their derivatives, terpenes, aliphatic, cycloaliphatic and aromatic resing, and any of a variety of hydrocarbon-type resins, tackifier coatings, tackified materials including tackified leathers and synthetic leathers, and other tackifier substances well known in the art.

The grip enhancing means formed of these tackfied materials integral to the glove body or formed of tackified grip enhancing panels, are preferably configured to provide a significantly higher coefficient of friction, preferably of at least a Shore A Durometer Coefficient of Friction of between 2.0 and 4.5; Still more preferably a Shore A Durometer Coefficient of Friction of between 2.5 and 4.5.

Any standard method may be used in creating a tackified portion on the glove body. For example, a grip enhancing panel may be formed by resin-impregnating tackified coatings onto leathers or synthetic leathers, for example. Alternatively, a tackified coating, such as POWR TAC by Grand Enterprises West directly onto portions of the glove body or onto a panel.

An exemplary process of tackifying a glove body is provided in US20070204381, by Thompson. U.S. Pat. No. 4,598,429, by Mulvaney also teaches method of tackifying a material. For an understanding of the compositions of tackifier compound solutions, The Chemistry of Tackifying Resins by Chretien Donker, is one a several known documents in the art.

Accordingly, embodiments provide a novel glove with added grip-enhancing features that enhances overall control and sports performance.

In another preferred aspect, the present invention also comprises protective properties to protect a user from injury or to protect an injury. These protective properties can be in the form of a thicker dorsal segment or in stronger material that comprises the dorsal segment of the glove. Additionally or alternatively, a shock-absorbing member or members, such as a padded layer or layers may be used so that the glove can be used to protect an injury or to protect an area from being injured, a critical feature now that football quarterbacks have recently started to more actively rush with the football.

The shock-absorbing member or members are generally located on the dorsal segment of the glove, preferably covering at least a portion of the metacarpal of any of the four fingers and/or the thumb, and/or on substantially the dorsal portions of the thumb and/or on any existing finger segments, where many football injuries occur as a quarterback throws a football and is immediately hit by an opposing player.

Also, some embodiments may have a shock-absorbing member or members near and around a portion or throughout the dorsal and palmar portions of the wrist area, extending up to as much as about five inches along the carpal bone of the wrist.

The shock-absorbing member may generally be affixed to the outer surface of the glove dorsal segment or may be integrally formed on the glove. If integrally formed, at least one embodiment may include a liner.

The thickness and dorsal surface locations of the shock absorbing members may vary, of course, depending on preference. In at least one embodiment the entire dorsal segment comprises a shock-absorbing member, and the shock-absorbing member can be one uniform cushion, for example, mirroring the design of the dorsal segment of the glove.

Accordingly, embodiments can also provide a novel glove with added protective features that enhances protection of a previously unprotected quarterback's throwing hand, for example, including the back of the hand, the thumb and fingers, and wrist areas, and combinations thereof.

The glove may also have an expandable opening means at a wrist end adapted to receive the user's hand. This preferably comprises a wrist portion with a securement opening means, such as but not limited to a flap which mechanically engages a flap capture mechanism to secure the glove to the users hand (e.g., a synthetic hook and loop fastening interface which adheres when pressed together, commonly using VELCRO). In this case the flap could overlay a small slit or opening along a portion of the back of the hand to allow the glove to widen when a user places the glove on to the hand. Alternatively, the opening means may comprise of other standard used mechanisms of allowing a user to apply and disengage the glove, such as an elastic band material along the wrist portion, or combinations therebetween.

Embodiments may also comprise of micro holes/recesses along any portions of the glove, generally used on golf gloves and football gloves for ventilation or moisture management purposes. These micro holes are generally about 0.120 millimeters or so in diameter.

Embodiments may further comprise a detachable golf ball marker to more easily allow a golfer to mark the spot of the golf ball's location. The detachable ball marker is secured by any standard fastening means, such as by snap fastening, by a VELCRO fastening compartment, by magnetism, or the like.

Some embodiments may also comprise of a weather-resistant coating, such as a synthetic resin for example, to allow for more accurate play during unfavorable weather conditions.

Construction of the present invention may be accomplished by standard methods, such as, for example, by designing the dorsal and palm sections to meet along a conjoining lateral edge to define a pocket for receiving the eminence of a user's hand.

One sport where the present invention will clearly enhance performance is in the sport of FOOTBALL. As previously discussed, wearing a glove can be very advantageous, and is used by most athletes in most sports activities. Prior art gloves, as previously configured however, were essentially inoperable on a football quarterback's throwing hand, and on a golfer's dominant hand. Using embodiments of the present invention now allow a football quarterback to place his covered thumb and middle finger on the football and increase the grip by the glove embodiment, and be able maintain maximum tactile abilities by leaving uncovered the fingertips of the user's ring finger and pinkie finger, for example. In addition, all glove embodiments also completely cover the forefinger's distal phalanx, or the fingertips, to further increase the user's grip while also providing the ability to maintain the usual heightened tactile forefinger sensation by offering an aperture along a portion of at least the proximal phalanx of the palmar surface. This configuration and other embodiments allow the quarterback the ability to place the uncovered ring finger and pinkie finger segments over the football laces unencumbered and also able to maintain significant feel on the football. This and other features now essentially make the sports glove more operable, novel and significantly superior to prior art in these areas.

More specifically, for example, one particular unmet need that the present invention will satisfy will be with football quarterbacks. It is often said that quarterback mechanics and ball-handling skills are vital for offensive success and consistency. One embodiment of the present invention is drawn and discussed in FIG. 1 and FIG. 2, which comprises a glove that covers all of the thumb, forefinger and middle finger of a hand, and the remaining two fingers are all partially covered, up to about ⅓rd of each respective finger. Additionally, the forefinger segment also comprises an aperture along the proximal phalanx of the forefinger segment while having a middle finger segment that covers a user's proximal phalanx. More specifically, for example, the glove covers the proximal phalanges of the ring and pinkie fingers, in part or in its entirety, but not extending to overlay any portion of the middle phalanges of said fingers. The aperture on the forefinger segment would be located to leave uncovered about the top half of the proximal phalanx, the entire proximal interphalangeal joint, and about the bottom half of the middle phalanx, thus creating one rather large aperture.

This finger configuration will allow a quarterback to increase his grip and overall control of a football while simultaneously allowing some finger feel of the football. The rest of the hand, front and back, can be completely covered by the glove. Additionally, the embodiment may provide a palmar and dorsal portion overlaying a portion of the wrist area. For example, the wrist portion could be stitched on the glove and be made of an expandable composition whereby the glove would expand when being placed on a hand, and then naturally readjust to fit snugly around the user's wrists.

This glove will take into account the benefits of the laces on a football and give a quarterback the unique ability to grasp a football over the football laces with the comfort and feel of not having a glove, while adding the support that a glove provides over the thumb, forefinger and middle finger, particularly over the fingertips of said thumb and fingers. Improvement in throwing accuracy and overall performance will result from this unique type of support provided by the new art.

This embodiment could also find significant usefulness in golf as well. When placed on a golfer's dominant hand, the golfer can then use the interlocking grip, for example, and still maintain the necessary feel between the dominant hand's pinkie finger which is mostly, still uncovered and which interlocks and is in direct contact with the non-dominant hand's forefinger. One of the added benefits of using the embodiment is that the user would now have enhanced grip on the dominant hand's thumb and forefinger, which is currently glove-less. Additionally, the forefinger segment configuration will allow the golfer to increase grip capabilities on the forefinger's fingertips while also providing the ability to feel the golf club because of the aperture on the palmar surface of the forefinger segment.

The dorsal surface and the palmar surface of the glove can otherwise essentially mirror each other in configuration, thereby making conjoining relatively simple to form the glove, for example. Other standard methods of construction could certainly be used, of course.

A similar embodiment could support a less popular, but still effective quarterback hand grip whereby the quarterback's hand extends out, creating a wider overall grip. The pinkie finger, in this manner of grip, isn't responsible very much for grip, but for feel. This embodiment, as drawn and described in FIG. 8 and FIG. 9 for example, comprises a body glove that has a thumb segment that covers the entire thumb and a forefinger segment whereby said glove leaves uncovered the user's entire pinkie finger while providing an aperture on the forefinger segment. This unique and significantly improved configuration allows a user to maintain necessary heightened tactile sensitivities along both ends on the grip by allowing the skin of a user's entire pinkie finger to touch the football—because of the completely uncovered pinkie finger—at one end of the hand, and allowing the skin of a user's forefinger to touch the football—because of the aperture located on the forefinger segment—at the other end of the hand, thereby allowing heightened tactile sensitivities.

Additionally, embodiments could comprise a grip enhancing means overlaying the entire metacarpophalangeal joints of the pinkie finger, ring finger, middle finger and forefinger. For example, this grip enhancing means may be defined by the four finger digital creases and extending down about three centimeters (width), enough to cover the entire metacarpophalangeal joints of said fingers in their entirety. The length would be defined by the two opposing sides of the palm, say about seven to ten centimeters in general. This area would then include, for example, a high friction surface or a textured surface, as the grip enhancing means. The grip enhancing means could be comprised of a beaded surface pattern projecting out at least ½ millimeter, and which could be integral to the glove material and would preferably extend throughout the entire designated surface area, but could certainly be provided on at least one centimeter by one centimeter along the designated outer surface to provide added grip support, such as, for example, only on the metacarpophalangeal joint of the forefinger.

Embodiments could also offer a grip enhancing means on the palmar side of the existing finger stalls as well as the thumb stall, preferably on a portion of one or any of the proximal phalanges of any finger and thumb stalls, thus defining the terminal edges of the grip enhancing means for the embodiment.

The finger stall configuration problems solved by the present invention now provide glove embodiments that can also protect a user's hand such as a quarterback's throwing hand. The embodiment described above, can further comprise, for example, a shock-absorbing member along generally the dorsal portion overlaying the metacarpals and/or on the dorsal area of the existing finger and thumb stalls.

The shock-absorbing member of this and other embodiments can comprise of a pad or pads, such as any foam or cotton-based fabric for example, that provides a cushion to protect the selected areas of the hand. The padding can extend along at least a portion of the dorsal segment of the glove. This embodiment, for example, comprises foam padding that overlay and is bounded by the four metacarpals of the pinkie finger, the ring finger, the middle finger and the forefinger. Additionally, this embodiment comprises foam padding that overlay and is separately bounded by the proximal phalanges of the pinkie finger, the ring finger, and middle finger and the forefinger, thus defining its terminal edges (the phalanges and generally the dorsal surface of the glove). The shock-absorbing members can be operably attached to the glove, for example. The foam pads each can be at least about 3 millimeters in height, each encased in separate, preferably flexible materials, such as flexible plastics or synthetic cottons.

Other embodiments may have various heights, of course. The encased pad, for example, can then be stitched on to their respective locations, as described. Each of the encased paddings can be one or a plurality of small cushions. The paddings can be stretchable and elastic.

The present invention solves the configuration challenges of prior art and now make the athletic glove operable for use by quarterbacks using conventional methods of controlling a football. The present invention now therefore also offers a new method of playing the position of quarterback. When throwing a football, for example, the quarterback will first place the present invention partial-fingered glove on his throwing hand. After receiving the football from the Center, he will look down the football field while using primarily his uncovered fingers as well the aperture along the forefinger segment, to feel and locate the football laces on the football. After locating the football laces, he will quickly place the uncovered portion of his ring finger and his pinkie finger over the football laces, thus creating a solid grip over the top and distal half of the football. The quarterback will place his now covered forefinger and thumb on the closer half of the football, thus creating a solid grip throughout the entire football. The quarterback then locates a teammate to throw the football and proceeds to throw the football. The quarterback's forefinger and middle finger, supported by a glove, will now be able to more properly release the football—or more properly spin the football with his now grip enhanced forefinger and middle finger—and deliver the football to the intended target more accurately.

In addition to offering greater throwing accuracy and consistency, these and other embodiments should also help minimize quarterback fumbles by adding support when 'pumping' the ball, when scrambling from being tackled, and when rushing and throwing the football. When in 'shot gun' formation especially, a quarterback must quickly look down field at his receivers and 'feel' for the football laces. The present invention will allow a quarterback to maintain a heightened sense of feel in his uncovered fingers, while increasing the grip support on at least his thumb, forefinger and middle finger segments. These significant and substantial features will, among other things, enhance grip and control while maintaining or even enhancing overall feel.

With quarterback fumbles reaching as high as 23 fumbles in a single season (Kerry Collins, 2001) these and other grip enhancing embodiments for football quarterbacks will significantly impact the sport of football.

If preferred, for example, embodiments may provide added grip capabilities along the palmar portion on and between the thumb stall and the forefinger stall, as drawn and described in FIG. 3, for example. By providing added grip support in this area, a quarterback will have further increased control of the football to better perform common tasks. For example, when a quarterback wants to throw the football but has to temporarily run, or scramble, to avoid being tackled the quarterback most often relies primarily on only the dominant hand to hold on to the football. This added grip enhancers now allow the quarterback to more securely hold the football in the throwing position while scrambling by providing added grip capabilities in select areas, and can throw the football with greater precision while scrambling if necessary.

The targeted grip enhancing means may also preferably overlay any thumb or finger, any of the metacarpophalangeal joints, on the edges of the aperture along the forefinger stall, or on any portion between the thumb and forefinger, and may be separately the only grip enhancers on the embodiment, may be used in combination, or may be throughout the palmar surface.

This and other embodiments offer superior grip capabilities, critical not only in overall ball control and passing the football, but also in quarterback rush attempts. Over the last decade or two, quarterbacks have increasingly chosen to rush for yardage and at times act more like a running back. Through his years in the NFL, for example, professional football quarterback Michael Vick has attempted over 650 rushes. More recently, NFL quarterback Tim Tebow had 43 rush attempts in a single season, with an average of over 3.16 yards per carry.

Clearly, the trends suggest that successful quarterbacks will be required to rush more with the football, the result will often result in getting hit on the dominant hand which is usually protecting the football. Largely because of this, individuals playing the position of running back almost all wear gloves to be able to maintain control of the ball during impact; now with quarterbacks starting to become the second leading rushers on their respective teams (Tebow, Denver Broncos, 2010) the need for the quarterback to wear the present invention on his or her dominant hand grows even higher, so as to maximize ball control while rushing.

Embodiments may also offer critical added protection over the dominant hand of quarterbacks who choose to rush with a football.

College football teams are also requiring quarterbacks to rush more often, further increasing the need for embodiments. The 2013 BCS College Orange Bowl between Northern Illinois University and Florida State University featured a starting quarterback who was the leading rusher for his team that season, with 1,771 rushing yards and 19 rushing touchdowns (Jordan Taylor, 2012, NUIhuskies.com/stats/2012-2013).

Embodiments of the present invention offer football quarterbacks many benefits including:

- stronger overall grip
- higher completed pass accuracy
- more success at throwing a spiral
- higher consistency and performance in ball handling and control
- better control resulting in less fumbles
- greater success at quarterback play execution
- added protection, by the shock-absorbing member, on select areas of the hand and/or wrist
- greater success when a quarterback runs/rushes with a football
- grip enhancers on the throwing hand of the quarterback
- targeted grip enhancers specifically designed to maximize quarterback performance
- significant enhanced and vital protection to a quarterbacks throwing hand
- protection on the throwing hand when the quarterback rushes with the football In football, unstable or weak ball control can, among other things increase fumbles, increase incompletes and thereby increase turnovers and decrease performance. The above features offer significant and substantial benefits which properly address the concerns currently facing many athletes, such as football quarterbacks.

Another sport where the present invention will fulfill an unmet need is in the sport of GOLF. Embodiments of the present invention can be configured, for example, to meet the unique requirements of a golfer's strong hand thereby providing new art. A preferred embodiment, as shown and discussed in FIG. 5 and FIG. 6, for example, comprises a glove with a thumb stall that covers all of a user's thumb, and a middle finger stall that covers all of a user's middle finger. Additionally, a user's ring finger is partially uncovered, up ⅓rd, and a user's pinkie finger is completely uncovered. Finally, a user's forefinger is completely covered, but also has an aperture along the entire palmar surface of its proximal phalanx, thereby maintaining the necessary feel of the golf club while providing added grip capabilities on the dominant hand.

This embodiment will now allow a golfer to use his conventional golf glove on his or her non-dominant hand, as is currently done, while now using the embodiment on his dominant hand as well. The uncovered pinkie finger allows the golfer to maintain heightened feel in the pinkie finger, necessary in coordinating both hands throughout the golf swing while using any of the conventional club gripping methods, such as the overlapping, interlocking or even the full-fisted method. The aperture is also crucial in that it allows heightened tactile sensitivities, something that most golfers are accustomed to when attempting to adjust their golf club throughout their club swing.

When using the conventional overlapping method, for example, the pinkie finger of the dominant hand is placed over the forefinger and middle finger of the non-dominant hand, so using this embodiment will allow the user to maintain tactile sensation of the pinkie finger and properly coordinate a golf swing. The aperture along the forefinger as well as the partially covered ring finger will offer both feel capabilities on the uncovered phalanges, while offering added grip along the covered portions to more securely hold the golf club. Additionally, the golfer will now also have added grip capabilities, as well as protection, along the covered thumb and middle finger of the dominant hand.

A grip enhancing means can also be formed on said finger stalls or along the metacarpophalangeal joints if preferred, thus providing added grip capabilities along the area where the club is gripped. For the same reasons this embodiment would significantly assist golfers using any of the interlocking or full-fisted grip methods as well.

Among the benefits of the present invention include the ability to offer greater golf consistency and accuracy by solving an unrecognized problem in prior art. Using this embodiment on the dominant hand in conjunction with a standard golf glove on the non-dominant will allow the user to maximize grip at both ends of the club grip while maintaining feel capabilities to coordinate swing and feel if the golf club moves during a golf swing. The grip enhancing means may comprise of stripes, for example, projecting out about 600 micrometers.

This embodiment can be in the form of a standard synthetic leather golf glove, with the dorsal and palmar surface areas essentially covering all five metacarpals, with the only exception of a slit along the dorsal surface which allows the golfer to insert the hand into the glove, and micro recesses along a portion of the glove to allow for ventilation.

Configuring a golf glove for the strong hand will, among other things, create a solid grip throughout both hands, thus satisfying an unmet need. This embodiment, of course would also prove useful for football quarterbacks for the reasons aforementioned.

Another area in the sport of golf where the present invention will meet an unmet need has to do with improving prior art for the weak hand. Prior art is not configured to allow a golfer to take complete advantage of his/her preferred grip by allowing for skin contact between both hands, to maximize hand coordination throughout the golf swing.

One very popular grip, for example, is called the interlocking grip. When you use this grip, the pinkie finger of the golfer's dominant-hand is placed between the golfer's weak-hand middle finger and forefinger. With this grip, clearly the role of the dominant-hand's pinkie finger has to do with both grip as well as with coordination and feel of the weak-hand, to more effectively control the golf swing and to provide greater golf swing consistency. There is therefore an opportunity to provide an improved art golf glove for the weak hand that offers an aperture along a critical area whereby the skin of the weak hand can create contact with the skin of the dominant hand thus maximizing tactile sensitivities without losing grip capabilities. The increased sensitivities will provide a user with significantly enhanced capabilities to coordinate a golf swing, to feel if there is even a modest amount of unnecessary movement between both hands, and to more properly adjust his or her next golf swing. Embodiments of the present invention offer these significant improvement to prior art.

One embodiment, as drawn as discussed in FIG. 21 and FIG. 22 for example, comprises a golf glove for the weak hand whereby the glove has a thumb stall that completely encloses a wearer's thumb, a middle finger stall that completely encloses a wearer's middle finger, a ring finger that completely encloses a wearer's ring finger, and a pinkie finger that completely encloses a user's pinkie finger. In addition, the glove has a forefinger stall that completely covers a user's forefinger with the exception that the forefinger stall has an aperture along the proximal phalanx of its dorsal surface and extends out to the side adjacent to the middle finger, thereby exposing a portion of a user's forefinger such a wearer could can touch the skin of the exposed forefinger with the pinkie finger of the wearer's opposing ungloved hand.

This embodiment, and others, will allow a golfer to use the interlocking method to provide the usual grip capabilities on the weak hand while now providing significantly superior tactile sensations in coordinating hand movements because of the aperture. This embodiment, for example, would provide significantly enhanced tactile and therefore coordination capabilities between the interlocked fingers creating a more unison golf swing. The aperture along the forefinger will allow the golfer to make skin contact between the user's weak hand forefinger and the dominant hand's pinkie finger. By providing an aperture along this select area, the user can uniquely increase feel without losing grip capabilities along the other portions of the interlocked hands.

An additional significant improvement to this embodiment may comprise a grip enhancing means along any or all of the metacarpophalangeal joints, and/or on any of the thumb, forefinger and pinkie stalls, and/or on any region between the thumb and forefinger. When using the interlocking grip method, the grip enhancing means may comprise a non-slip latex coating, such as a nitrile coating for example, and would be especially useful along the ring finger's metacarpophalangeal joint, the area just below where the weak-hand forefinger interlocks with the strong hand pinkie finger defining the terminal edges of this grip enhancing means. The thumb and forefinger stalls can also comprise micro recesses or holes generally used on golf gloves, for ventilation or moisture management purposes. The rest of the palmar and dorsal segments could cover the rest of the hand, including the palm.

Finally, this and other embodiments may comprise of an opening means, such as VELCRO fasteners, and with a detachable ball marker, such a circular magnetic disc that attaches to a magnet located on the dorsal surface area of the golf glove, for example.

In general, the grip enhancing means of the present invention generally creates a higher coefficient of friction on the palmar segment of the glove, and can be comprised of various grip-enhancing materials, coatings, and designs, including a plurality of regular or irregular projections, a plurality of regular or irregular depressions, fabrics, PVC dots, perimeter patching designs, linear and non-linear grooves, or combinations thereof, high friction surfaces, textured surfaces, non-slip materials and coatings, such as PVC coatings, nitrile coatings and latex coatings, and designs creating coarse surfaces such as eighty grit Emory cloth for example, as well as pebbled or beaded surfaces, convex or concave bumps, striations, cross-hatches, convex or concave linear and non-linear lines, angled ribs, random structures, convex or concave ridges, crevices, elongated segments, and the like. Preferably, the depths of the depressions and/or heights of projections would be such that the gap formed by the depressions or projections would allow for some movement of the palmar surfaces thereby increasing the grip capabilities of the user. The height or depth ranges generally begin at about 100 micrometers to several millimeters.

The grip enhancing means may further comprise a plurality of spaced apart stripes or striped projections formed from a high friction material, such as a PVC material, for example. Preferably the stripes comprise raised or projecting stripes and are arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters. These grip-enhancers may create a pattern, may be in rows or randomly placed, and may form circular and non-circular shapes, such as spherical, cylindrical or elongated. Additionally, they may be individually separated or interconnected. Furthermore, the grip enhancing means may comprise of grip enhancing panels affixed to the palmar portion of the glove body, and tackifiers coated onto the palmar glove body or by affixing a tackified material on to the glove body.

In general, a palmar portion surface of an embodiment can have a variety of finishes, one portion of the surface can have a smooth finish, for example, and another portion can have a textured surface. The textured portion could create a coefficient of friction, or grip enhancer, on the surface.

The grip enhancing means can be formed on the glove by any standard method, for example, by embossing, stamping or molding a portion of the glove to create the gripping means. For example, the grip-enhancing means can comprise of regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform heights, and have a more random pattern on the palmar portions forming the glove.

Alternatively, the grip-enhancing means may be attached, affixed or otherwise placed to select areas of the glove by standard methods and forms of attachment such as by overlaying a panel to select areas of the glove. This may be accomplished, for example, by creating a textured surface on a silicone-based layer and then hot melting said silicone surface onto the bottom surface of the most proximal end of the middle finger stall, thus providing a high friction surface on the embodiment. The grip enhancing means may be affixed to the glove by any other standard methods of attachment, such as by stitching.

The grip enhancing means is generally located on the palmar portion of the glove. Within that parameter, preferably, the grip enhancing means can be on any portion of any thumb stall or finger stall where a thumb or finger stall exist, any portion of the metacarpophalangeal joints, and any portion between the thumb stall and forefinger stall, generally defined by the forefinger metacarpal, the thumb metacarpal, and the glove segment between said metacarpals. The grip enhancing means can therefore be specifically positioned to provide enhanced grip and a higher coefficient of friction along select aspects of primarily the palmar of the glove. Of course, users may prefer any combination of the aforementioned. In at least one embodiment all of the above mentioned comprise of a grip enhancing means including all of the metacarpals. In at least one embodiment, the palmar segment itself comprises a grip-enhancer, thereby covering the entire palmar area of the glove.

Some embodiments of course will not have a grip enhancing means on any part of the glove. These embodiments absent of any grip enhancing means will be useful and significantly beneficial to football quarterbacks but also especially to those playing the sport of golf, primarily because of the unique finger configurations of the glove, for example.

The shock-absorbing member can comprise of any material that could provide added protection to a user's thumb, fingers, hand, wrist, or combinations thereof. In general, the shock-absorbing member can comprise of conventional materials for dissipating pressure across a surface area, can have varying densities and thicknesses, and can be in the form of a layer or multiple layers.

The shock-absorbing member may be flexible, compressible and resilient. The shock-absorbing member can comprise of, for example, any foam or cotton-based fabrics, cloth paddings, such as a cushion, foams such as a polyurethane foam pad, and flexible plastics, and the like, to absorb impact received from opposing players or from hitting the ground. It can comprise foam-filled segments, such as polyethylene foam pads, or it can be of cotton or cloth, or gels. For example, the shock-absorbing member may comprise of a unitary pad or pad segments, and may comprise any open cell or closed cell foam, such as BOLLARD foam, polyolefin foam and the like. The shock-absorbing member may also be made of any common materials used in providing glove padding, including natural or synthetic rubber, natural or synthetic rubber foams, gels, polyester fiber, or cotton or other natural or synthetic wadding materials. Additionally, it may comprise of foam possessing a substantially uniform cell distribution or polyvinyl chloride foam plastic.

The shock-absorbing member may comprise of cushions or pads which can be implemented as any of a variety of conventional padding material, such as foam rubber of varying densities and thicknesses, layers of fabric of various types and thicknesses, conventional gel or plastic material, liquid-holding compartments, or other types of conventional materials. The shock-absorbing member may also be fabricated from more rigid materials such as plastics or fiberglass materials. It will be apparent to one of ordinary skill in the art that many other implementations of the shock-absorbing member are possible.

The shock-absorbing member may range in thickness, beginning generally ranging from about 600 micrometers to several inches. The thickness may vary according to location, such as finger versus metacarpal areas, and degree of desired protection; generally, 600 micrometers in thickness provides the minimum level of protection for a quarterback's hand, any thinner is inadequate to protect from injury from impact.

The thickness of similar embodiments may vary depending on several factors, such as for example, user preference. In other words, embodiments may be configured to absorb more or less by the thickness of the shock absorbing member. The embodiment can thus create a cushioning effect to, for example, protect an injury. For example, quarterbacks who rarely rush with the football may only require a thinner pad, say 0.25 inch or less, as opposed to quarterbacks who more often need to rush with the ball.

The shock-absorbing member is primarily located on the dorsal portion of the glove. Within that parameter, preferably, the shock-absorbing member can overlay any portion of any thumb and/or finger where a thumb and finger stall exists, and/or any portion of the five metacarpals. In at least one embodiment, the entire dorsal segment comprises a shock-absorbing member, thereby generally mirroring the dorsal segment's design or structure of the glove.

Preferably, embodiments can also have a shock-absorbing member along the dorsal surface overlaying any portion of the wrist area including any of the carpometacarpal joints or the carpal bones, provided a segment overlaying the wrist exists. The shock-absorbing member overlaying the carpals on the wrist area may extend to also cover up to about five inches, and may do so as separate padding segments, for example, to allow for significant wrist flexibility, or may be configured as one pad.

The shock-absorbing member can be constructed on the glove using standard techniques placing paddings on gloves, such as by stitching for example, or may alternatively be integrally formed on the glove. For example, the shock-absorbing member may be encased in a compartment or compartments that are then attached to select areas of the dorsal surface area of the glove. Alternatively, said compartments may be integrally formed on the glove and the shock-absorbing member could be interposed in the glove, with the compartment or plurality of discreet shock-absorbing protective protrusions projecting out from the glove.

The construction of these compartments may comprise of any flexible material, such as rubber, or may be of the same materials that form the glove. Said compartment or compartments could house and allow said shock-absorbing member to project out to provide protection in desired areas along generally the dorsal surface of the glove, or may be stitched onto the dorsal surface area of the glove.

By way of example, if the shock-absorbing member is placed onto the outer surface of the dorsal segment, it is envisioned that the pad could be sewn, bonded or otherwise attached atop the dorsal segment of the glove. A shock-absorbing member could include an outer layer of material which encapsulates the pad and enables the outer periphery of the pad to be positioned without damaging the pad. For example, it is envisioned that the pad may include an outer layer made of the same material as the rest of the glove, or may be a heavier, thicker material, such as synthetic leather. The shock-absorbing member, in this case a pad, is then inserted into the compartment. The compartment can then be sewn, adhered to or otherwise secured on the glove, such as deposed adjacent the dorsal segment of the thumb stall.

The shock-absorbing member may also be integrally formed on the glove. For example, the shock-absorbing member may be located between the inner surface of the dorsal segment of the glove, and a liner or sleeve. The liner (or sleeve) material would therefore be positioned between the shock-absorbing member and a user's hand. The liner could be attached to the glove by standard methods, such as by conventional stitching about the perimeter of the dorsal segment, whereby the padded layer would be inserted and then sealed.

A similar method if the shock absorbing member is integrally formed on the sports glove comprises a flexible, preferably integrally molded dorsal member which has a tougher outer protective surface and a smooth hand contacting inner material, such as a liner or sleeve, being connected together around the peripheral edge of the molded member. The outer member may have a plurality of discrete shock-absorbing protective protrusions whereby the shock-absorbing members could be housed. The protrusions may be in a variety of heights and shapes, and of sufficient dimensions to house each shock-absorbing member.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in the rain or snow.

These novel features will give a quarterback added protection from the abrasion of hitting a user's fingers against the helmet of an opponent, for example, or while wrapping his throwing hand around the football when rushing. The shock-absorbing member sections of the present invention offer the unique ability of being able to protect an injury while maintaining grip capabilities in select areas by offering padded layer or layers, a significant and substantial advancement to prior art, such as bandages, thus providing a solution to a long-felt need of being able to protect a quarterback's throwing hand.

Some embodiments, of course, will not have a shock-absorbing member on any part of the glove. These embodiments that are absent of any shock-absorbing member will be useful and significantly beneficial to football quarterbacks but also especially to those playing the sport of golf, primarily because the unique finger configurations of the glove, as well as because of any grip-enhancing means on embodiments.

Embodiments may also comprise of a wrist securement opening means to secure the glove to the user's hand. The opening means may be, for example, an elastic means or a flap which mechanically engages a flap capture mechanism (e.g., a synthetic hook and loop fastening interface which adheres when pressed together, commonly using VELCRO). The wrist portion opening means may alternatively comprise an elastomeric band fixed around then wrist aperture. Embodiments may also have combinations of both a flap capture mechanism and an elastomeric band. The wrist portion may be formed integral with the glove or may be attached to the glove by standard methods, such as by sewing.

Some embodiment also comprise of a detachable ball marker. The ball marker may be secured by any standard fastening means, such as by magnetism or snap fastening, for example. The back portion of the detachable ball marker as well as the connecting dorsal segment of the glove may both therefore have small magnets. The ball marker may be circular or non-circular in design.

The location of the aperture along the forefinger segment will vary due to user preference and sport being played. The aperture is located on at least a portion of the proximal phalanx of the forefinger stall. Additionally, the aperture may be located on only the dorsal surface, the palmar surface, the side surface, or combinations thereof.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during the Winter months, usually during the football playoffs. Additionally, embodiments may also comprise various weather-resistant and perspirant-resistant materials, forms and designs including, but not limited to, water-resistant materials or micro-hole designs along any portion of the glove, for moisture management, or combinations thereof.

Embodiments may be made and manufactured using standard materials and methods in developing sports gloves. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers, rubbers, plastics, woven fabrics, non-woven fabrics, cloths, LYCRA, a vinyl material, a neoprene material, a fleece material, or combinations thereof.

The thickness of the dorsal and palmar segments can generally begin anywhere from about 0.005 inches to 0.040 inches or more as are standard sports gloves, for example, and can depend on several factors such as comfort and durability preferences. Some embodiments may offer more durable material for the dorsal surface thus requiring an even thicker dorsal segment. Of course, the more durable the material for more protection the glove may naturally provide.

SUMMARY

As described herein, the present invention overcomes the limitations of prior art in a number of significant ways. In general, embodiments of the present invention can generally be used in conjunction with any type of hand task activity and/or sports play. As discussed, embodiments offer an individual with the opportunity to increase overall hand task performance.

Maintaining or increasing overall control, for example, can provide many benefits to a user of these, and other embodiments.

These and other embodiments:

- offer the ability to grip as well as feel a ball, such as a football
- offer the ability to grip as well as feel a sports device, such as a golf club
- provide a unique solution for players who desire better grip capabilities only in select areas
- offer basic benefits that standard gloves offer, now offered also to quarterbacks
- offer a more stabilizing overall grip of a ball or object, by conveying grip-enhancers to select locations of the hand
- provide grip enhancers along the connecting area between the thumb and forefinger
- allow an individual to maintain or increase control of a ball or object along the metacarpophalangeal joints
- permit the ability to use a glove on a dominant hand configured to meet the unique needs of a user's preferred golf grip
- improve performance in hand task execution by providing heightened feel capabilities on a golfer's weak hand
- offer more control capabilities throughout a sports task, a valuable feature when striking a golf club with greater velocity
- afford more control throughout a football task, such as when throwing a slippery football or while under duress
- allow more hand coordination by adjusting grip-enhancers to match a preferred particular golf swing
- decrease the likelihood of football mishandles
- create more safety in playing the position of quarterback especially for the youth in our country
- give quarterbacks the necessary protection already offered to others who rush with the football, such as running backs These are among the many benefits of the present invention, and are not to be construed as limitations of the benefits nor their legal equivalent.

Although the description of the present invention only discussed two sports, it is understood that individuals playing other sports might benefit as well, such as baseball, volleyball and basketball.

Additionally, some embodiments discussed related to football may also be used in golf, and vice versa. In addition, the term 'overlay' is not meant to limit how the grip enhancing means or the shock-absorbing member will be created on embodiments of the present invention. Indeed, as has been demonstrated, the grip enhancing means and shock-absorbing member may be integrally formed on many of these embodiments. Therefore, use of the term 'overlay' may be defined more broadly, as "applied, affixed, formed on or otherwise created on."

Furthermore, only some embodiments have been discussed and in no way is intended to limit all the various embodiments and other embodiments that the present invention provides, such as but not limited to, different designs. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

FIG. 1 is a drawing of the palmar (front) view of an embodiment. The glove completely covers a user's thumb and middle finger. The glove also has a finger segment that covers the ring finger's proximal phalanx but does not extend to cover the ring finger's middle phalanx. Said glove further provides a pinkie finger segment that covers the pinkie finger's proximal phalanx but does not extend to cover the pinkie finger's middle phalanx. In addition, a forefinger segment exists that encloses the forefinger; said forefinger segment also has an aperture along the proximal phalanx.

FIG. 2 is a drawing of the embodiment as described in FIG. 1, showing the dorsal (back) view.

FIG. 3 is a drawing of the palmar (front) view of a second embodiment. The glove completely covers a user's thumb, middle finger and pinkie finger. In addition, a forefinger segment exists that encloses the forefinger; said forefinger segment also has an aperture along the proximal phalanx. There is no ring finger stall so there is no dorsal or palmar portion defining the ring finger stall; the glove provides a ringlet for the ring finger to extend through the glove.

FIG. 4 is a drawing of the embodiment as described in FIG. 3, showing the dorsal view.

FIG. 5 is a drawing of the palmar view of a third embodiment, shown as a partial-fingered glove. The thumb and middle finger are both completely covered. The ring finger segment and the pinkie finger segment both cover about ⅓rd of said fingers. In addition, a forefinger segment exists that encloses the forefinger; said forefinger segment also has an aperture along the proximal phalanx.

Figure 23:
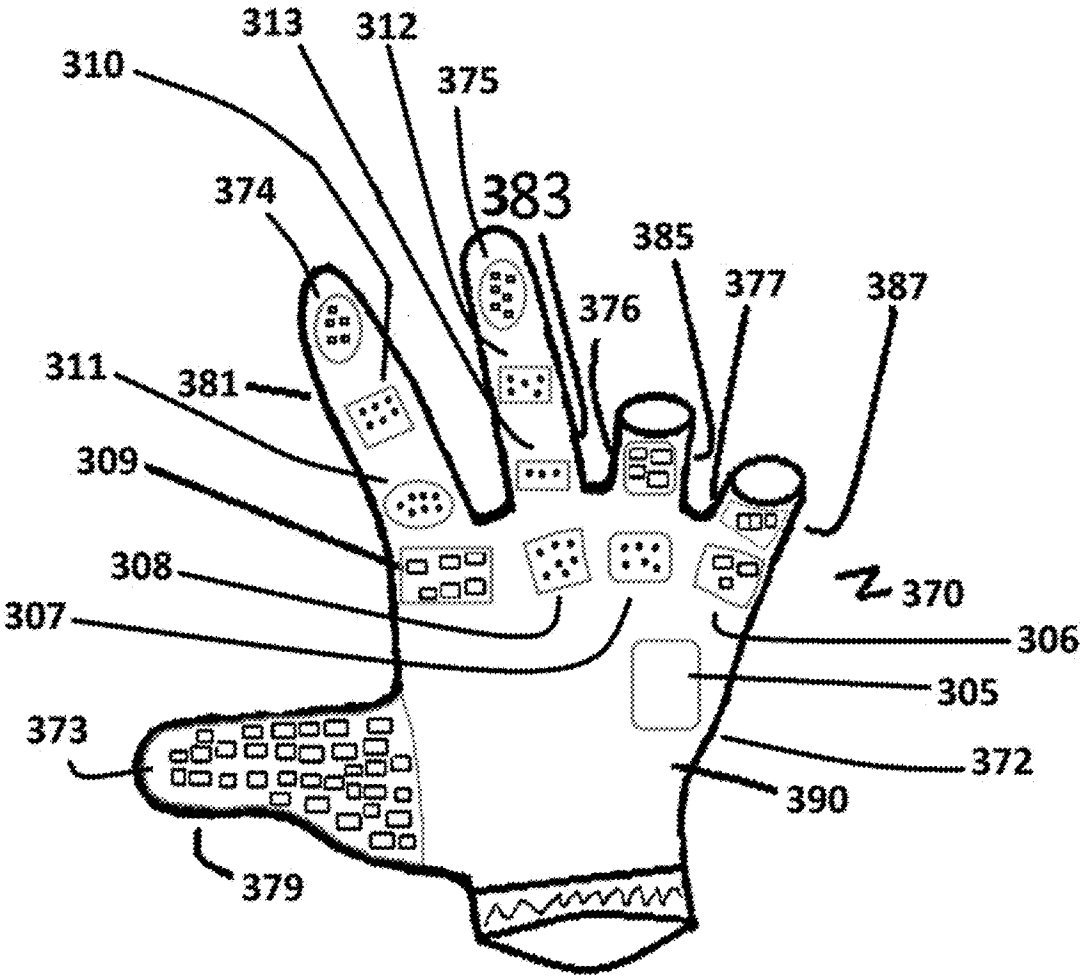

FIG. 23 is a drawing of the palmar (front) view of eighth embodiment. The glove completely covers a user's thumb and middle finger. The glove also has a finger segment that covers the ring finger's proximal phalanx but does not extend to cover the ring finger's middle phalanx. Said glove further provides a pinkie finger segment that covers the pinkie finger's proximal phalanx but does not extend to cover the pinkie finger's middle phalanx. In addition, a forefinger segment exists that encloses the forefinger; said forefinger segment also has an aperture along the dorsal portion to expose a portion of a user's forefinger.

Figure 24:
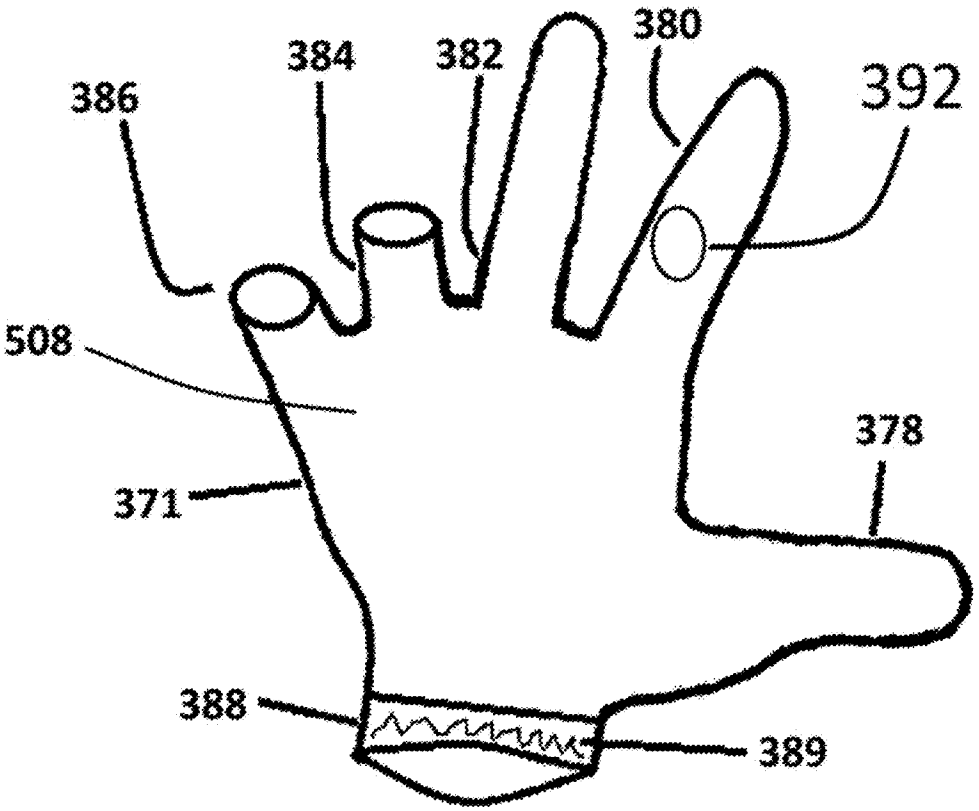

FIG. 24 is a drawing of the embodiment as described in FIG. 23, showing the dorsal (back) view.

Figure 25:
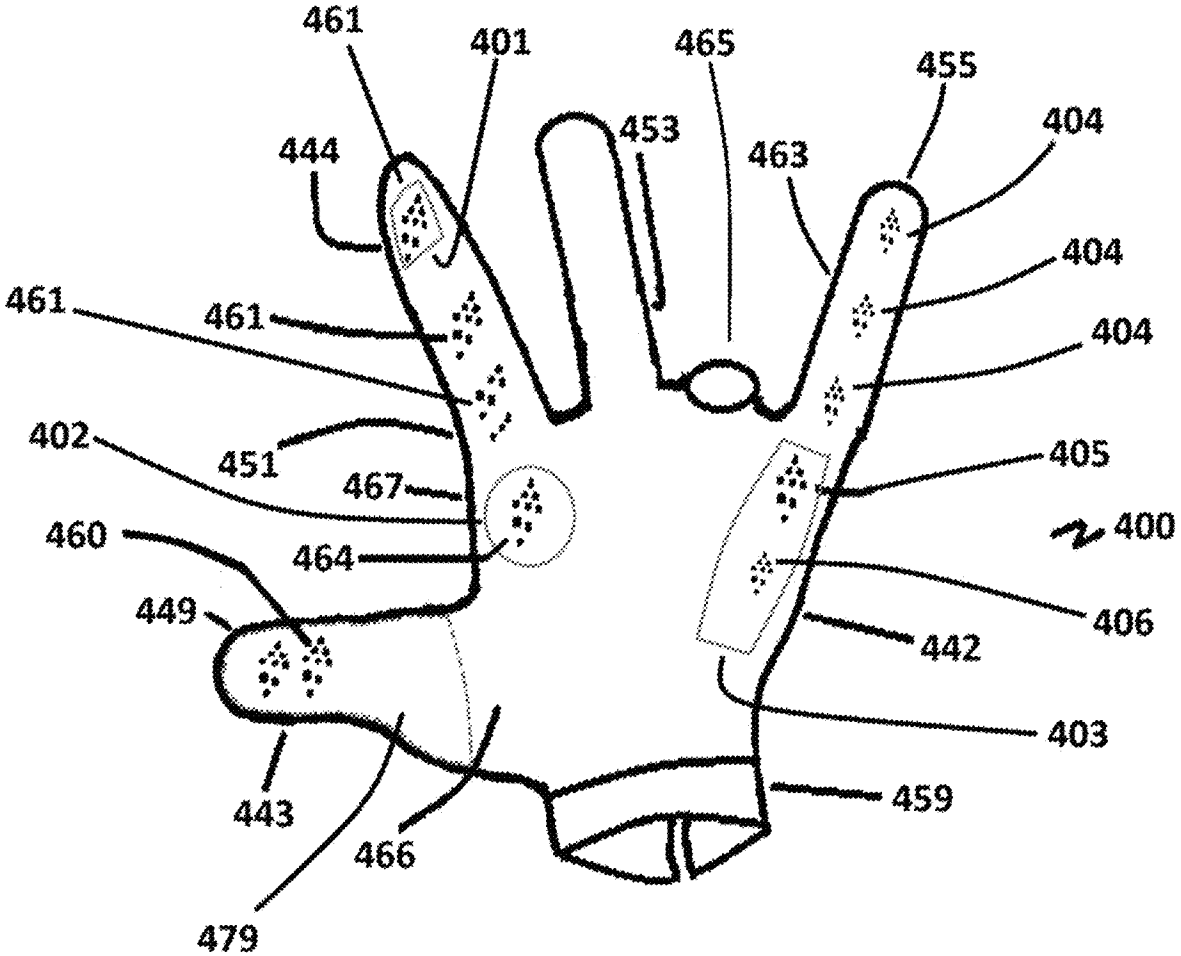

FIG. 25 is a drawing of the palmar (front) view of a ninth embodiment. The glove completely covers a user's thumb, middle finger and pinkie finger. In addition, a forefinger segment exists that encloses the forefinger; said forefinger segment also has an aperture along the dorsal portion to expose a portion of a user's forefinger. There is no ring finger stall so there is no dorsal or palmar portion defining the ring finger stall; the glove provides a ringlet for the ring finger to extend through the glove.

Figure 26:
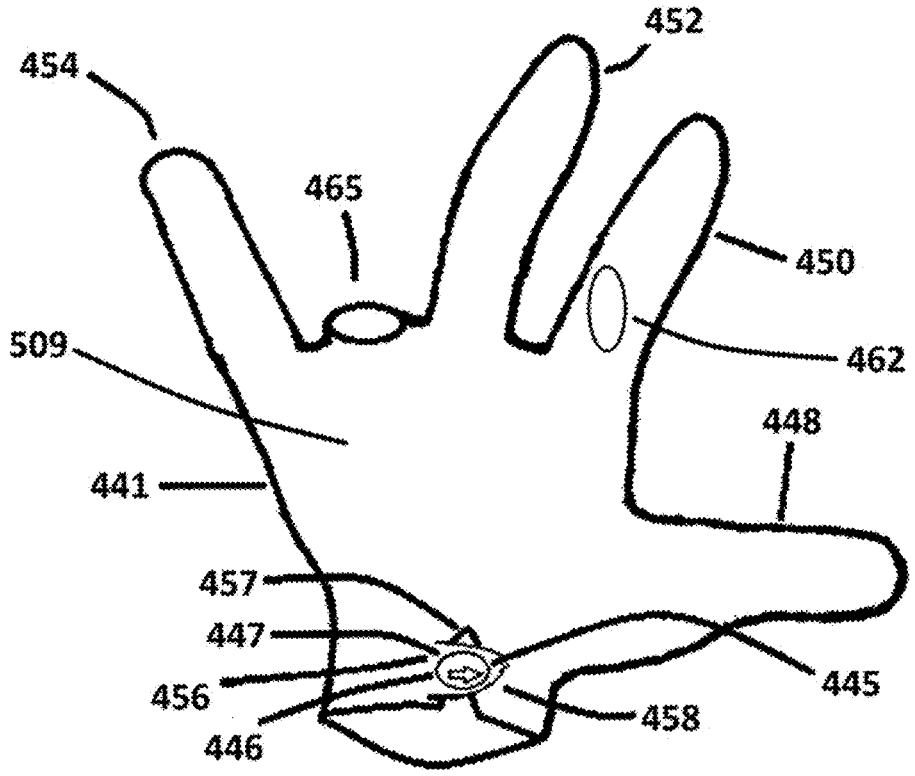

FIG. 26 is a drawing of the embodiment as described in FIG. 25, showing the dorsal view.

Figure 27:
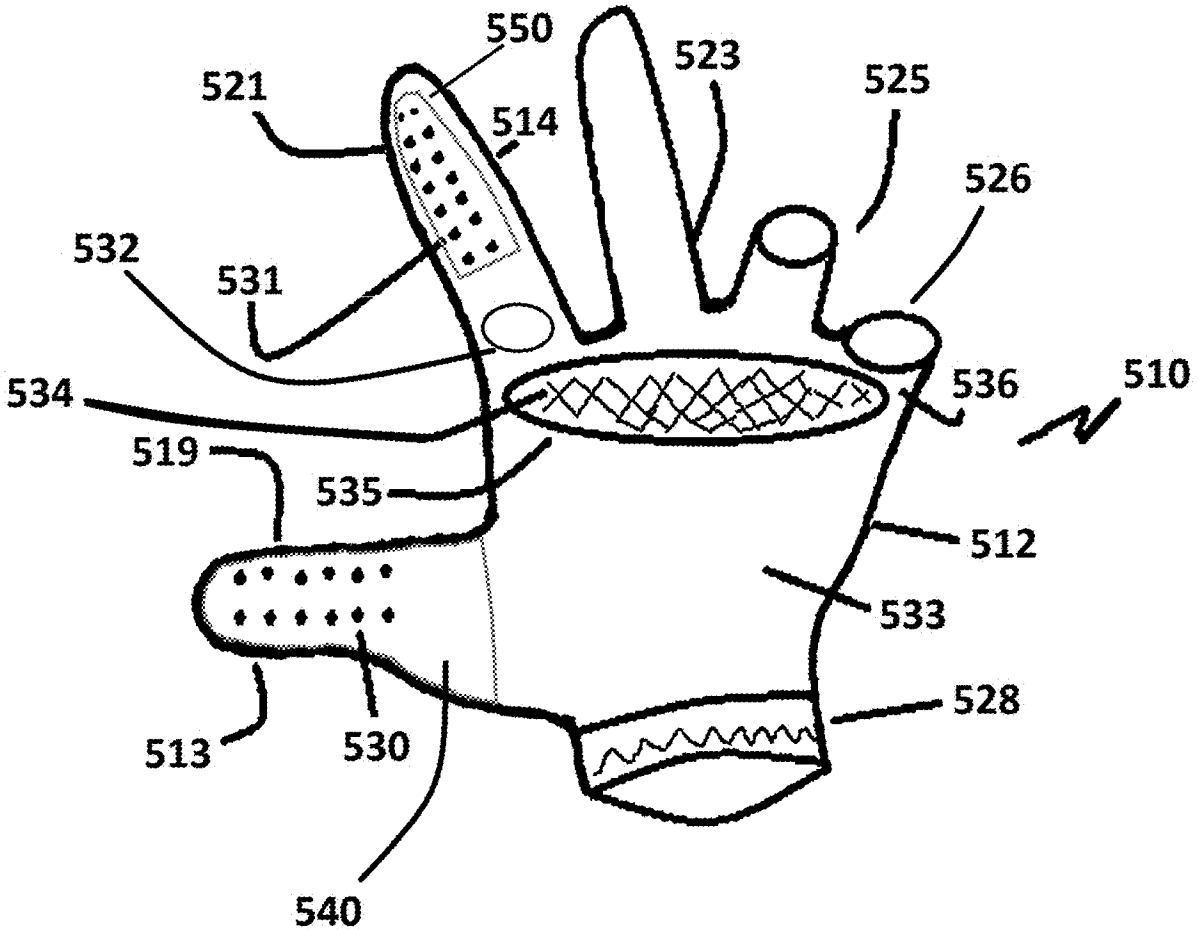

FIG. 27 is a drawing of the palmar view of a tenth embodiment, shown as a partial-fingered glove. The thumb and middle finger are both completely covered. The ring finger segment and the pinkie finger segment both cover about ⅓rd of said fingers. In addition, a forefinger segment exists that encloses the forefinger; said forefinger segment also has an aperture along the proximal phalanx.

Figure 28:
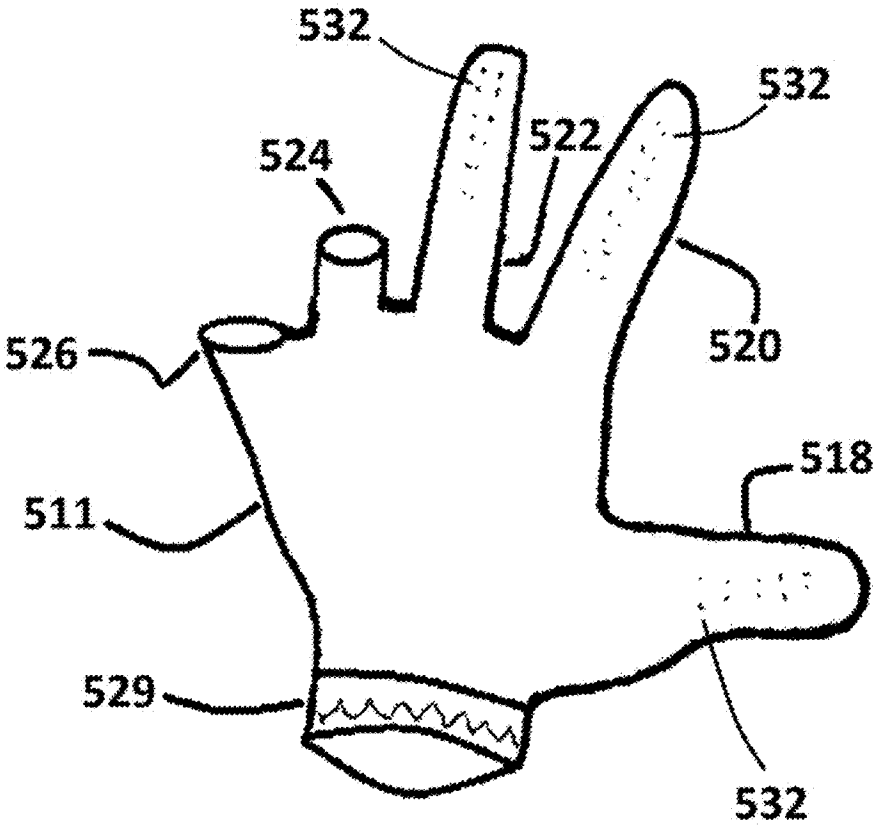

FIG. 28 is a drawing of the embodiment as described in FIG. 27, dorsal (back) view.

DETAILED DESCRIPTION OF THE DRAWINGS

It is expressly understood that the drawings are for the purpose of illustration and description only and are not intended as a definition of the limits of the invention.

Figure 1:
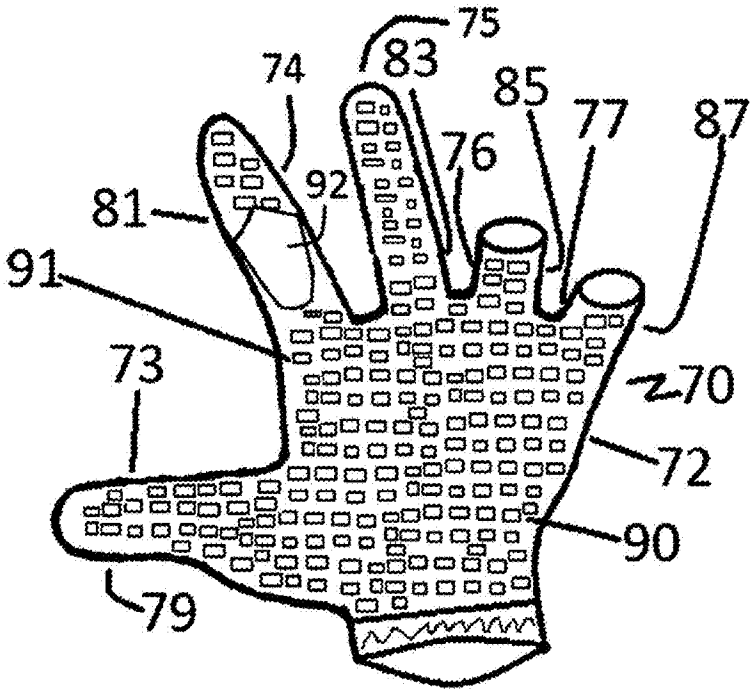
Figure 2:
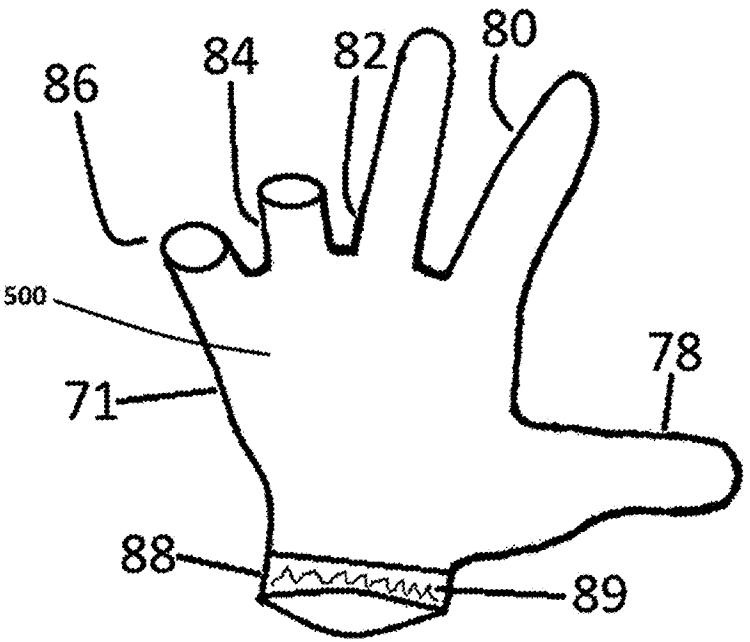

Referring now to FIG. 1 and FIG. 2, an embodiment of the present invention is shown and designated as 70. The palmar view of a left-handed glove is drawn in FIG. 1 and the dorsal view of the same glove is drawn in FIG. 2. This partial-fingered embodiment provides a glove having a dorsal portion 71, a palmar portion 72 for overlaying respective back and palm regions of a human hand, said dorsal and palmar portions having distal and proximal ends with a plurality of digital segments (or stalls) projecting from said distal ends. The glove includes a glove body having a back portion covering the back of the hand 71, and a front portion covering the palm or front of the hand 72. The glove body includes a plurality of finger stalls (or digital segments) and a thumb stall (digital segment) each adapted to receive a finger or thumb, respectively, therein.

In the illustrated embodiment, the glove is constructed such that the thumb 73 and forefinger 74 digital segments enclose a user's thumb and forefinger, respectively, including enclosing the fingertips. The glove has a middle finger segment that covers the middle finger 75, a ring finger segment that covers the ring finger's proximal phalanx 76 but does not extend to cover the ring finger's middle phalanx, and a pinkie finger segment that covers the pinkie finger's proximal phalanx 77 but does not extend to cover the pinkie finger's middle phalanx.

The forefinger segment also has an aperture 92 that is located on about fifty percent of the proximal phalanx and extends to about sixty percent of the middle phalanx of the forefinger segment's palmar portion. The aperture also extends out to the side of the aforementioned areas, but does not generally extend onto the dorsal surface of the forefinger segment 74. The aperture also does not extend beyond the distal interphalangeal nor below the metacarpophalangeal, thus defining its terminal edges.

The palmar section also covers the palm segment overlaying the palm of the hand 72; the dorsal section also covers most of the back of the hand 71. The glove also has a wrist portion that surrounds the wrist of a user.

The thumb stall 73 is defined by a dorsal portion 78 and a palmar portion 79. The forefinger stall 74 is defined by a dorsal portion 80 and a palmar portion 81. The middle finger stall 75 is defined by a dorsal portion 82 and a palmar portion 83. The ring finger stall 76 is defined by a dorsal portion 84 and a palmar portion 85. The pinkie finger stall 77 is defined by a dorsal portion 86 and a palmar portion 87.

The wrist portion is preferably expansible so as to hold more securely to the user's wrist. Therefore the embodiment also has an expandable opening means 88 at a wrist end 89 adapted to receive the user's hand. The expandable opening means comprises an elastic material along the wrist portion, such as an elastomeric band 88 fixed around the wrist. If desired, the opening means may comprise a strap means at the open end of the glove body for fastening the glove body secure about the wrist area. The strap may have two pads of cohesive-adhesive material for releasably securing the strap. The strap as well as this wrist portion may be sewn onto the glove.

This embodiment further shows how the present invention may comprise a grip enhancing means 90. Although the embodiment now provides a higher coefficient of friction than what the skin of throwing hand of a quarterback or a golfer's dominant hand would otherwise provide, one may now further increase grip areas by adding a grip enhancing means on select areas or on the entire palmar surface of the glove.

In the illustrated embodiment, the grip enhancing means 90 comprises a high friction surface 90 formed on the entire palmar portion of the glove body 72, including the palmar surfaces of the thumb segment 79 and any existing finger segments 81, 83, 85 and 87. Preferably, the high friction surface is formed from a PVC material, a nitrile material, a latex material, or a rubber material 90. The surface may include a depression or projection pattern formed from the high friction material. Formed on the illustrated material is a grip enhancing means comprising a plurality of square-like projections 91 that are applied to the entire palmar surface area by any standard means. These square-like projections preferably are spaced apart to allow for added grip and flexibility. The rubber palmar surface can then be conjoined to the dorsal surface, thus creating the glove.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material on the dorsal surface overlaying said metacarpophalangeal joints while the rest of the dorsal surface is comprised of a more durable material. The elastic material could be stitched onto those areas, and therefore replacing the more durable materials along those select areas. Alternatively, said joints may simply have protrusions molded into the dorsal surface thereby allowing added flexibility along select areas of the hand 166.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

Additionally, embodiments such as this one, may be coated with a with a water repellant substance, such as a synthetic resin 500 throughout the entire outer surface of the glove. Alternatively, the embodiments may also comprise of micro holes/recesses along any portions of the glove, generally used on golf gloves and football gloves for ventilation or moisture management purposes. These micro holes are generally about 0.120 millimeters or so in diameter.

As aforementioned, this embodiment provides users with several benefits, in multiple sports. For example, football quarterbacks may use this embodiment on their dominant hand thereby allowing the quarterback significantly more grip capabilities while simultaneously being able to have heightened tactile abilities at the same time on key areas of the dominant hand. Configuring the glove in this unique manner solves the problems which have previously prevented most football quarterbacks to choose to play the position of quarterback without the use of a glove. This embodiment thereby overcomes the prior art deficiencies.

By way of example, those who play golf would also significantly benefit by using this embodiment. A golfer who grips a golf club using the interlocking grip could particularly benefit by placing this embodiment over their dominant hand thereby creating a much strong overall grip while not losing much tactile sensations because of the partially uncovered ring finger but especially due to the aperture on the forefinger.

By way of example, baseball pitchers may also find this embodiment beneficial over their strong (pitching) hand primarily because it offers grip enhancing capabilities on the fingertips on select digital segments while allowing the pitcher to maintain heightened feel by simultaneously providing the pitcher with the ability to touch the baseball with his or her skin.

Figure 3:
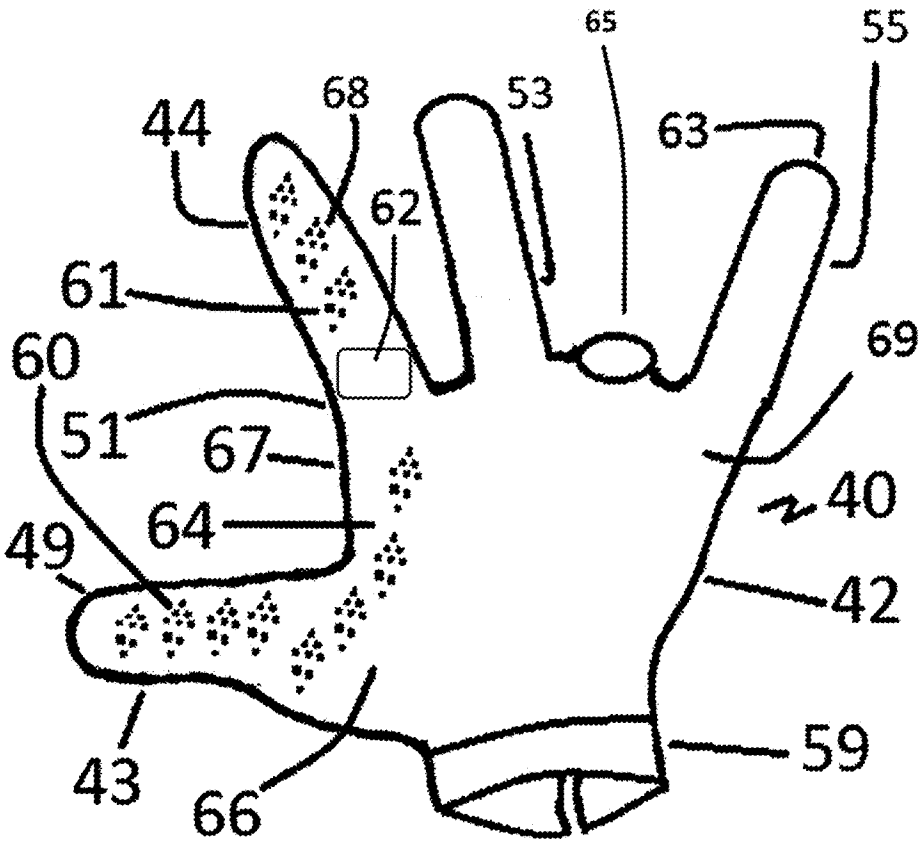
Figure 4:
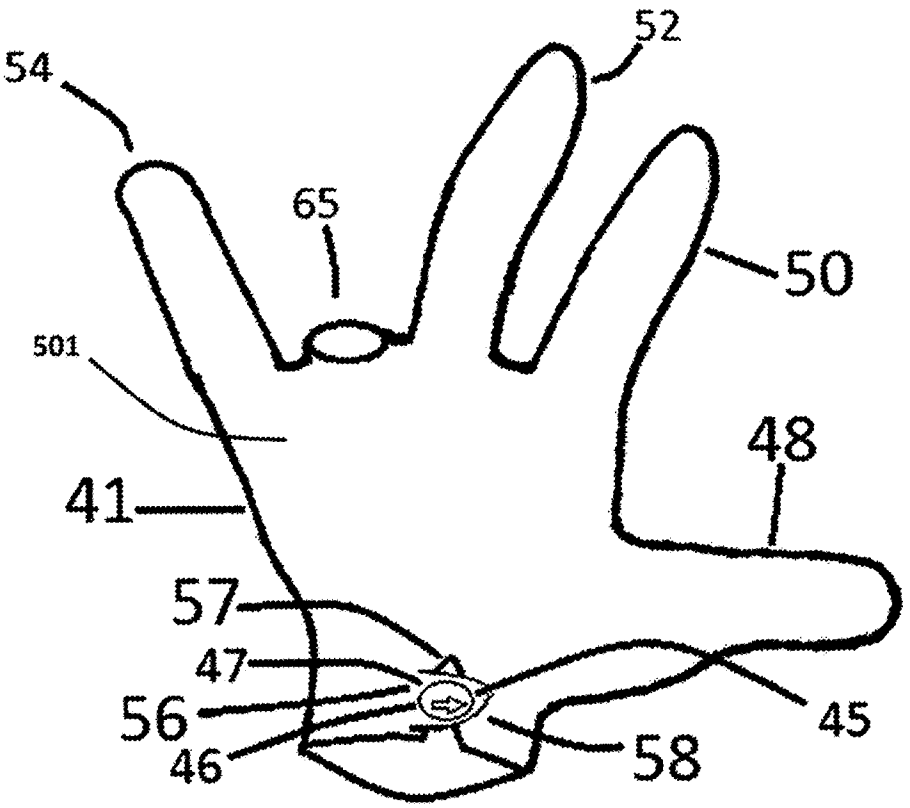

Referring now to FIG. 3 and FIG. 4, a second embodiment of the athletic glove of the present invention is shown and designated as 40. The palmar (front) view of a left-handed glove is drawn in FIG. 3 and the dorsal (back) view of the same glove is drawn in FIG. 4. This partial-fingered embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 41, and a front portion covering essentially the entire palm surface of the hand 42. The glove body includes finger segments and a thumb segment each adapted to receive a finger or thumb, respectively, therein.

The glove is constructed such that the thumb 43, forefinger 44, middle finger 53, and pinkie finger 63 digital segments separately completely enclose a user's thumb, forefinger, middle finger, and pinkie finger, respectively, including enclosing the fingertips. Additionally, an aperture exists 62 only along the proximal phalanx of the forefinger digital segment 44.

Furthermore, the ring finger of a user is completely uncovered therefore this embodiment does not have a ring finger digital segment. The glove provides a ringlet or recess 65 whereby a wearer's ring finger may extend entirely through said glove. Providing a golf glove without a ring finger stall solves significant problems for golfers who are married or engaged. Prior art gloves provide ring finger stalls that fit snugly around a user's ring finger. The problem is, of course, if a user is married or engaged she or he is wearing a ring on her ring finger. Prior art forces the user to either take off her rings while swinging a golf club, or be highly uncomfortable and distracted by the ring finger stall continually pushing down on the rings and ring finger. By providing a recess in lieu of a ring finger stall, the user now may play golf without forsaking her beloved and taking off their rings.

The palmar portion of the glove therefore covers the rest of the front of the hand, including the entire palm of the hand 42; the dorsal section covers most of the back of the hand 41, allowing for a slit on the wrist portion for an opening to more easily insert a hand. The thumb stall 43 is defined by a dorsal portion 48 and palmar portion 49. The forefinger stall 44 is defined by a dorsal portion 50 and a palmar portion 51. The middle finger stall is defined by a dorsal portion 52 and a palmar portion 53. The pinkie finger stall is defined by a dorsal portion 54 and a palmar portion 55. There is no ring finger stall so there is no dorsal or palmar portion defining the ring finger stall; however the dorsal and palmar portion provides a ringlet 65 for a user's ring finger to extend completely through the glove 40.

The embodiment is also comprised of an aperture 62 along the forefinger segment 44. This aperture is bounded by the proximal phalanx portion of the forefinger segment, thus the aperture only exposes a user's forefinger proximal phalanx. The aperture is rectangular in general structure, and is located primarily on the palmar surface.

The glove also has an expandable opening means at a wrist end portion 59 adapted to receive the user's hand. The expandable opening means comprises a strap means 56 at the open end 57 of the glove body for fastening the glove body secure about the wrist area. The strap means may be unitary with the glove body and may include VELCRO fasteners 58, buttons, and the like or other suitable closure means thereon. The wrist portion is preferably expansible so as to hold more securely around the user's wrist. The dorsal surface of the glove therefore has an uncovered portion 57. As with other embodiments, the glove may alternatively have an expandable opening means comprised of an elastic material to expand and contract for easier glove application onto a hand.

This embodiment further shows how the present invention may also comprise a grip enhancing means 68. Although the embodiment now provides a higher coefficient of friction on the throwing hand of a quarterback or on a golfer's non-dominant hand, one may now further increase grip areas by adding a grip enhancing means on select areas.

The illustrated embodiment has a grip enhancing means 68 on select areas of the palmar portion—or front—of the hand, specifically along the thumb and forefinger digital segments as well as along the region between the thumb and forefinger segments. The grip enhancing means 68 comprises ovals depressions 68, each having a depth of at least about three hundred micrometers, and are further grouped in diamond shaped clusters 68 to allow for greater hand flexibility and movement.

The plurality of ovals located on the palmar section of the thumb stall 60 and forefinger stall 61 are throughout said stalls. Similar embodiments may have a grip enhancing means along only the distal phalanx of the thumb segment or the distal phalanx of the forefinger, or combinations thereof, to maximize grip abilities primarily on the fingertips of the thumb and forefinger.

A grip enhancing means 68 is also on the palmar portion of the glove overlaying the area between the thumb and the forefinger segments 64, generally defined by the portion overlaying the forefinger metacarpal, the thumb metacarpal 66 and the area between said metacarpals extending to the edge of the palm 67. The grip enhancing means 68 can also comprise of a high friction surface by applying a non-slip coating, such as a latex, a nitrile, or PVC coating, along described locations of this embodiment 60, 61 and 64. The coating could of course also be applied to the entire palmar portion of the glove 42.

The locations of the grip enhancing means may vary on several factors of course, such as personal preference and preferred degree of enhanced grip. Additionally, the depressed designs may vary, such as being in the form of non-linear or crisscross lines, for example.

As discussed, the grip-enhancing means 68 may be integral to the glove or may be affixed to the glove using any standard methods. For example, this embodiment comprises grip enhancing means 68 that are integral to the glove 40, using any standard method to accomplish this, such as stamping said depressed ovals on described portions of the glove. As mentioned, the grip enhancing means can also comprise of a high friction surface by applying a non-slip coating, such as latex, nitrile or PVC coating. These coatings may be a preferable choice when applying a grip enhancing means on any metacarpophalangeal joints. For example, a similar embodiment may comprise a grip enhancing means 68, such as a nitrile coating 69 over the palmar portion of the pinkie finger's metacarpophalangeal joint 69. This would be especially useful for golfers using the interlocking grip, for example, by providing added grip along the area where the fingers interlock.

This embodiment also comprises a detachable ball marker 45. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 45 with a design that points to where the golf ball exactly is located. In this embodiment, the design is an arrow 46. The golfer will then place the ball marker just behind the golf ball but will now know exactly where the golf is by placing the arrow exactly behind the golf ball. The detachable ball marker is secured by any standard fastening means, such as by magnetism (as shown) or snap fastening, for example. The back portion of the detachable ball marker as well as the connecting dorsal segment of the glove 47, both therefore have small magnets. The ball marker may be circular or non-circular in design.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

The embodiment is suitably a substantially conventionally constructed sports glove, modified as aforementioned. This particular glove can be made of a polyester and cotton blend for superior comfort or of a synthetic leather latex coated glove for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, and cloths. Examples of synthetic yarns include nylon, polyester, and spandex (polyurethane) yarns. Additionally, embodiments such as this one, may be coated with a with a water repellant substance, such as a SCOTCH GUARD 501 throughout the entire outer surface of the glove.

Alternatively, the embodiments may also comprise of micro holes/recesses along any portions of the glove, generally used on golf gloves and football gloves for ventilation or moisture management purposes. These micro holes are generally about 0.120 millimeters or so in diameter.

Figure 5:
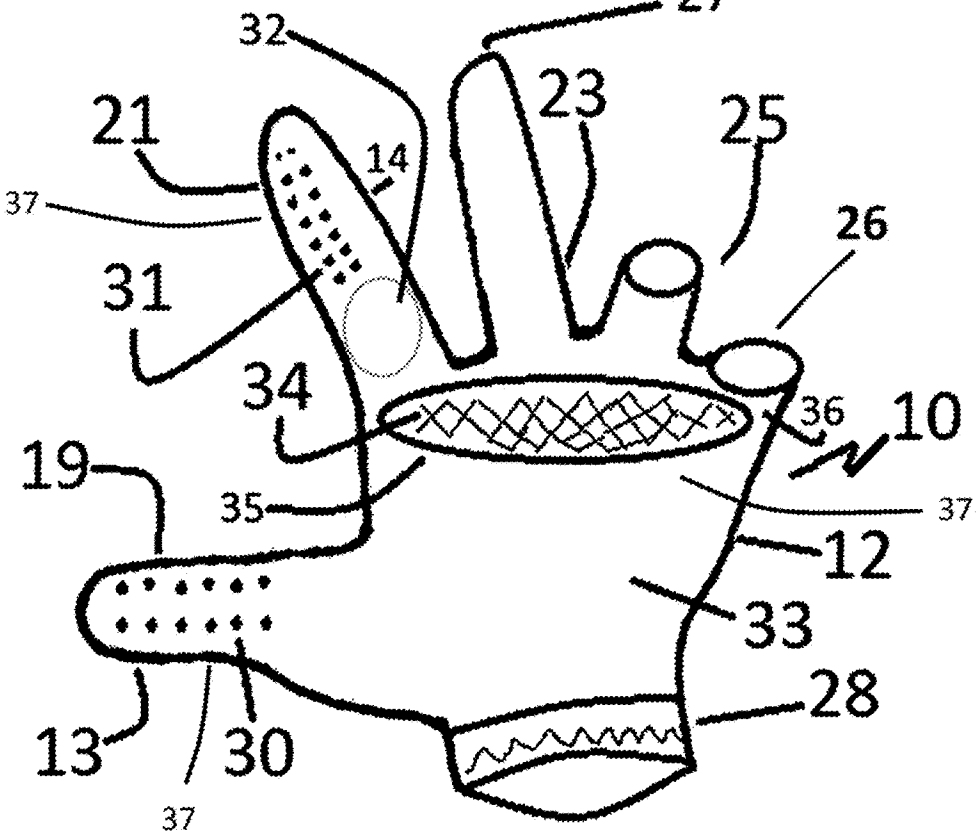
Figure 6:
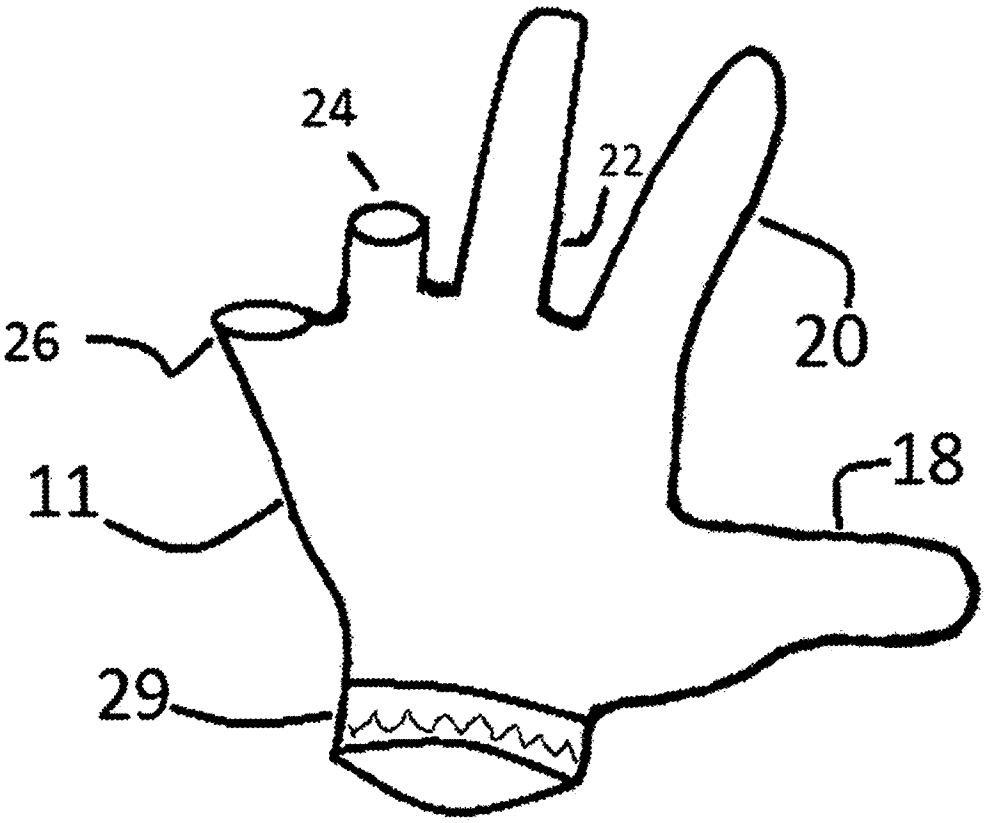
FIG. 6 is a drawing of the embodiment as described in FIG. 5, dorsal (back) view.

Referring now to FIG. 5 and FIG. 6, an athletic glove of the present invention is shown and designated as 10. The palmar (front) view of a left-handed glove is drawn in FIG. 5 and the dorsal (back) view of the same glove is drawn in FIG. 6. This partial-fingered embodiment provides a glove having a dorsal portion 11, a palmar portion 12 for overlaying respective back and palm regions of a human hand, said dorsal and palmar portions having distal and proximal ends with a plurality of digital segments (or stalls) projecting from said distal ends. The glove includes a glove body having a back portion covering the back of the hand 11, and a front portion covering the palm or front of the hand 12. The glove body includes finger stalls and a thumb stall each adapted to receive a finger or thumb, respectively, therein.

In the illustrated embodiment, the glove is constructed such that the thumb, forefinger and middle finger digital segments enclose a user's thumb, forefinger and middle finger, including enclosing the fingertips. The glove also provides a ring finger segment that covers the ring finger's proximal phalanx but does not extend to cover the ring finger's middle phalanx; a user's ring finger is therefore covered about one-third of the way up.

There is no pinkie finger stall so there is no dorsal or palmar portion defining the pinkie finger stall. The glove provides a ringlet or recess 26 whereby a wearer's pinkie finger extends entirely through said glove.

The embodiment is also comprised of an aperture 32 along the forefinger segment 14. This aperture is located on about thirty percent of the proximal phalanx and about seventy percent of the middle phalanx portions of the forefinger segment. The illustrated aperture does not extend below the forefingers' metacarpophalangeal or above its proximal interphalangeal. The aperture is oval in general structure, and is located primarily on the palmar surface.

The palmar section covers the entire palm of a user's hand 12 and the dorsal section covers the back of a user's hand 11, allowing only for any micro recesses, typically used to provide ventilation. The glove also has a wrist portion that surrounds the wrist of a user.

The thumb stall 13 is defined by a dorsal portion 18 and a palmar portion 19. The forefinger stall 14 is defined by a dorsal portion 20 and a palmar portion 21. The middle finger stall is defined by a dorsal portion 22 and a palmar portion 23. The ring finger stall is defined by a dorsal portion 24 and a palmar portion 25. This embodiment does not have a pinkie finger segment. The glove provides a ringlet 26 or recess whereby a wearer's pinkie finger may extend entirely through said glove.

The wrist portion is preferably expansible so as to hold more securely to the user's wrist. Therefore the embodiment also has an expandable opening means 28 at a wrist end 29 adapted to receive the user's hand. The expandable opening means comprises an elastic material along the wrist portion, such as an elastomeric band 28 fixed around throughout the wrist. If desired, the opening means may comprise a strap means at the open end of the glove body for fastening the glove body secure about the wrist area. The strap means may be unitary with the glove body and may include VELCRO fasteners, buttons, and the like or other suitable closure means thereon.

This embodiment further shows how the present invention may comprise a grip enhancing means 37. Although the glove now provides a higher coefficient of friction on the throwing hand of a quarterback or on a golfer's dominant hand, for example, one may now further increase grip capabilities by adding a grip enhancing means along the palmar surface of the glove.

The thumb and forefinger digital segments of this embodiment each also comprise a grip enhancing means 37, in the form of a plurality of projections 30, 31, 34 such as PVC dots 30, 31, on at least a portion of the thumb and forefinger segments. The PVC dots preferably project out at least about three hundred micrometers. The PVC dots located on the palmar section of the thumb 30 and forefinger stalls 31 are throughout said stalls, including on the distal phalanges of the thumb and forefinger. Similar embodiments may have a grip enhancing means along only the thumb segment overlaying the distal phalanx or the forefinger's distal phalanx, or combinations thereof, to maximize grip abilities on the fingertips of the thumb and forefinger.

The grip enhancing means 37 may be integral to the glove or may be affixed to the glove using any standard methods. For example, this embodiment comprises grip enhancing means 37 that are integral to the glove thumb and forefinger stalls, using any standard method known in the art. For example, the PVC dots can be imparted by any standard methods, such as, for example, by molding. The heights of the PVC dots in this embodiment are all the same height, and are in rows. Other embodiments could of course offer different heights, non-uniform heights, and have a more random pattern on the top surface.

The locations of the grip enhancing means may vary on several factors of course, such as personal preference and preferred degree of enhanced grip. This added grip configuration will be useful especially to quarterbacks and golfers for reasons described herein. Other grip enhancing configurations and locations may of course be preferred.

For example, a quarterback who often rushes with the football may prefer a grip enhancing means throughout any existing finger stalls, whereas a quarterback who often throws the football may prefer a grip enhancing means on the fingertips of the thumb and forefinger segments, and along the area between the thumb and forefinger metacarpophalangeal joints 64 (See FIG. 3). Having a gripping enhancing means along these areas will significantly increase the quarterback's ability to control the football throughout a throw or rush attempt by creating an even higher coefficient of friction than the rest of the glove body.

A golfer may have similar grip enhancing preferences as those discussed. An individual using the overlapping grip method may additionally desire a grip enhancing means overlaying the palmar surface areas. The resulting grip enhancing configurations would offer the golfer added control on the dominant hand's thumb and forefinger. Additionally, the partially uncovered fingers as well as the aperture along the forefinger segment offer maximum retention of tactile sensation. The uncovered finger portions allow the user to maximize hand coordination, for example, while the aperture allows the user to maintain maximum feel ability on the golf club—both crucial aspects in completing a successful golf swing. This unique offering will significantly increase the golfer's ability to control a golf club and also therefore a golf swing and golf ball.

The embodiment's grip enhancing means 37 can also comprise of a high friction surface, such as a plurality of crisscross projections, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint, 34. The grip enhancing means portion overlaying the pinkie finger metacarpophalangeal joint preferably does not extend over the upper-palmar crease, however, to provide optimal flexibility. The height of the projections may vary, as aforementioned. These projections are about one millimeter, for example.

The grip enhancing means can also comprise of a high friction surface by applying a non-slip coating, such as a latex, a nitrile or PVC coating, along described locations of this embodiment. The coating could of course also be applied to the entire palmar portion of the glove.

Additionally, embodiments such as this one, may be completely coated with a with a water repellant substance 33, such as a synthetic resin on the palmar surface or throughout the entire glove. Alternatively, a plurality of micro recesses of about 0.120 millimeters in diameter may be randomly disposed about the front, back and finger and thumb stalls of the glove, thereby providing added comfort and more ventilation.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

This embodiment further shows how the present invention may comprise of the same materials to construct both the palmar and dorsal surface. This particular glove can be made of a polyester and cotton blend for superior comfort, say about seventy percent polyester. The polyester thread, for example, could be spun with the cotton yarns to produce the composite. Other materials that could comprise these glove embodiments include, but are not limited to woven materials that include natural, synthetic or blends of natural and synthetic yarns, flexible plastics, and thermoextruded or thermoset rubbery embodiments including those made from thermoplastic elastomers. Examples of synthetic yarns include nylon, polyester, and spandex (polyurethane) yarns, and LYCRA.

This embodiment also may comprise a grip enhancing means 37 that is affixed to the glove. In general, as aforementioned, a grip enhancing means may be either formed on or applied to any palmar portion, such as the palm or any thumb or any existing finger stalls, using any standard methods. The embodiment's gripping means can comprise of a high friction surface, such as creating crisscross 34 or grooves that are formed on a rubber grip enhancing panel 35, for example, then attaching said grip enhancing panel onto a portion of the gloves palmar surface area. The panel is attached to the palmar surface of the glove by any standard methods of attachment, such as by adhesion or stitching.

The grip enhancing panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 36. The panel portion overlaying the pinkie finger metacarpophalangeal preferably does not extend over the upper-palmar crease, however, to provide optimal flexibility. This form of attachment may additionally be used to affix a grip-enhancing means over the thumb stall, any existing finger stalls and/or along the area between the forefinger and thumb stalls, in part or in their entirety.

The grip enhancing means formed of a panel 35 may generally be comprised of any flexible material, for example, a plastic material having a top surface comprising the grip enhancing area formed by a plurality of depressions, such as, for example, ridges. A preferred depth of the depressions would be such that the gap formed by the depressions would allow for some movement of the newly formed top surface edges thereby increasing the grip capabilities of the user. This grip enhancing means could have a preferred depth beginning about three hundred micrometers, and can be imparted by, for example, embossing or standard mechanical treatments. The panel may then be bonded to, and become a part of the top surface of a portion of the glove, by any standard method such as, for example, cementing or hot melt gluing.

The panel 35 provides an effective coefficient of friction, preferably of at least a Shore A Durometer Coefficient of Friction of 1.5. More preferably, said panel provides a Shore A Durometer Coefficient of Friction of between 1.5 and 4.5; More preferably, said panel provides a Shore A Durometer Coefficient of Friction of between 2.0 and 4.5; Still more preferably, said panel provides a Shore A Durometer Coefficient of Friction of between 2.5 and 4.5.

Figure 7:
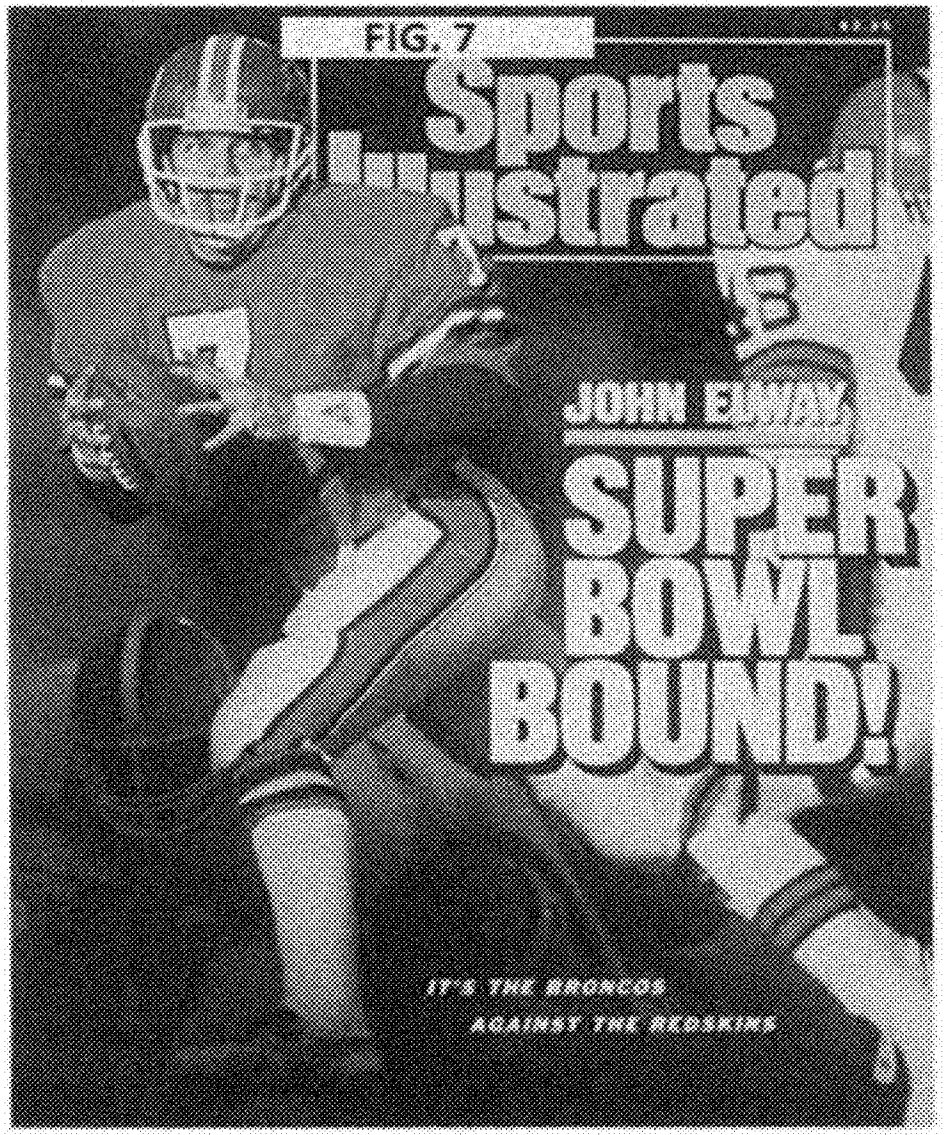
FIG. 7 is a picture of a famous football quarterback's football grip.

Referring now to FIG. 7 is a picture of John Elway's hall of fame football grip and captures a standard method of a quarterback prepares to throw a football.

Figure 8:
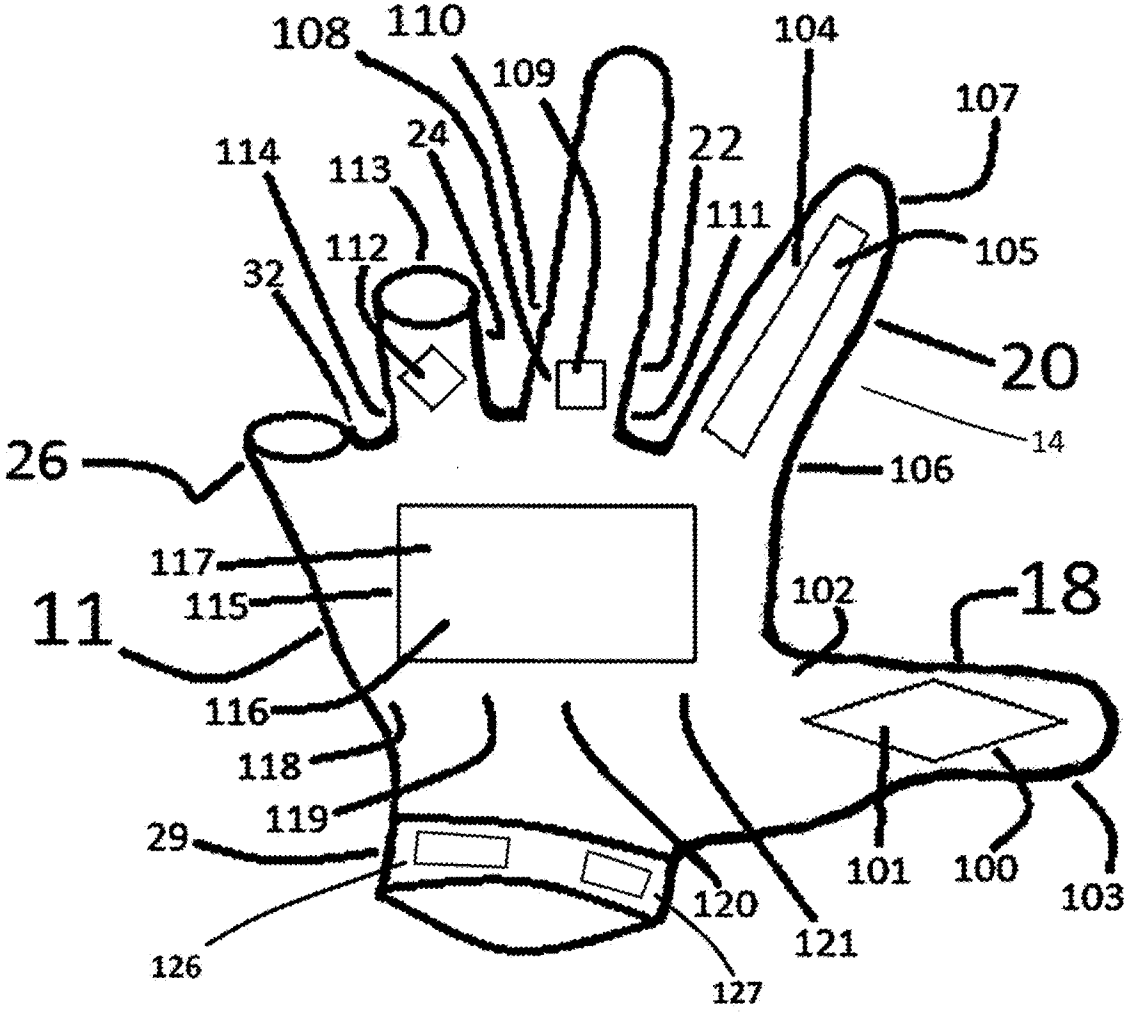
FIG. 8 is an alternative dorsal segment to the glove drawn and described in FIG. 5, showing shock-absorbing members.
Figure 9:
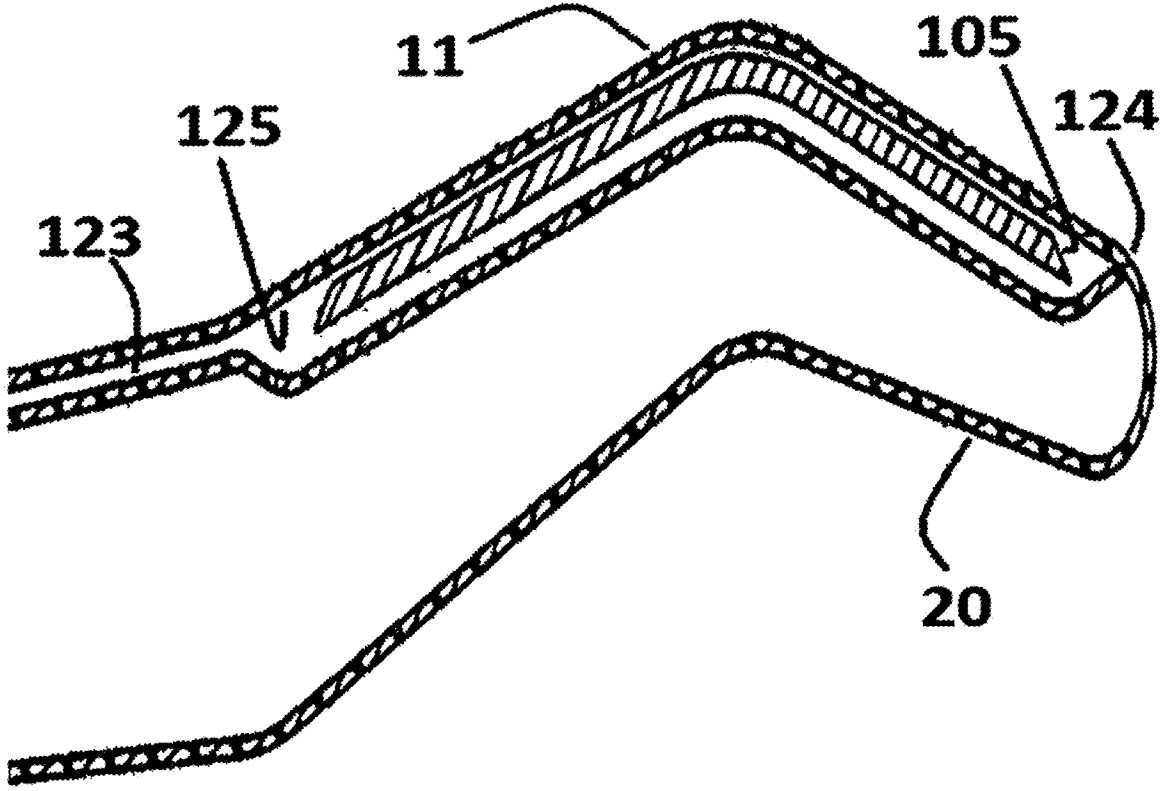
FIG. 9 is a cross-sectional view of FIG. 8, showing a liner.

FIG. 8 and FIG. 9 show an alternative dorsal portion to FIG. 5. Embodiments may also preferably comprise of a shock-absorbing member along any portion of the dorsal surface, such as any or all existing finger and thumb stalls, along the dorsal surface overlaying any or all of the metacarpals, or combinations thereof.

In the illustrated embodiment, the glove is constructed such that the thumb, forefinger and middle finger digital segments enclose a user's thumb, forefinger and middle finger, including enclosing the fingertips. The glove also provides a ring finger segment that covers the ring finger's proximal phalanx but does not extend to cover the ring finger's middle phalanx, and therefore is covered about one-third of the way up.

There is no pinkie finger stall so there is no dorsal or palmar portion defining the pinkie finger stall. The glove provides a ringlet or recess 26 whereby a wearer's pinkie finger extends entirely through said glove. The embodiment is also comprised of an aperture 32 along the forefinger segment 14.

This embodiment has a shock-absorbing member along substantially all of the dorsal surface overlaying the thumb 18. The shock-absorbing member overlaying the thumb is in the pattern of a diamond 100, and is configured as a one pad segment 101. Other embodiments may prefer to overlay the thumb as separate padding segments, for example, to allow for significant finger flexibility by having one pad overlaying only the proximal phalanx, and a second pad overlaying only the distal phalanx of the thumb. By not covering any of the thumb joints you have added flexibility but less protection.

The length of the shock-absorbing member is further restricted to the length of the thumb segment extending from the glove 102 and 103 and, as mentioned, the dorsal surface area of the thumb segment 18—allowing for the shock-absorbing member to extend circumferentially along the sides of the thumb segment but not extending onto the palmar surface of the thumb segment, therefore generally not extending over one hundred and eighty degrees.

This embodiment also has a shock-absorbing member along substantially all of the dorsal surface overlaying the forefinger 20. The shock-absorbing member overlaying the forefinger is in the pattern of a rectangle 104, and is configured as a one pad segment 105. Other embodiments may prefer to overlay the forefinger as separate padding segments, for example, to allow for significant finger flexibility by having one pad overlaying only the proximal phalanx, a second pad overlaying only the middle phalanx, and a third pad overlaying only the distal phalanx of the forefinger. By not covering any of the forefinger joints you have added flexibility but less protection.

The length of the shock-absorbing member is further restricted to the length of the forefinger segment 106 and 107 extending from the glove and, as mentioned, the dorsal surface area of the forefinger segment 20—allowing for the shock-absorbing member to extend circumferentially along the sides of the forefinger segment but generally not extending onto the palmar surface of the forefinger segment.

This embodiment also has a shock-absorbing member along substantially the dorsal surface overlaying the proximal phalanx of the middle finger 22 but does not extend to cover any portion the middle finger's middle phalanx. The shock-absorbing member overlaying the middle finger is in the pattern of a square 108, and is configured as a one pad segment 109. The length of the shock-absorbing member would further be restricted to the length of the middle finger's proximal phalanx segment 110 and 111 extending from the glove and, as mentioned, the dorsal surface area of the middle finger segment 22—allowing for the shock-absorbing member to extend circumferentially along the sides of the middle finger segment but generally not extending onto the palmar surface of the middle finger segment.

This embodiment also has a shock-absorbing member along the dorsal surface overlaying the proximal phalanx of the ring finger 24 but does not extend to cover any portion the ring finger's middle phalanx. The shock-absorbing member overlaying the ring finger is in the pattern of a diamond 112, and is configured as a one pad segment 112. The length of the shock-absorbing member would further be restricted to the length of the ring finger segment 113 and 114 extending from the glove and, as mentioned, the dorsal surface area of the ring finger segment 24—allowing for the shock-absorbing member to extend circumferentially along the sides of the ring finger segment but generally not extending onto the palmar surface of the ring finger segment.

This embodiment also has a shock-absorbing member along substantially the dorsal surface overlaying the metacarpals of the four fingers 115. The shock-absorbing member overlaying the four metacarpals is in the pattern of a rectangle 116, and is configured as a one pad segment 117. Other embodiments may prefer to overlay the metacarpals as separate padding segments, for example, to allow for significant finger flexibility by having one pad overlaying only the top half of the metacarpals—the portion closest to the fingers, and a second pad overlaying the bottom half of the metacarpals—the portion closest to the wrist area. The length and width of the shock-absorbing member of this embodiment is generally restricted to the dorsal portion of the glove overlaying the metacarpal bones of the hand 118, 119, 120, and 121, in part or in their entirety. Of course, users may prefer any combination of the aforementioned, and may also include the thumb metacarpal.

Finally, the wrist portion also comprises a shock-absorbing member that protrudes on the dorsal segment 126 and 127, along the carpals about 1 inch 126, 127. This will give the user added protection from the abrasion such as from hitting said fingers and wrist on the ground or while the quarterback rushes with the football.

As mentioned, the shock-absorbing member may be affixed to the glove by any standard methods of attachment, such as by stitching or adhesion. For example, it can be in the form of pouches or attachments to the glove and then bonding these second layers to the back of the glove, using heat sealing or other methods. The shock absorbing member overlaying the middle finger 22 is attached to the glove.

As illustrated, the rest of the shock-absorbing members are integral with the material that form the glove, and may be applied to select areas of the glove by standard methods and forms of attachment methods such as, for example, by the dorsal segment 11 comprising of a vinyl sheet material with a stretch nylon backing and the liner (or sleeve) 123 made of a knit of polyester. The liner is positioned along the inner surface of the dorsal segment 125 of the glove whereby the padded layer 105 or layers would be inserted and then sealed. The cushions may also be secured to the glove by conventional stitching 124.

The liner 123 can be interposed between the shock-absorbing member and the interior of the glove, and separates the shock-absorbing member from the user's hand, fingers, thumb and metacarpals, such as disclosed above, allowing easy insertion of the user's hand. Preferably, the liner is fixed to the dorsal segment interior using methods known in the art, such as stitching, to affix the shock-absorbing member to the glove. Padding can be interposed between the dorsal segment and the liner. The liner secures the shock-absorbing member between the user's hand and the dorsal segment. Of course, other methods of attachment that are known in the art may be used, such as by chemical bonding.

The shock-absorbing member will give the user added protection from the abrasion from hitting a user's fingers against the helmet of an opponent, for example. The shock-absorbing member of the present invention offer the unique ability of being able to protect an injury while maintaining grip capabilities in select areas by offering padded layer or layers, a significant and substantial advancement to prior art, such as bandages and BAND-AID, thus providing a solution to a long-felt need of being able to protect a quarterback's throwing hand.

The paddings can be made of a neoprene material or of any other materials aforementioned. The illustrated dorsal segment is constructed of the same material as that of FIG. 6 but may also be of a thicker, more durable material, such as a synthetic leather for added protection, or any other materials aforementioned. The dorsal segment may be joined to the palmar segment, as described in FIG. 5, by methods known in the art such as by sewing to form an opening for receiving the user's hand.

The wrist portion is preferably expansible so as to hold more securely to the user's wrist. Therefore the embodiment also has an expandable opening means 28 at a wrist end 29 adapted to receive the user's hand. The expandable opening means comprises an elastic material along the wrist portion, such as an elastomeric band 28 fixed around the wrist. If desired, the opening means may also comprise a strap means at the open end of the glove body for fastening the glove body secure about the wrist area. The strap means may be unitary with the glove body and may include VELCRO fasteners, buttons, and the like or other suitable closure means thereon.

FIG. 9 is a cross-sectional view of FIG. 8, showing the liner. Specifically, the illustration shows the forefinger stall 20, whereby the shock-absorbing member 105 lies between the inner surface 125 of the dorsal segment 11 and the liner 123. The thickness of the shock-absorbing member 105 can vary by user preference. The thickness of this embodiment may be about ¼ inch, for example. The shock-absorbing member may be constructed with known material and those aforementioned, such as cotton, for example. Preferably, the liner is fixed to the dorsal segment interior using methods known in the art, such as stitching to fix the shock-absorbing members to the glove.

Figure 10:
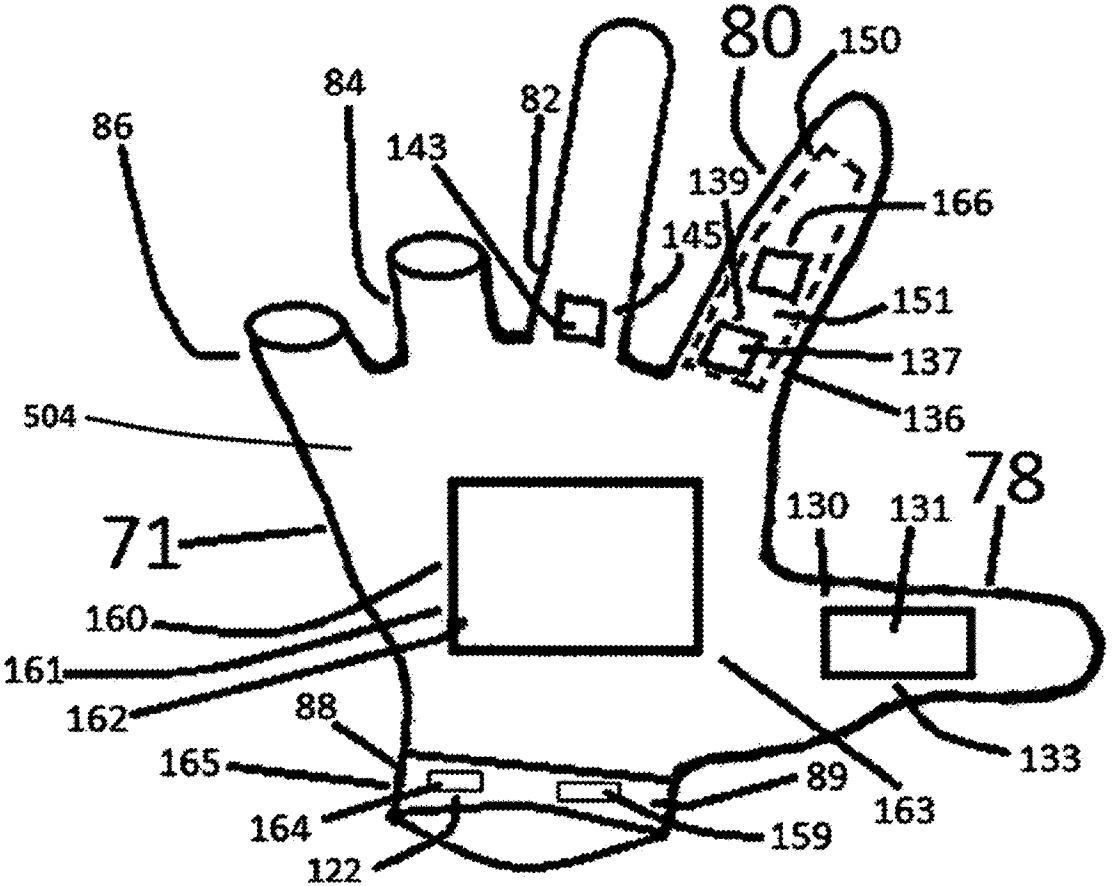
FIG. 10 is an alternative dorsal segment to the glove drawn and described in FIG. 1, showing shock-absorbing members.
Figure 11:
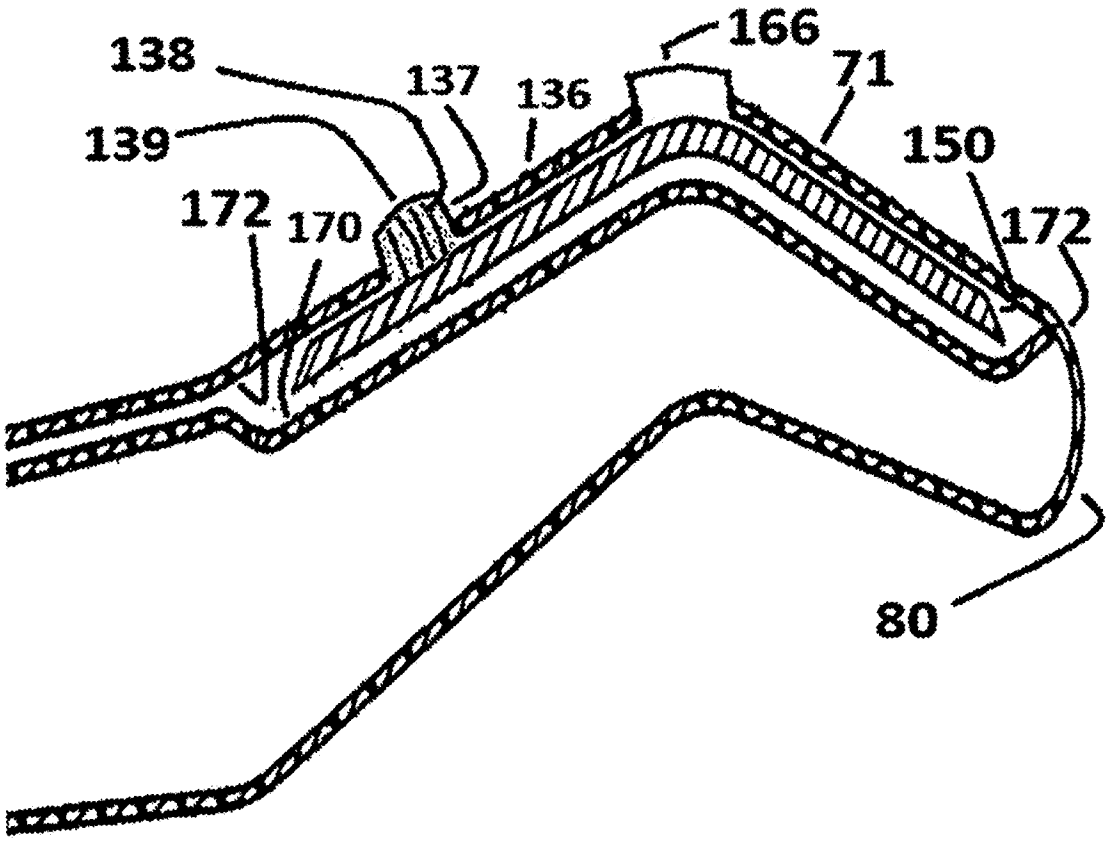
FIG. 11 is a cross-sectional view of FIG. 10, showing a liner and protrusions.

FIG. 10 and FIG. 11 show an alternative dorsal portion to FIG. 1. Embodiments may also preferably comprise of a shock-absorbing member along any portion of the dorsal surface, such as any or all existing finger or thumb stalls, along the dorsal surface overlaying any or all of the metacarpals, along any of all of the wrist area including any of the carpometacarpals, or combinations thereof.

In the illustrated embodiment, the glove is constructed such that the thumb 73 and middle finger 75 digital segments enclose a user's thumb and middle finger, respectively, including enclosing the fingertips. The glove has a forefinger segment that covers the forefinger 74, a ring finger segment that covers the ring finger's proximal phalanx 76 but does not extend to cover the ring finger's middle phalanx, and a pinkie finger segment that covers the pinkie finger's proximal phalanx 77 but does not extend to cover the pinkie finger's middle phalanx.

This embodiment has a shock-absorbing member along substantially all of the proximal phalanx 130 dorsal surface overlaying the thumb 78. The shock-absorbing member overlaying the thumb is in the pattern of a rectangle 131, and is configured as a one pad segment 131. Other embodiments may prefer to offer additional separate padding segments, for example, with a second pad overlaying only the distal phalanx of the thumb. The length of the shock-absorbing member is further restricted to the length of the protrusion 133 along the proximal phalanx of the thumb stall, and, as mentioned, the dorsal surface area of the thumb segment 78—allowing for the shock-absorbing member to extend circumferentially along the sides of the thumb segment but not extending onto the palmar surface of the thumb segment, therefore not extending over about one hundred and eighty degrees of the digital segment.

This embodiment has a shock-absorbing member 150 along a substantial portion of the dorsal surface overlaying the forefinger 80. The shock-absorbing member overlaying the forefinger is in the pattern of a rectangle 151, is an elongated cloth pad, is configured as a one pad segment 151, and is defined by the length and width of the forefinger segment's dorsal surface.

This embodiment has a second layer shock-absorbing member along the proximal phalanx 136 dorsal surface overlaying the forefinger 80. The shock-absorbing member overlaying the forefinger is in the pattern of a square 137, and is configured as a one pad segment 137. Other embodiments may prefer to offer additional separate padding segments, for example, with a second pad overlaying only the middle phalanx, and a third pad overlaying only the distal phalanx of the forefinger.

The length of the second layer shock-absorbing member is further restricted to the length of the protrusion 139 along the proximal phalanx on forefinger stall and, as mentioned, the dorsal surface area of the forefinger segment 80—allowing for the shock-absorbing member to extend circumferentially along the sides of the thumb segment but not extending onto the palmar surface of the thumb segment, therefore not extending over about one hundred and eighty degrees of the digital segment.

This embodiment has a shock-absorbing member along the middle finger stall 82, such as substantially along substantially all the proximal phalanx dorsal surface overlaying the middle finger 82. The shock-absorbing member overlaying the middle finger is in the pattern of a rectangle 143, and is configured as a one pad segment 143. The length of the shock-absorbing member is further restricted to the length of the discreet protrusion 145 along the proximal phalanx of the middle finger stall and, as mentioned but other embodiments may have a protrusion extending throughout the dorsal surface area of the middle finger segment.

This embodiment also has a shock-absorbing member along substantially the dorsal surface overlaying the metacarpals of the forefinger, middle finger, ring finger and pinkie finger 160. The shock-absorbing member overlaying the four metacarpals, the forefinger, middle finger, ring finger and pinkie finger, is in the pattern of a rectangle 161, and is configured as a one pad segment 162. Other embodiments may prefer to may do so as separate padding segments, for example, to allow for significant finger flexibility by having one pad encased and protruding from only the top half of the metacarpals—the portion closest to the fingers, and a second pad encased and protruding from the bottom half of the metacarpals—the portion closest to the wrist area. The length and width of the shock-absorbing member is generally restricted to the protrusion on the dorsal portion of the glove overlaying the metacarpal bones of the hand, and can also include a protrusion overlaying the thumb metacarpal 163, in part or in its entirety. Of course, users may prefer any combination of the aforementioned.

Finally, the wrist portion also comprises a shock-absorbing member that protrudes on the dorsal segment 164 and 159, along the carpals about ½ inch 165. This will give the user added protection from the abrasion such as from hitting said fingers and wrist on the ground or while the quarterback rushes with the football.

Additionally, the embodiment is configured such that a second protrusion exists on the proximal interphalangeal joint of the forefinger's dorsal surface 166. This discreet protrusion is does not contain a second shock-absorbing member thus providing the user with added flexibility capabilities along the interphalangeal joint, especially beneficial if the dorsal segment is generally constructed with a more durable material, such as a leather latex glove.

The shock-absorbing members may comprise any type of cloth fabric, like a cushion, or foam, such as an open cell foam 150. The shock-absorbing member need not be very thick, say beginning from about six hundred micrometers 150 or so, to two inches or more. The thickness of pads for example may vary on several factors, of course, such as degree of preferred protection (e.g., the more a quarterback likes to rush with the football, the thicker padding he may desire) and a location of the pads (e.g., padding on only the pinkie metacarpal where many quarterback hand injuries occur). Each shock-absorbing member may comprise of one foam pad or a plurality of small pads to maximize flexibility.

Multiple layered shock-absorbing members may also be offered. The second (or multiple) layer may preferably be of the same material but also may be thicker or more resilient to better protrude.

The shock-absorbing members may be stitched on or may be integral to the glove. This can be done by standard methods. The illustration shows the shock-absorbing member integrally formed on the glove. For example, the dorsal segment of the glove 71 comprises preferably a flexible, integrally molded member which has a tougher outer protective membrane 71 and a smoother hand-contacting inner membrane, such as a liner 170 or sleeve, membranes 71 and 170 being connected together around the peripheral edge of the member 172. Inner membrane 170 is generally flat and outer membrane has a plurality of discreet shock-absorbing protective protrusions 133, 139, 145, 159, 160, 164, and 166.

For example, the shock-absorbing member may comprise a thick layer of resilient plastic foam material, such as ¼ inch polyethylene foam sheet, which is interposed between outer membrane and inner membrane to provide a composite laminated sheet which is then molded. Outer membrane is of a suitable plastic material such as vinyl sheet material with a stretch nylon backing. Inner membrane is preferably of double knit polyester or other suitable textile material to minimize abrasion of hand. The composite laminate sheet can then be molded to form the spacing between protrusions, by pressing outer membrane toward inner membrane. The dimensions of the compartments would be of sufficient manner to house the pads.

As mentioned, the shock-absorbing members may alternatively be affixed to the dorsal surface of the glove. Methods have previously been discussed such as, for example, encasing the shock-absorbing members of this embodiment with the same material forming the glove 122, then attaching the casings to the dorsal surface such as the wrist area 122, by any standard methods such as by stitching.

The wrist portion is preferably expansible so as to hold more securely to the user's wrist. Therefore the embodiment also has an expandable opening means 88 at a wrist end 89 adapted to receive the user's hand. The expandable opening means comprises an elastic material along the wrist portion, such as an elastomeric band 88 fixed around the wrist. If desired, the expandable opening means may comprise a strap means at the open end of the glove body for fastening the glove body secure about the wrist area. The strap may have two pads of cohesive-adhesive material for releasably securing the strap, for example. The strap as well as the wrist portion may be sewn onto the glove.

Additionally, embodiments such as this may be coated with a water repellant substance, such as a synthetic resin 504, for example, especially useful during rainy weather game situations.

FIG. 11 is a cross-sectional view of FIG. 10, showing the liner and protrusions. Specifically, the illustration shows the forefinger stall 80, whereby the shock-absorbing member 150 lies between the inner surface 172 of the dorsal segment 71 and the liner 170. The other protrusions 133, 139, 145, 159, 160, 164, and 166 along the glove body dorsal portion are constructed in like fashion.

The thickness of the shock-absorbing member can vary by user preference, such as about ¼ inch for example, and extends to cover the dorsal portion of the glove's digital finger segment, the padding therefore defined by the dorsal portion of the forefinger digital segment. The shock-absorbing member may be constructed with known material and those aforementioned, such as cotton, for example. Preferably, the liner is fixed to the dorsal segment interior using methods known in the art, such as stitching, to fix the shock-absorbing member to the glove.

This embodiment has a second layer shock-absorbing member along the proximal phalanx 136 dorsal portion overlaying the forefinger 80. The shock-absorbing member overlaying the forefinger is in the pattern of a square 137, and is configured as a one pad segment 138. Other embodiments may prefer to offer additional separate padding segments, for example, with a second pad overlaying only the middle phalanx, and a third pad overlaying only the distal phalanx of the forefinger.

The length of the second layer shock-absorbing member is further restricted to the length of the protrusion 139 along the proximal phalanx on forefinger segment, say about 0.20 inch for example, and other dimensions to snugly enclose the aforementioned pads.

Additionally, the embodiment is configured such that a second protrusion exists on the forefinger, located on the proximal interphalangeal joint of the forefinger's dorsal surface 166. This protrusion does not contain a second shock-absorbing member thus providing the user with added flexibility capabilities along the interphalangeal joint, especially beneficial if the dorsal segment is generally constructed with a more durable material, such as a leather latex glove. Also, the liner may be made of a fleece material 170 thus offering additional comfort and warmth for the user, especially useful during rainy conditions.

Figure 12:
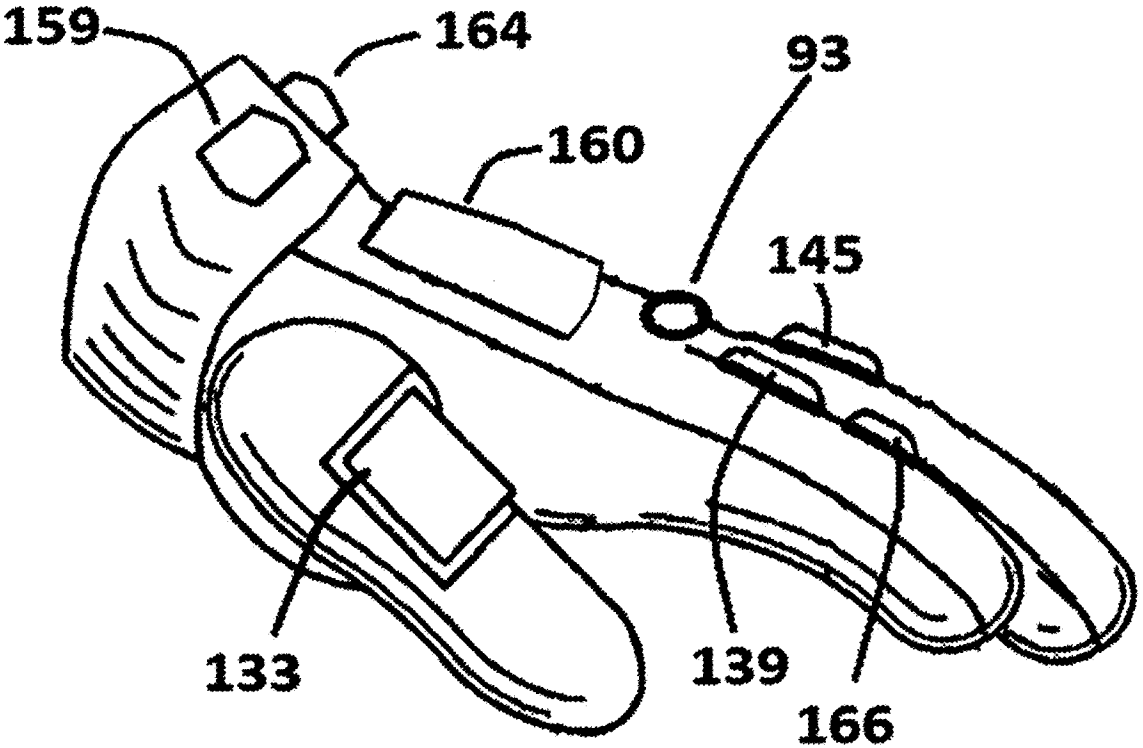
FIG. 12 is a side view of the glove embodiment described in FIG. 10 (dorsal segment) and FIG. 1 (palmar segment).

FIG. 12 is a side view of the glove embodiment comprised of FIG. 10 (dorsal segment) and FIG. 1 (palmar segment). The illustration shows the protrusion on the thumb stall 133, the protrusions on the forefinger stall 139 and 166, the protrusion on the middle finger stall 145, the protrusion overlaying the four finger metacarpals 160, and the protrusions on the wrist segment 159 and 164. The protrusions may have various dimensions of course. The illustrated protrusions preferably have a height of about 0.20 of an inch, for example. As mentioned, this embodiment could also prove beneficial with or without the apertures on the metacarpophalangeal joints, such as the middle finger segment's metacarpophalangeal 93.

Figure 13:
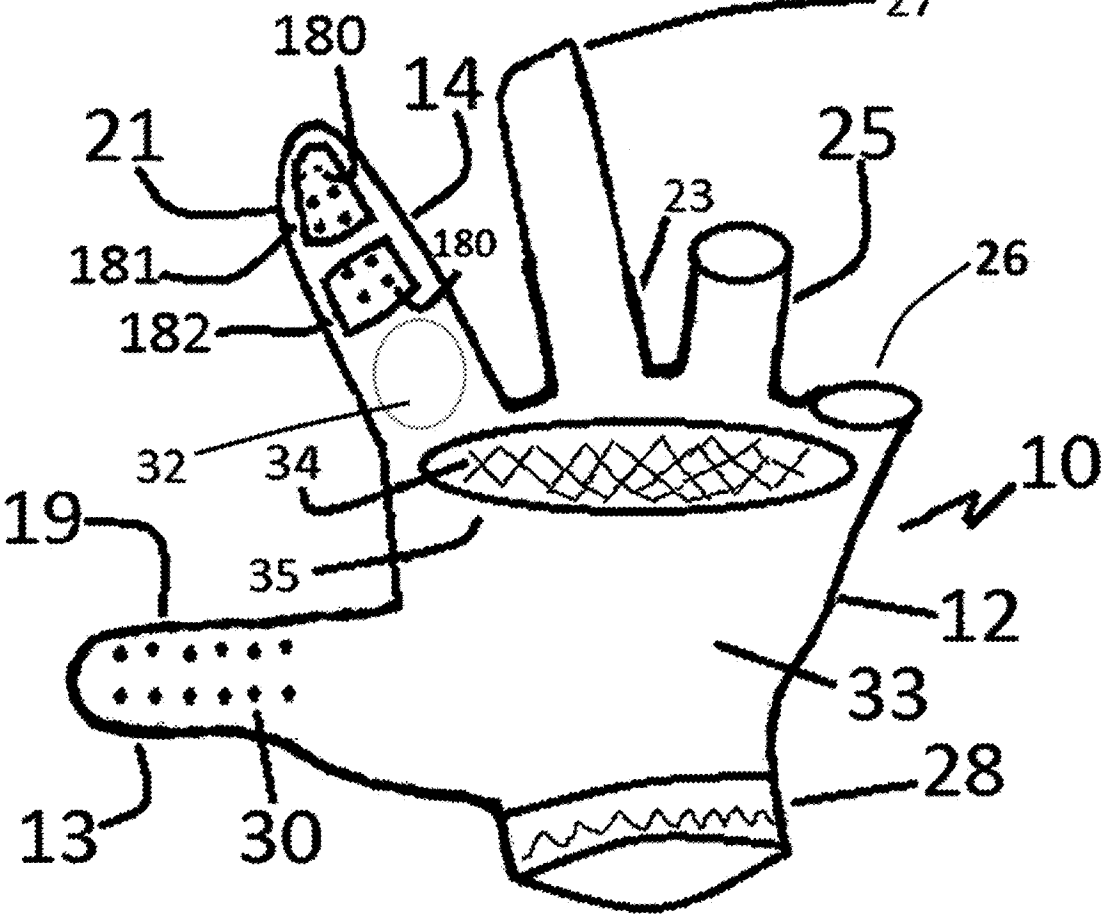
FIG. 13 shows an alternate grip-enhancing means surface 21 or 31, of the embodiment described in FIG. 5.

FIG. 13 shows an alternate palmar portion with alternative grip-enhancing means 37 surfaces as shown in FIG. 5. Specifically, shown is grip enhancing means creating a high friction surface along the distal 181 and middle 182 phalanges of the forefinger stall 14, along substantially the entire palmar portion of the thumb stall 13, and along a substantial portion of the forefinger metacarpophalangeal joint, middle finger metacarpophalangeal joint, the ring finger metacarpophalangeal joint, and the pinkie finger metacarpophalangeal joint 34; each comprising of a grip enhancing means which is comprised of a plurality of spaced apart depressions 180. Said grip enhancing means may be integrally formed on the glove body 30 or applied to a grip enhancing panel 181, 182 and then affixed to the palmar portion of the glove body. As illustrated, the plurality of depressions preferably have a depth of at least three hundred micrometers, and may be formed from a high friction material, such as latex for example. The depressions 180 are located throughout the top surface of the grip enhancing panels 181, 182.

More specifically, for example, one grip enhancing panel covers much of the distal phalanx of the forefinger 181 but does not overlay the digital crease. A second grip enhancing panel covers much of the middle phalanx of the forefinger 182 but does not overlay the digital crease.

In addition, a grip enhancing means comprising a grip enhancing panel overlays the forefinger metacarpophalangeal joint, the middle finger metacarpophalangeal joint, the ring finger metacarpophalangeal joint, and pinkie finger metacarpophalangeal joint of the glove body, and is formed of any material aforementioned, such as LYCRA.

The grip enhancing means comprising of these grip enhancing panels preferably provide a higher and more effective coefficient of friction than the rest of the glove body, preferably providing a Shore A Durometer Coefficient of Friction of between 1.5 and 4.5.

The grip enhancing means may further comprise of tackifiers including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing means comprised of a plurality of discreet tackified locations. More specifically, a grip enhancing means comprises a grip enhancing panel overlaying the forefinger distal phalanx, whereby said grip enhancing panel is a tackified material 181, such as a impregnating a synthetic leather with a tackifier resin; said grip enhancing panel is configured to overlay a digital phalanx, in part or in its entirety, but not to extend beyond a digital phalanx. In addition, a grip enhancing means comprises a grip enhancing panel overlaying the forefinger middle phalanx, whereby said grip enhancing panel is a tackified material, such as coating the forefinger middle phalanx any commonly known tackifier 182, such as POWR TAC TACKIFIER COATING; said grip enhancing panel is configured to overlay a digital phalanx, in part or in its entirety, but not to extend beyond a digital phalanx.

The aperture 32 extends to expose primarily only a user's forefinger proximal phalanx.

Figure 14:
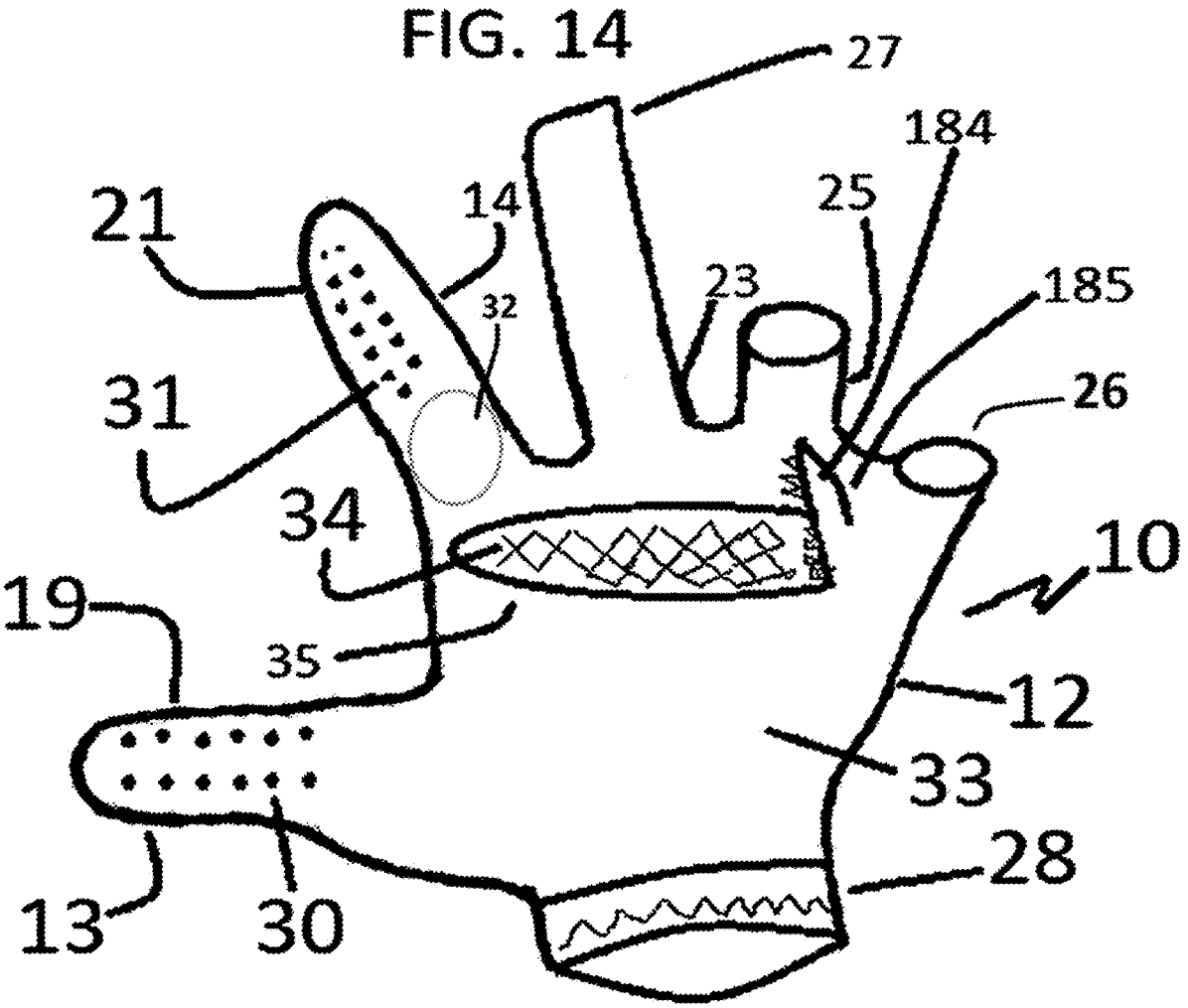
FIG. 14 shows the top and bottom view of a panel which creates a higher friction surface on an embodiment, as shown in FIG. 5.

FIG. 14 shows the top (front) and bottom (back) portions of a panel which creates a higher friction surface on an embodiment, as shown in FIG. 5. Specifically, shown is a panel overlaying much of the metacarpophalangeal joints of the forefinger, middle finger, ring finger, and pinkie finger stalls.

In general, as aforementioned, a grip enhancing means may be either formed on or applied to any palmar portion, such as the palm or any thumb or any existing finger stalls, using any standard methods.

This embodiment shows a gripping means comprising of a high friction surface, such as creating crisscross grooves 34 that are depressed onto a gripping enhancing panel 35, for example, then attaching said panel onto a portion of the gloves palmar surface area. The bottom portion of the panel 185 is attached to the palmar surface of the glove by any standard methods of attachment, such as by an adhesive 184 or stitching.

Figure 15:
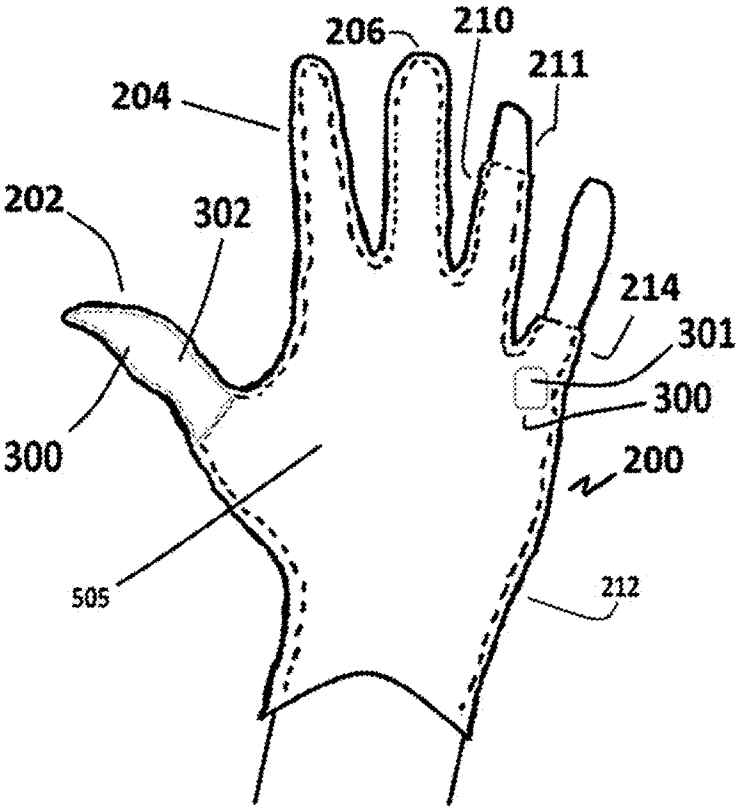
FIG. 15 is a drawing of the palmar view of a fourth embodiment, shown as a partial-fingered glove.
Figure 16:
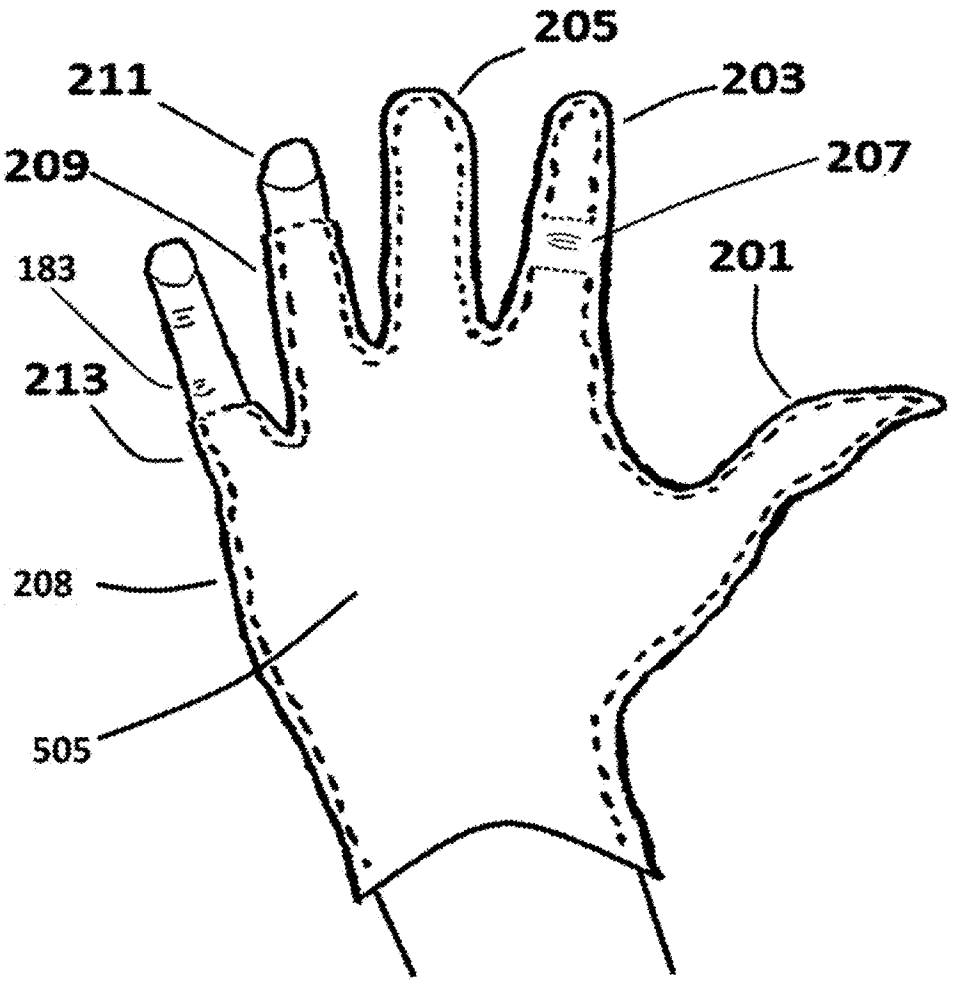
FIG. 16 is a drawing of the embodiment as described in FIG. 15, showing the dorsal view.

In FIG. 15 and FIG. 16, the present invention is shown as another partial-fingered glove 200 worn by a user. The palmar view of a left-handed glove is drawn in FIG. 15 and the dorsal view of the same glove is drawn in FIG. 16.

This partial-fingered embodiment provides a glove having a dorsal portion 208, a palmar portion 212 for overlaying respective back and palm regions of a human hand, said dorsal and palmar portions having distal and proximal ends with a plurality of digital segments (or stalls) projecting from said distal ends. The glove includes a glove body having a back portion covering the back of the hand 208, and a front portion covering the palm or front of the hand 212. The glove body includes finger stalls (or digital segments) and a thumb stall (digital segment) each adapted to receive a finger or thumb, respectively, therein.

In the illustrated embodiment, the glove is constructed such that the thumb, forefinger and middle finger are each entirely covered. The forefinger segment however, also provides an aperture 207. Specifically, the dorsal surface portion of most of the forefinger's proximal and middle phalanges are uncovered, defining the aperture on the forefinger segment; the distal phalanx is entirely covered by the forefinger stall. The ring finger is largely covered, except from the third joint to the fingertips, which is entirely uncovered. The pinkie finger is largely uncovered, except for part of the first joint, which remains covered.

The small opening 207, or aperture, on the forefinger segment will allow the skin of said finger to make contact with the skin of another finger on a user's opposing hand. For example, a golfer who grips a club using the overlapping grip could wear this embodiment on his/her weak-hand. The golfer would then place his dominant-hand's pinkie finger on top of and between his/her weak-hand's covered forefinger and middle fingers. However, this embodiment would allow the skin of the weak hand's forefinger to touch the skin of the dominant hand's pinkie finger, thus increasing hand coordination.

The thumb stall is defined by a dorsal portion 201 and a palmar portion 202. The forefinger stall is defined by a dorsal portion 203 and a palmar portion 204. The middle finger stall is defined by a dorsal portion 205 and a palmar portion 206. Additionally, the dorsal surface portion of most of the forefinger's proximal and middle phalanges, and therebetween, are uncovered 207 defining the aperture on the forefinger segment.

The ring finger stall is defined by a dorsal portion 209 and a palmar portion 210. The ring finger segment does not extend to cover the ring finger's distal phalanx 211. The pinkie finger stall is defined by a dorsal portion 213 and a palmar portion 214, and overlays a substantial portion of the proximal phalanx but does not extend to cover a user's proximal interphalangeal joint 183.

This embodiment further shows how the present invention may comprise a grip enhancing means 300. Although the glove now provides a higher coefficient of friction on the throwing hand of a quarterback or on a golfer's dominant hand, for example, one may now further increase grip capabilities by adding a grip enhancing means along the palmar portion of the glove.

The grip enhancing means may comprise a plurality of projections, a plurality of depressions, one or more grip enhancing panels, or tackifiers, for example.

More specifically, for example, the grip enhancing means may comprise of tackifiers including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing means comprised of a plurality of discreet tackified locations 301, 302.

More specifically, a grip enhancing means comprises a grip enhancing panel 300 overlaying the pinkie finger metacarpophalangeal joint 301, whereby said grip enhancing panel is a tackified material 301, such as by tackifying a panel with any commonly known tackifier, such as any commonly known hydrocarbon-type resins; such as a impregnating a synthetic leather with a tackifier resin 301; said grip enhancing panel is configured to overlay a metacarpophalangeal joint, in part or in its entirety, but not to extend beyond a metacarpophalangeal joint.

In addition, the entire palmar portion of the thumb digital segment comprises a tackified material 302, such as impregnating a leather with a tackifier resin 302 and then affixing said material onto the rest of the palmar portion of the glove body. This particular configuration provides for maximum grip capabilities for a user, such as a golfer. The less flexible thumb segment is not of importance to a golfer because the weak hand's thumb does not need to bend at any time during a golf swing.

The grip enhancing means formed of these tackfied materials integral to the glove body or formed of tackified grip enhancing panels, are preferably configured to provide a significantly higher coefficient of friction, preferably of at least a Shore A Durometer Coefficient of Friction of between 2.0 and 4.5; Still more preferably a Shore A Durometer Coefficient of Friction of between 2.5 and 4.5.

The wrist portion is preferably expansible so as to hold more securely to the user's wrist. Therefore the embodiment also has an expandable opening means at a wrist end adapted to receive the user's hand. The expandable opening means comprises an elastic material along the wrist portion, such as an elastomeric band fixed around the wrist. If desired, the opening means may comprise a strap means at the open end of the glove body for fastening the glove body secure about the wrist area. The strap may have two pads of cohesive-adhesive material for releasably securing the strap. The strap as well as this wrist portion may be sewn onto the glove.

Additionally, embodiments such as this one, may be completely coated with a with a water repellant substance 505, such as a synthetic resin 505 on the dorsal surface 212 or throughout the entire glove 208, 212. Alternatively, a plurality of micro recesses of about 0.120 millimeters in diameter may be randomly disposed about the front, back and finger and thumb stalls of the glove, thereby providing added comfort and more ventilation.

The materials forming the illustrated embodiment may comprise those discussed in reference to the present invention, such as primarily synthetic leather in a NYLON material. Likewise, any previously discussed methods of construction and materials may be applied to this embodiment.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

Figure 17:
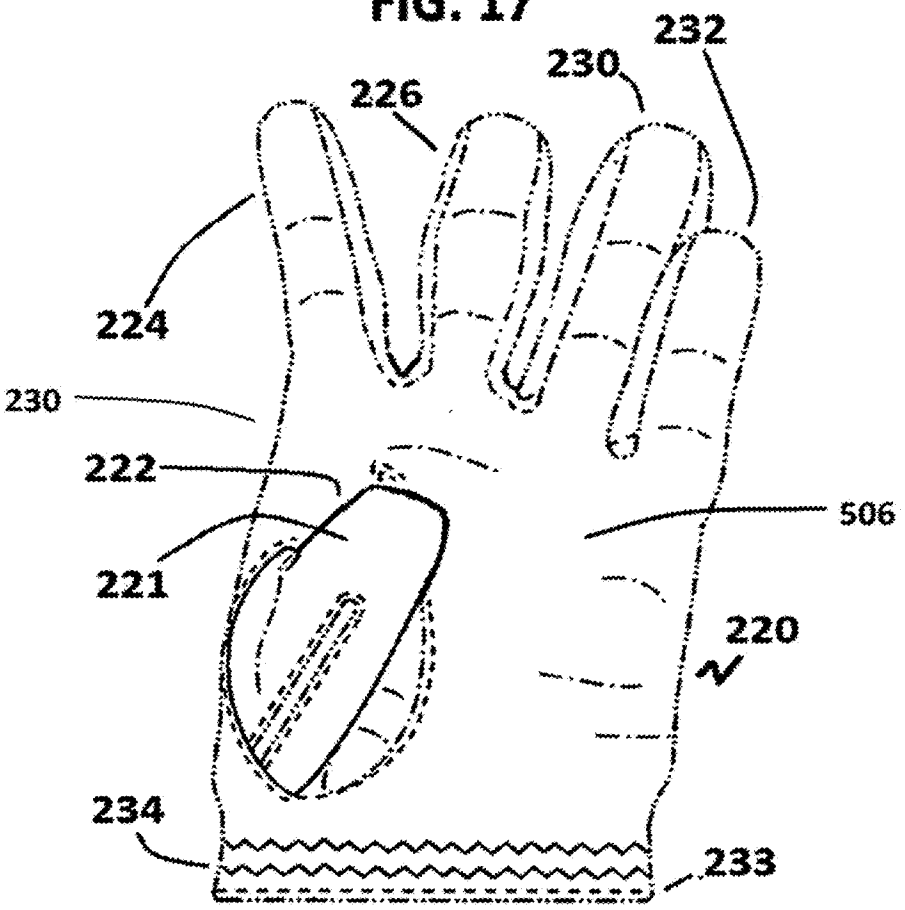
FIG. 17 is a drawing of the palmar view of a fifth embodiment, shown as essentially a full-fingered glove, with an aperture residing along the dorsal portion of the forefinger's proximal phalanx, but not extending beyond the proximal interphalangeal or below the metacarpophalangeal, defining the aperture on the forefinger segment.
Figure 18:
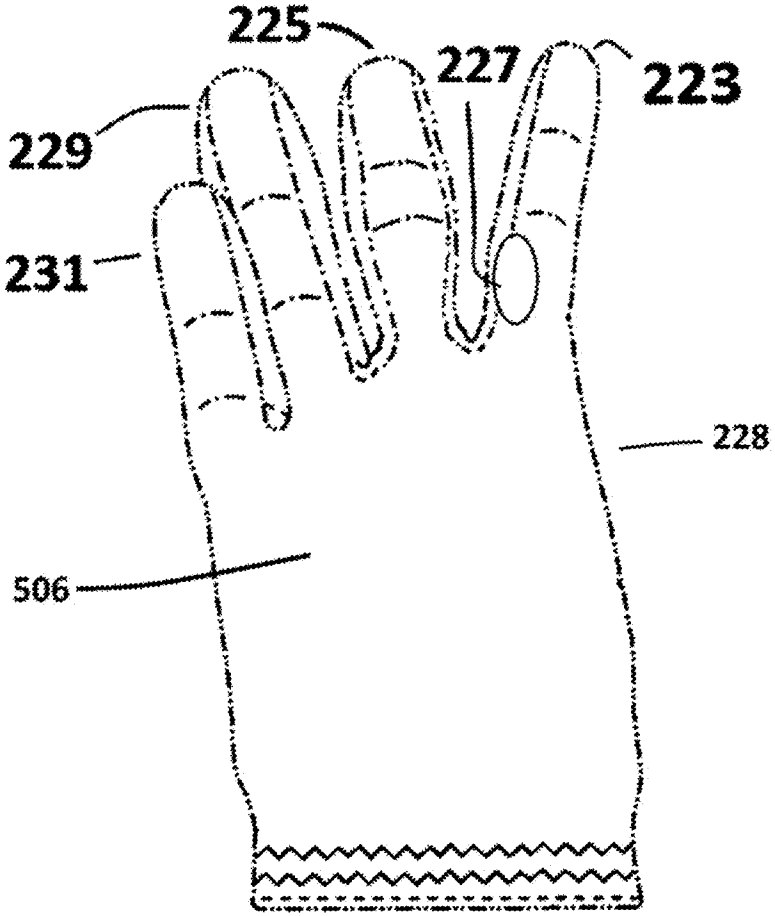
FIG. 18 is a drawing of the embodiment as described in FIG. 17, showing a dorsal view.

FIG. 17 and FIG. 18 show a partially open hand cover 220, where said cover is a glove having connected back portion 228 and palmar portion 230 for protecting respective back and palmar areas of the human hand, the back and palmar portions having distal and proximal ends with a plurality of digital segments projecting from the distal ends, where the digital segment of the thumb overlays a user's entire thumb including the fingertip of said thumb, where the digital segment of the forefinger overlays the forefinger including the fingertip of said forefinger, said forefinger also comprises an aperture along the digital segment of the forefinger leaving uncovered at least a portion of the proximal phalanx of said forefinger. In addition, the digital segment of the middle finger overlays the entire middle finger including the fingertip of said middle finger, and at least one of the remaining two fingers are at least partially covered.

In the illustrated embodiment, the digital segment of the ring finger overlays the entire ring finger including the fingertip of said ring finger. Additionally, the digital segment of the pinkie finger overlays the entire pinkie finger including the fingertip of said pinkie finger.

The thumb stall is defined by a dorsal portion 221 and a palmar portion 222. The forefinger stall is defined by a dorsal portion 223 and a palmar portion 224. The middle finger stall is defined by a dorsal portion 225 and a palmar portion 226. Additionally, an aperture 227 resides along the dorsal portion of the forefinger's proximal phalanx, but does not extend beyond the proximal interphalangeal or below the metacarpophalangeal, defining the aperture on the forefinger segment. The aperture of this embodiment extends along the side of the forefinger, adjacent the middle finger segment 225, but does not extend to expose the palmar portion of a user's forefinger. The ring finger stall is defined by a dorsal portion 229 and a palmar portion 230. The pinkie finger stall is defined by a dorsal portion 231 and a palmar portion 232.

The wrist portion is preferably expansible so as to hold more securely to the user's wrist. Therefore the embodiment also has an expandable opening means 233 at a wrist end 234 adapted to receive the user's hand. The expandable opening means comprises an elastic material along the wrist portion, such as an elastomeric band 233 fixed around the wrist. If desired, the opening means may comprise a strap means at the open end of the glove body for fastening the glove body secure about the wrist area. The strap may have two pads of cohesive-adhesive material for releasably securing the strap. The strap as well as this wrist portion may be sewn onto the glove.

Additionally, embodiments such as this one, may be completely coated with a with a water repellant substance 506, such as SCOTCH GUARD on the palmar surface 230 or throughout the entire glove 228, 230. Alternatively, a plurality of micro recesses of about 0.120 millimeters in diameter may be randomly disposed about the front, back and finger and thumb stalls of the glove, thereby providing added comfort and more ventilation.

The materials forming the illustrated embodiment may comprise those discussed in reference to the present invention. Likewise, any previously discussed methods of construction may be applied to this embodiment. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

Figure 19:
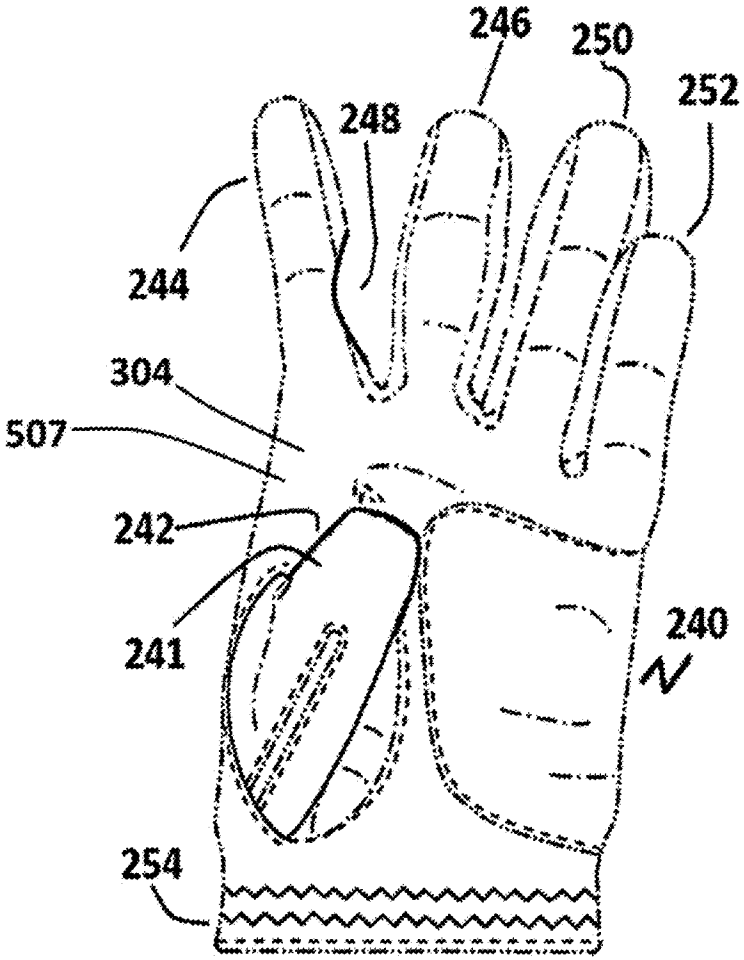
FIG. 19 is a drawing of the palmar view of a sixth embodiment, shown as essentially a full-fingered glove, with an aperture residing along the dorsal and palmar portions of the forefinger's proximal and middle phalanges, but not extending beyond the distal interphalangeal or below the metacarpophalangeal.
Figure 20:
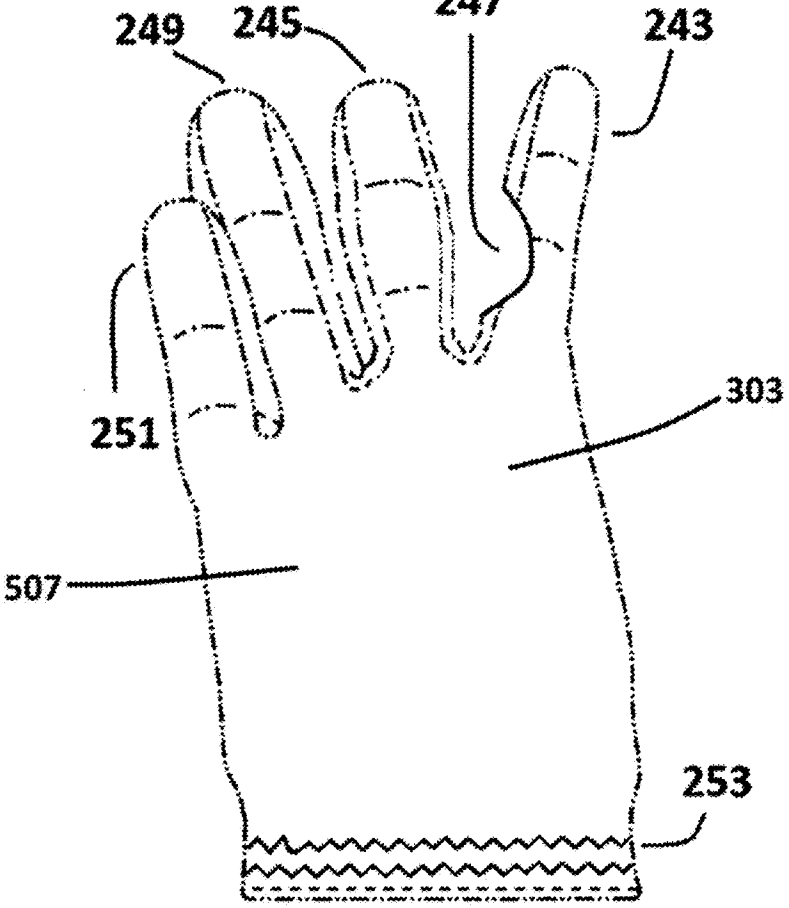
FIG. 20 is a drawing of the embodiment as described in FIG. 19, showing a dorsal view.

FIG. 19 and FIG. 20 show a partially open hand cover 240, where said cover is a glove having connected back 303 and palmar portions 304 for protecting respective back and palmar areas of the human hand, the back and palmar portions having distal and proximal ends with a plurality of digital segments projecting from the distal ends, where the digital segment of the thumb overlays the entire thumb including the fingertip of said thumb, where the digital segment of the forefinger overlays the forefinger including the fingertip of said forefinger, said forefinger digital segment also comprises an aperture along the digital segment of the forefinger leaving exposed at least a portion of the proximal phalanx of said forefinger. In addition, the digital segment of the middle finger overlays the entire middle finger including the fingertip of said middle finger, the digital segment of the ring finger overlays the entire ring finger including the fingertip of said ring finger, and the digital segment of the pinkie finger overlays the entire pinkie finger including the fingertip of said pinkie finger.

The thumb stall is defined by a dorsal portion 241 and a palmar portion 242. The forefinger stall is defined by a dorsal portion 243 and a palmar portion 244. The middle finger stall is defined by a dorsal portion 245 and a palmar portion 246. Additionally, an aperture resides along the dorsal 247 and palmar 248 portions of the forefinger's proximal and middle phalanges, but does not extend beyond the distal interphalangeal or below the metacarpophalangeal, defining the aperture on the forefinger segment. Preferably, at least approximately twenty percent of the proximal phalanges and middle phalanges are each uncovered, but can certainly be more or less. The uniquely placed aperture, substantially on the side of the forefinger, adjacent the middle finger 245, 246, provides golfers using the interlocking grip method maximum tactile sensation and is thereby uniquely configured to meet the special needs of users gripping a golf club using a conventional interlocking grip method.

The ring finger stall is defined by a dorsal portion 249 and a palmar portion 250. The pinkie finger stall is defined by a dorsal portion 251 and a palmar portion 252.

The wrist portion is preferably expansible so as to hold more securely to the user's wrist. Therefore the embodiment also has an expandable opening means 253 at a wrist end 254 adapted to receive the user's hand. The expandable opening means comprises an elastic material along the wrist portion, such as an elastomeric band 253 fixed around the wrist. If desired, the opening means may comprise a strap means at the open end of the glove body for fastening the glove body secure about the wrist area. The strap may have two pads of cohesive-adhesive material for releasably securing the strap. The strap as well as this wrist portion may be sewn onto the glove.

Additionally, embodiments such as this one, may be completely coated with a with a water repellant substance 507, such as a synthetic resin 507 on the palmar surface 304 or throughout the entire glove 303, 304. Alternatively, a plurality of micro recesses of about 0.120 millimeters in diameter may be randomly disposed about the front, back and finger and thumb stalls of the glove, thereby providing added comfort and more ventilation.

The materials forming the illustrated embodiment may comprise those discussed in reference to the present invention. Likewise, any previously discussed methods of construction may be applied to this embodiment.

Figure 21:
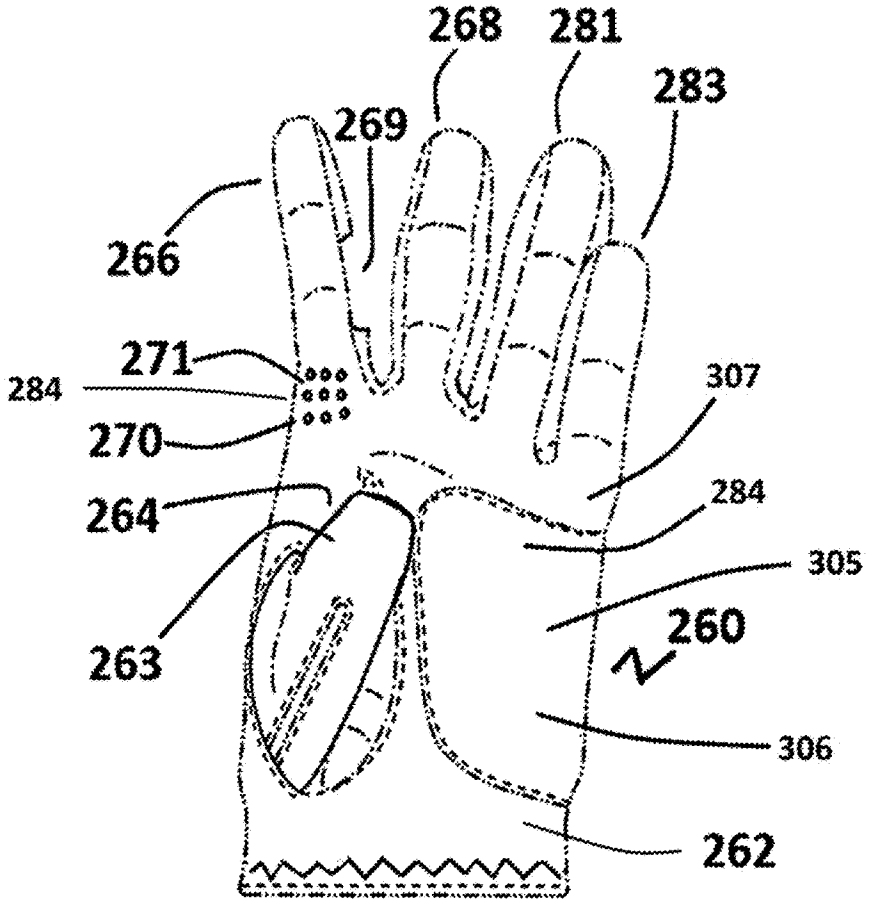
FIG. 21 is a drawing of the palmar view of a seventh embodiment, shown as a full-fingered glove, with an aperture residing along the dorsal portion of the forefinger's proximal and middle phalanges, but not extending beyond the proximal interphalangeal or below the metacarpophalangeal.
Figure 22:
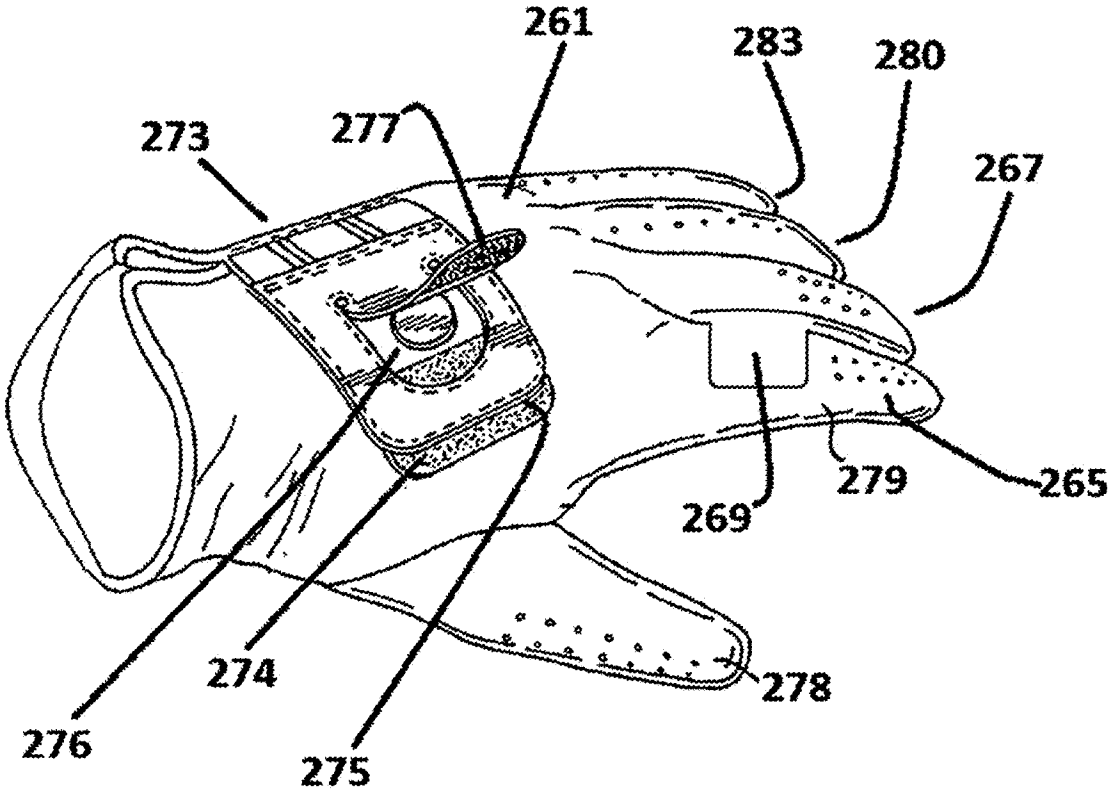
FIG. 22 is a side elevation view of the embodiment as described in FIG. 21, showing a dorsal view.

FIG. 21 and FIG. 22 show a partially open hand cover 260, where said cover is a glove having connected back 261 and palmar portions 262 for protecting respective back and palmar areas of the human hand, the back and palmar portions having distal and proximal ends with a plurality of digital segments projecting from the distal ends, where the thumb digital segment overlays a user's entire thumb including the fingertip of said thumb, where the forefinger digital segment overlays the forefinger including the fingertip of said forefinger, said forefinger digital segment also comprises an aperture along the forefinger digital segment exposing at least a portion of the proximal phalanx of a user's forefinger. In addition, the middle digital segment overlays the entire middle finger including the fingertip of said middle finger, the ring finger digital segment overlays the entire ring finger including the fingertip of said ring finger, and the pinkie finger digital segment overlays the entire pinkie finger including the fingertip of said pinkie finger.

The thumb stall is defined by a dorsal portion 263 and a palmar portion 264. The forefinger stall is defined by a dorsal portion 265 and a palmar portion 266. The middle finger stall is defined by a dorsal portion 267 and a palmar portion 268. Additionally, an aperture 269 resides along the dorsal portion of the forefinger's proximal and middle phalanges, but does not extend to expose the distal interphalangeal or the metacarpophalangeal, defining the aperture on the forefinger segment. Preferably, for example, approximately fifty percent of the proximal phalanx and about fifty percent of the middle phalanx of the dorsal segment are each uncovered, but can certainly vary. The aperture of the embodiment extends along the side of the forefinger stall 266, adjacent the middle finger stall 268.

The ring finger stall is defined by a dorsal portion 280 and a palmar portion 281. The pinkie finger stall is defined by a dorsal portion 282 and a palmar portion 283.

This embodiment further shows how the present invention may comprise a grip enhancing means 284 along any portion of the palmar glove body 262. The embodiment now provides a higher coefficient of friction on a golfer's weak hand, allowing for increase grip especially when gripping a golf club using the conventional interlocking grip.

In the illustrated embodiment, the grip enhancing means 284 comprises a high friction surface 270 formed on the palmar surface of the forefinger's metacarpophalangeal portion of the glove 271. Preferably, the high friction surface is formed from a PVC material 270, a nitrile material, a latex material, or the like. The surface may include a plurality of depressions or a plurality of projections formed from the grip enhancing panel.

Formed on the illustrated glove is a plurality of projections 270, such as PVC dot projections 270 that are formed by any standard means, such as by bonding, along the glove body palmar portion. These circular-like projections preferably are spaced apart to allow for added grip and flexibility, and overlay the metacarpophalangeal joint of the forefinger, but do not extend beyond a metacarpophalangeal joint 271.

The grip enhancements will provide support the interlocked weak hand forefinger that has to extend out to interlock with the dominant hand's pinkie finger. As the user extends out the weak hand's forefinger it raises the forefinger's metacarpophalangeal slightly. Providing this added grip will therefore better support the user's control around the interlocked fingers. Among the advantages include the ability to have enhanced overall control and golf swing stability.

The grip enhancing means may also comprise of a plurality of depressions, grip enhancing panels and/or tackifiers and tackified materials along the forefinger metacarpophalangeal joint 271.

The grip enhancing means provides on the glove body palmar portion 262 may further comprise of tackifiers 305 including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing means comprised of a discreet tackified location. More specifically, a grip enhancing means comprises a grip enhancing panel 306 overlaying the pinkie finger metacarpal and the ring finger metacarpal, whereby said grip enhancing panel is a tackified material 306, such as a impregnating a synthetic leather 306 with a tackifier resin 305, and then affixing said grip enhancing panel onto the glove body palmar portion. The illustrated grip enhancing panel does not overlay the metacarpophalangeal joint 307 to allow the user to more easily clench his or her pinkie finger while increasing grip.

The wrist portion is preferably expansible so as to hold more securely to the user's wrist. Therefore the embodiment also has an expandable opening means 273 at a wrist end adapted to receive the user's hand. The expandable opening means comprises an elastic material along the wrist portion, such as an elastomeric band fixed around the wrist. If desired, the opening means may comprise any standard strap means at the open end of the glove body for fastening the glove body secure about the wrist area. The strap may have two pads of cohesive 274 adhesive material 275 for releasably securing the strap. The strap as well as this wrist portion may be sewn onto the glove.

This embodiment also comprises a detachable ball marker 276. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 276. The golfer will then place the ball marker just behind the golf ball but will now know exactly where the golf is by placing the arrow exactly behind the golf ball. The detachable ball marker is secured by any standard fastening means, such as by snap fastening, by a VELCRO fastening compartment 277, or by magnetism.

Additionally, embodiments such as this one, may be completely coated with a with a water repellant substance such as a synthetic resin on the palmar surface or throughout the entire glove. Alternatively, a plurality of micro recesses of about 0.120 millimeters or so in diameter may be randomly disposed about the front, back and finger 279 and thumb stalls 278 of the glove, thereby providing added comfort and more ventilation.

The materials forming the illustrated embodiment may comprise those discussed in reference to the present invention. Likewise, any previously discussed methods of construction may be applied to this embodiment.

Referring now to FIG. 23 and FIG. 24, an embodiment of the present invention is shown and designated as 370. The palmar view of a left-handed glove is drawn in FIG. 23 and the dorsal view of the same glove is drawn in FIG. 24. This partial-fingered embodiment provides a glove having a dorsal portion 371, a palmar portion 372 for overlaying respective back and palm regions of a human hand, said dorsal and palmar portions having distal and proximal ends with a plurality of digital segments (or stalls) projecting from said distal ends. The glove includes a glove body having a back portion covering the back of the hand 371, and a front portion covering the palm or front of the hand 372. The glove body includes finger stalls (or digital segments) and a thumb stall (digital segment) each adapted to receive a finger or thumb, respectively, therein.

In the illustrated embodiment, the glove is constructed such that the thumb and forefinger digital segments enclose said thumb and forefinger, including enclosing the fingertips. The glove has a finger segment that covers the middle finger, a finger segment that covers the ring finger's proximal phalanx but does not extend to cover the ring finger's middle phalanx, and a finger segment that covers the pinkie finger's proximal phalanx but does not extend to cover the pinkie finger's middle phalanx.

The forefinger segment also has an aperture 392 exposing a user's proximal interphalangeal joint. The aperture also extends out to the sides of the aforementioned areas of the forefinger segment, but does not generally extend onto more than twenty-five percent of the palmar surface of the forefinger segment.

The palmar section also covers the palm segment overlaying the palm of the hand 372; the dorsal section also covers most of the back of the hand 371. The glove also has a wrist portion that surrounds the wrist of a user.

The thumb stall is defined by a dorsal portion 378 and a palmar portion 379. The forefinger stall is defined by a dorsal portion 380 and a palmar portion 381. The middle finger stall is defined by a dorsal portion 382 and a palmar portion 383. The ring finger stall is defined by a dorsal portion 384 and a palmar portion 385. The pinkie finger stall is defined by a dorsal portion 386 and a palmar portion 387.

The wrist portion is preferably expansible so as to hold more securely to the user's wrist. Therefore the embodiment also has an expandable opening means 388 at a wrist end 389 adapted to receive the user's hand. The expandable opening means comprises an elastic material along the wrist portion, such as an elastomeric band 388 fixed around the wrist. If desired, the opening means may comprise a strap means at the open end of the glove body for fastening the glove body secure about the wrist area. The strap may have two pads of cohesive-adhesive material for releasably securing the strap. The strap as well as this wrist portion may be sewn onto the glove.

This embodiment further shows how the present invention may comprise a grip enhancing means 373, 374, 375, 376, 377, 305, 306, 307, 308, 309, 310, 311, 312, 313 along the glove body palmar portion 372. Although the embodiment now provides a higher coefficient of friction than what the skin of throwing hand of a quarterback or a golfer's dominant hand would otherwise provide; one may now further increase grip areas by adding a grip enhancing means on select areas of the palmar portion of the glove. In general, the grip enhancing means of the present invention may be integral to the glove or may be affixed to the glove surface by, for example, forming a grip enhancing panel and applying the panel onto a portion of the palmar portion of the glove body.

The glove body may include a grip enhancing means comprising a plurality of depressions or a plurality of projections formed on select areas of the palmar portion, thereby creating a higher coefficient than on the rest of the glove body.

Formed on the illustrated glove is a plurality of depressions 373, 374, 375, 376, 377, 306, 307, 308, 309, 310, 311, 312, 313. These square-like and circular depressions preferably are spaced apart to allow for added grip and flexibility. The plurality of depressions are preferably provided on at least one centimeter by one centimeter of any finger stalls 374, 375, 376, 377, 310, 311, 312, 313. The depressions preferably have a depth less than 1/10 of a centimeter, for example, but can range generally from 1/20 of a centimeter to several centimeters.

The grip enhancing means comprising a plurality of depressions overlay, more specifically, for example, the entire palmar portion 373 of the thumb stall palmar segment 379. In addition, a plurality of depressions overlay the distal phalanx 374, the middle phalanx 310, and the proximal phalanx 311 of the forefinger stall palmar portion 381. In addition, a plurality of depressions overlay the distal phalanx 375, the middle phalanx 312, and the proximal phalanx 313 of the middle finger stall palmar portion 383. In addition, a plurality of depressions overlay the distal phalanx 376 of the ring finger 385. In addition, a plurality of depressions overlay the distal phalanx 377 of the pinkie finger 387. In addition, a plurality of depressions overlay the forefinger metacarpophalangeal joint 309, the middle finger metacarpophalangeal joint 308, the ring finger metacarpophalangeal joint 307, and pinkie finger metacarpophalangeal joint 306.

The grip enhancing means comprising a plurality of depressions may be integrally formed on, or may be affixed to the glove body palmar portion. For example, the plurality of depressions may be affixed the glove body by forming said plurality of depressions onto a panel, and then affixed the panel onto select areas of the glove body by any standard methods, such as by stitching or adhesion for example.

In the illustrated embodiment, the grip enhancing means further comprises a plurality of grip enhancing panels on key areas along the palmar surface of the glove 372, including the palmar surfaces of the thumb segment 373, any existing finger segments 381, 383, 385, 387, and on any finger metacarpophalangeal joints.

The grip enhancing means comprising of these grip enhancing panels preferably provide a higher and more effective coefficient of friction than the rest of the glove body, preferably providing a Shore A Durometer Coefficient of Friction of between 1.5 and 4.5.

For example, a grip enhancing means comprising a grip enhancing panel 310 overlays up to but not more than the entire middle phalanx of the forefinger stall, and formed from a PVC material 310, for example. In addition, a grip enhancing means comprising a grip enhancing panel 311 overlays up to but not more than the entire proximal phalanx of the forefinger stall, and formed from a latex material, for example. In addition, a grip enhancing means comprising a grip enhancing panel 312 overlays up to but not more than the entire middle phalanx of the middle finger stall, and formed from a PVC material, for example. In addition, a grip enhancing means comprising a grip enhancing panel 313 overlays up to but not more than the entire proximal phalanx of the middle finger stall, and formed from a latex material, for example. In addition, a grip enhancing means comprising a grip enhancing panel 376 overlays up to but not more than the entire proximal phalanx of the ring finger stall, and formed from a neoprene material, for example. In addition, a grip enhancing means comprising a grip enhancing panel 377 overlays up to but not more than the entire proximal phalanx of the pinkie finger stall, and formed from a nitrile material, for example.

In addition, grip enhancing panels 309, 308, 307, 306 overlay the forefinger metacarpophalangeal joint 309, the middle finger metacarpophalangeal joint 308, the ring finger metacarpophalangeal joint 307, and pinkie finger metacarpophalangeal joint 306 of the glove body.

The grip enhancing means may further comprise of tackifiers including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing means comprised of a plurality of discreet tackified locations. More specifically, a grip enhancing means comprises a grip enhancing panel 309 overlaying the forefinger metacarpophalangeal joint, whereby said grip enhancing panel is a tackified material 309, such as a impregnating a synthetic leather with a tackifier resin 309; said grip enhancing panel is configured to overlay a metacarpophalangeal joint, in part or in its entirety, but not to extend beyond a metacarpophalangeal joint. In addition, a grip enhancing means comprising a grip enhancing panel 308 overlays the middle finger metacarpophalangeal joint, whereby said grip enhancing panel is a tackified material 308, such as by coating a rubber material panel with any commonly known tackifier 308, such as POWR TAC SPRAY-ON TACKIFIER; said grip enhancing panel is configured to overlay a metacarpophalangeal joint, in part or in its entirety, but not to extend beyond a metacarpophalangeal joint. In addition, a grip enhancing means comprising a grip enhancing panel 307 overlays the ring finger metacarpophalangeal joint, whereby said grip enhancing panel is a tackified material 307, such as by tackifying a panel with any commonly known tackifier 307, such as any commonly known hydrocarbon-type resins for example; said grip enhancing panel is configured to overlay a metacarpophalangeal joint, in part or in its entirety, but not to extend beyond a metacarpophalangeal joint. In addition, a grip enhancing means comprising a grip enhancing panel 306 overlays the pinkie finger metacarpophalangeal joint, whereby said grip enhancing panel is a tackified material 306, such as a impregnating a synthetic leather with a tackifier resin 306; said grip enhancing panel is configured to overlay a metacarpophalangeal joint, in part or in its entirety, but not to extend beyond a metacarpophalangeal joint.

Furthermore, a grip enhancing means may comprise a grip enhancing panel 305 overlays the pinkie finger's metacarpal, whereby said grip enhancing panel is a tackified material 305; said grip enhancing panel is configured to overlay the pinkie finger metacarpal, in part or in its entirety, but not to extend beyond said metacarpal. Providing a grip enhancing means along this location provides increased grip along a critical grip area especially important when controlling a football. In addition, many novice golfers find it difficult to keep the golf club shaft from moving on the downswing. Often, the shaft will be held toward the top of the pinkie metacarpal, closest to the metacarpophangeal joint, but as a golfer completes the downswing, the shafts uncontrollably moves down toward the bottom of the pinkie metacarpal, clearly resulting in inconstant golf swings. Thus, providing a grip enhancing means along the pinkie metacarpal will serve to resolve these grip deficiencies.

In addition, the entire palmar portion of the thumb digital segment comprises a tackified material 373, such as impregnating a leather with a tackifier resin and then affixing said material onto the rest of the palmar portion of the glove body. This particular configuration provides for maximum grip capabilities for a user, such as a golfer. The less flexible thumb segment is not of importance to a golfer because the weak hand's thumb does not need to bend at any time during a golf swing.

The grip enhancing means formed of these tackfied materials integral to the glove body or formed of tackified grip enhancing panels, are preferably configured to provide a significantly higher coefficient of friction, preferably of at least a Shore A Durometer Coefficient of Friction of between 2.0 and 4.5; Still more preferably a Shore A Durometer Coefficient of Friction of between 2.5 and 4.5.

Once the grip enhancing panels have been formed, these panels may then be applied to the palmar surface of the glove by any standard methods, such as by stitches or adhesives, for example.

Additionally, embodiments such as this one, may be completely coated with a with a water repellant substance such as a synthetic resin 508 on the palmar surface 372 or throughout the entire glove 372, 371. Alternatively, a plurality of micro recesses of about 0.120 millimeters or so in diameter may be randomly disposed about the front, back and finger and thumb stalls of the glove, thereby providing added comfort and more ventilation.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material on the dorsal surface overlaying said metacarpophalangeal joints while the rest of the dorsal surface is comprised of a more durable material. The elastic material could be stitched onto those areas, and therefore replacing the more durable materials along those select areas. Alternatively, said joints may simply have protrusions molded into the dorsal surface thereby allowing added flexibility along select areas of the hand.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, football quarterbacks may use this embodiment on their dominant hand thereby allowing the quarterback significantly more grip capabilities while simultaneously being able to have heightened tactile abilities at the same time on key areas of the dominant hand.

By way of example, those who play golf would also significantly benefit by using this embodiment. A golfer who grips a golf club using the overlapping golf grip could particularly benefit by placing this embodiment over their dominant hand thereby creating a much strong overall grip while not losing much tactile sensations because of the partially uncovered ring finger.

Moreover, the strategically located aperture 392 along the forefinger segment—exposing a user's proximal interphalangeal joint—exposes the primary portion of the user's weak hand forefinger that touches the user's strong hand pinkie finger, when using a conventional overlapping golf grip method, and thereby uniquely designing a golf glove to meet the specific needs of those who grip a golf club using a conventional overlapping golf grip method.

By way of example, baseball pitchers may also find this embodiment beneficial over their strong (pitching) hand primarily because it offers grip enhancing capabilities on the fingertips on select digital segments while allowing the pitcher to maintain heightened feel by simultaneously providing the pitcher with the ability to touch the baseball with his or her skin.

Referring now to FIG. 25 and FIG. 26, a second embodiment of the athletic glove of the present invention is shown and designated as 400. The palmar (front) view of a left-handed glove is drawn in FIG. 25 and the dorsal (back) view of the same glove is drawn in FIG. 26. This partial-fingered embodiment provides a glove having a dorsal portion 441 and a palmar portion 442 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 441, and a front portion covering essentially the entire palm surface of the hand 442. The glove body includes finger segments and a thumb segment each adapted to receive a finger or thumb, respectively, therein.

The glove is constructed such that the thumb 443, forefinger 444, middle finger 453, and pinkie finger 463 digital segments completely enclose said thumb, forefinger, middle finger, and pinkie finger, including enclosing the fingertips. Additionally, an aperture exists 462 only along the proximal phalanx of the forefinger segment. Furthermore, the ring finger of a user is completely uncovered therefore this embodiment does not have a ring finger digital segment. The glove provides a ringlet or recess 465 whereby a wearer's ring finger may extend entirely through said glove.

The palmar surface of the glove therefore covers the rest of the front of the hand, including the entire palm of the hand 442; the dorsal section covers most of the back of the hand 441, allowing for a slit on the wrist portion for an opening to more easily insert a hand. The thumb stall 443 is defined by a dorsal portion 448 and palmar portion 449. The forefinger stall 444 is defined by a dorsal portion 450 and a palmar portion 451. The middle finger stall is defined by a dorsal portion 452 and a palmar portion 453. The pinkie finger stall is defined by a dorsal portion 454 and a palmar portion 455. There is no ring finger stall so there is no dorsal or palmar portion defining the ring finger stall, however the dorsal and palmar portion provides a ringlet/recess 465 for the ring finger to extend through the glove.

The embodiment is also designed to provide of an aperture 462 along the forefinger segment 444, thereby exposing only a portion of a user's forefinger. This aperture is bounded by the proximal phalanx portion of the forefinger segment. The aperture is located primarily of the dorsal portion of the glove body.

The glove also has an expandable opening means at a wrist end portion 459 adapted to receive the user's hand. The expandable opening means comprises a strap means 456 at the open end 457 of the glove body for fastening the glove body secure about the wrist area. The strap means may be unitary with the glove body and may include VELCRO fasteners 458, buttons, and the like or other suitable closure means thereon. The wrist portion is preferably expansible so as to hold more securely around the user's wrist. The dorsal surface of the glove therefore has an uncovered portion 457. As with other embodiments, the glove may alternatively have an expandable opening means comprised of an elastic material to expand and contract for easier glove application onto a hand.

This embodiment further shows how the present invention may also comprise a grip enhancing means 460, 479, 461, 401, 404, 464, 402, 405, 406, and 403. Although the embodiment now provides a higher coefficient of friction on the throwing hand of a quarterback or on a golfer's dominant hand, one may now further increase grip areas by adding a grip enhancing means on select areas.

In general, the grip enhancing means of the present invention may be integral to the glove or may be affixed to the glove surface by, for example, forming a grip enhancing panel and applying the panel onto a portion of the glove.

The glove body may include a grip enhancing means comprising a plurality of depressions or a plurality of projections formed on select areas of the palmar portion, thereby creating a higher coefficient than on the rest of the glove body.

Formed on the illustrated glove is a plurality of projections 460, 461, 404, 464, 405, and 406. These circular projections preferably are spaced apart to allow for added grip and flexibility.

The illustrated embodiment has a grip enhancing means on select areas of the front of the hand, specifically along the four digital segments as well as along the region between the thumb and forefinger segments. The grip enhancing means comprises oval projections, each having a height of at least about three hundred micrometers, and are further grouped in diamond shaped clusters to allow for greater hand flexibility and movement.

The grip enhancing means comprising a plurality of oval projections are located on the palmar section of the thumb stall 460 and forefinger stall 461, and are throughout said stall palmar portions, to maximize grip abilities of a user's thumb and forefinger. In addition, a grip enhancing means comprising a plurality of projections are located along substantially the entire pinkie finger palmar portion 404. In addition, a grip enhancing means comprising a plurality of projections 405 overlay substantially the pinkie finger's metacarpophalangeal joint as well as a substantial portion of the pinkie finger's metacarpal 406, and formed from a nitrile material, for example.

A grip enhancing means comprising a plurality of projections is also on the palmar portion of the glove overlaying the area between the thumb and the forefinger segments 464, generally defined by the portion overlaying the forefinger metacarpal, the thumb metacarpal and the area between said metacarpals extending to the edge of the palm 467. The grip enhancing means can also comprise of a high friction surface by applying a non-slip coating, such as a latex, a nitrile, PVC coating, or a tackifier coating along described locations of this embodiment. The coating may of course also be applied to the entire palmar portion of the glove.

The locations of the grip enhancing means may vary on several factors of course, such as personal preference and preferred degree of enhanced grip. Additionally, the projection designs may vary, such as being in the form of non-linear or crisscross lines, for example. Finally, the heights may vary as well.

As discussed, the grip enhancing means comprising a plurality of projections for example, may be integrally formed on or may be affixed to the glove body palmar portion. In other words, the plurality of projections may be affixed the glove body by forming said plurality of projections onto a grip enhancing panel, and then affixing the panel onto select areas of the glove body by any standard methods, such as by stitching or adhesion for example.

In the illustrated embodiment, the grip enhancing means further comprises a plurality of grip enhancing panels 401, 402, and 403 on key areas along the palmar surface of the glove 442, including the palmar surfaces of the thumb segment 479, any existing finger segments, and on any finger metacarpophalangeal joints, such as the forefinger metacarpophalangeal joint 402.

The grip enhancing means comprising of these grip enhancing panels preferably provide a higher and more effective coefficient of friction than the rest of the glove body, preferably providing a Shore A Durometer Coefficient of Friction of between 1.5 and 4.5.

For example, a grip enhancing means comprising a grip enhancing panel 401 overlays up to but not more than the entire distal phalanx of the forefinger stall, and is formed from a high friction material 401, such as a neoprene material 401, for example.

In addition, a plurality of grip enhancing panels may separately overlay the forefinger metacarpophalangeal joint 402, the middle finger metacarpophalangeal joint, the ring finger metacarpophalangeal joint, and pinkie finger metacarpophalangeal joint 403 of the glove body, for example.

More specifically, for example, a grip enhancing means comprising a grip enhancing panel 402 preferably overlays up to but not more than the entire forefinger's metacarpophalangeal joint. In addition, a grip enhancing means comprising a grip enhancing panel 403 overlays substantially the pinkie finger's metacarpophalangeal joint extending to overlay a substantial portion of the pinkie finger's metacarpal, and formed from a nitrile material, for example.

Many novice golfers find it difficult to keep the golf club shaft from moving on the downswing. Often, the shaft will be held toward the top of the pinkie metacarpal, closest to the metacarpophangeal joint, but as a golfer completes the downswing, the shafts uncontrollably moves down toward the bottom of the pinkie metacarpal, clearly resulting in inconstant golf swings. Thus, providing a grip enhancing means along the pinkie metacarpal will serve to resolve these grip deficiencies. In addition, providing a grip enhancing means along this location provides increased grip along a critical grip area especially important when controlling a football.

The grip enhancing means may further comprise of tackifiers including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing means comprised of a plurality of discreet tackified locations. More specifically, a grip enhancing means comprises a grip enhancing panel 402 overlaying the forefinger metacarpophalangeal joint, whereby said grip enhancing panel is a tackified material 402, such as a impregnating a synthetic leather with a tackifier resin 402; said grip enhancing panel is configured to overlay a metacarpophalangeal joint 402, in part or in its entirety, but not to extend beyond a metacarpophalangeal joint.

In addition, the entire palmar portion of the thumb digital segment comprises a tackified material 479, such as impregnating a leather 479 with a tackifier resin 479 and then affixing said material onto the rest of the palmar portion of the glove body. This particular configuration provides for maximum grip capabilities for a user, such as a golfer. The less flexible thumb segment is not of importance to a golfer because the weak hand's thumb does not need to bend at any time during a golf swing. Alternatively, a grip enhancing means may comprise a grip enhancing panel overlays the proximal phalanx of the thumb segment, whereby a grip enhancing means comprises any commonly known tackifier coating, such as POWR TAC SPRAY-ON TACKIFIER; said tackifier is coated onto any thumb or finger stalls, such as, for example, on the proximal phalanx of the thumb segment, in part or in its entirety, but not extending beyond a proximal phalanx.

The grip enhancing means formed of these tackified materials integral to the glove body or formed of tackified grip enhancing panels, are preferably configured to provide a significantly higher coefficient of friction, preferably of at least a Shore A Durometer Coefficient of Friction of between 2.0 and 4.5; Still more preferably a Shore A Durometer Coefficient of Friction of between 2.5 and 4.5.

Once the grip enhancing panels have been formed, these panels may then be applied to the palmar surface of the glove by any standard methods, such as by stitches or adhesives, for example.

This embodiment also comprises a detachable ball marker 445. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 445 with a design that points to where the golf ball exactly is located. In this embodiment, the design is an arrow 446. The golfer will then place the ball marker just behind the golf ball but will now know exactly where the golf is by placing the arrow exactly behind the golf ball. The detachable ball marker is secured by any standard fastening means, such as by magnetism (as shown) or snap fastening, for example. The back portion of the detachable ball marker as well as the connecting dorsal segment of the glove 447, both therefore have small magnets. The ball marker may be circular or non-circular in design.

Additionally, embodiments such as this one, may be completely coated with a with a water repellant substance such as SCOTCH GUARD 509 on the palmar surface or throughout the entire glove. Alternatively, a plurality of micro recesses of about 0.120 millimeters or so in diameter may be randomly disposed about the front, back and finger and thumb stalls of the glove, thereby providing added comfort and more ventilation.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

The embodiment is suitably a substantially conventionally constructed sports glove, modified as aforementioned. This particular glove can be made of a polyester and cotton blend for superior comfort or of a synthetic leather latex coated glove for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, and cloths. Examples of synthetic yarns include nylon, polyester, and spandex (polyurethane) yarns. Additionally, embodiments such as this one, may be coated with a with a water repellant substance, such as a synthetic resin throughout the entire outer surface of the glove.

Referring now to FIG. 27 and FIG. 28, an athletic glove of the present invention is shown and designated as 510. The palmar (front) view of a left-handed glove is drawn in FIG. 27 and the dorsal (back) view of the same glove is drawn in FIG. 28. This partial-fingered embodiment provides a glove having a dorsal portion 511, a palmar portion 512 for overlaying respective back and palm regions of a human hand, said dorsal and palmar portions having distal and proximal ends with a plurality of digital segments (or stalls) projecting from said distal ends. The glove includes a glove body having a back portion covering the back of the hand 511, and a front portion covering the palm or front of the hand 512. The glove body includes finger stalls and a thumb stall each adapted to receive a finger or thumb, respectively, therein.

In the illustrated embodiment, the glove is constructed such that the thumb, forefinger and middle finger digital segments enclose said thumb, forefinger and middle finger, including enclosing the fingertips. The glove a finger segment that covers the ring finger's proximal phalanx but does not extend to cover the ring finger's middle phalanx, and therefore is covered about one-third of the way up.

There is no pinkie finger stall so there is no dorsal or palmar portion defining the pinkie finger stall. The glove provides a ringlet or recess 526 whereby a wearer's pinkie finger may extend entirely through said glove.

The embodiment is also comprised of an aperture 532 along the forefinger segment. This aperture located on about seventy percent of the proximal phalanx and no more than ten percent of the middle phalanx portions of the forefinger segment. The illustrated aperture does not extend to expose the metacarpophalangeal joint or the proximal interphalangeal. The aperture is oval in general structure, and is located on the palmar portion, or palmar section, of the glove body.

The palmar section covers the entire palm of the hand 512 and the dorsal section covers the back of the hand 511, allowing only for any micro recesses, typically used to provide ventilation. The glove also has a wrist portion that surrounds the wrist of a user.

The thumb stall 513 is defined by a dorsal portion 518 and a palmar portion 519. The forefinger stall 514 is defined by a dorsal portion 520 and a palmar portion 521. The middle finger stall is defined by a dorsal portion 522 and a palmar portion 523. The ring finger stall is defined by a dorsal portion 524 and a palmar portion 525. This embodiment does not have a pinkie finger segment. The glove is designed to provide a ringlet 526 or recess whereby a wearer's pinkie finger may extend entirely through said glove body.

The wrist portion is preferably expansible so as to hold more securely to the user's wrist. Therefore the embodiment also has an expandable opening means 528 at a wrist end 529 adapted to receive the user's hand. The expandable opening means comprises an elastic material along the wrist portion, such as an elastomeric band 528 fixed around throughout the wrist. If desired, the opening means may comprise a strap means at the open end of the glove body for fastening the glove body secure about the wrist area. The strap means may be unitary with the glove body and may include VELCRO fasteners, buttons, and the like or other suitable closure means thereon.

This embodiment further shows how the present invention may comprise a grip enhancing means. Although the glove now provides a higher coefficient of friction on the throwing hand of a quarterback or on a golfer's dominant hand, for example, one may now further increase grip capabilities by adding a grip enhancing means along the palmar surface of the glove.

The thumb and forefinger digital segments of this embodiment have a grip enhancing means, in the form of plurality of depressions, on a portion of the palmar portion of the glove body, such as on a portion of the thumb and forefinger segments, for example. The plurality of depressions preferably have a depth of at least about three hundred micrometers.

The plurality of depressions are located on the palmar section of the distal and middle phalanges of the forefinger 531 stall, and on substantially the entire palmar portion of the thumb stall 530.

The embodiment's grip enhancing means can also comprise of a high friction surface, such as creating crisscross depressions, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint, 534. The grip enhancing means portion overlaying the pinkie finger metacarpophalangeal joint preferably does not extend over the upper-palmar crease, however, to provide optimal flexibility. The depths of the depressions may vary, as aforementioned. These depressions are about one millimeter, for example.

The grip enhancing means may be integral to the glove or may be affixed to the glove using any standard methods. For example, this embodiment comprises grip enhancing means that are integral to the glove thumb and forefinger stalls, using any standard method known in the art. For example, the depressions can be imparted by any standard methods, such as, for example, by molding or stamping. The heights of the PVC dots in this embodiment are all the same height, and are in rows.

The grip enhancing means may further comprise of tackifiers including tackifier resins, such as rosins and their derivatives, terpenes, aliphatic, cycloaliphatic and aromatic resin, and any of a variety of hydrocarbon-type resins, tackifier coatings, tackified materials such tackified leathers and synthetic leathers, and other tackifier substances well commercially known in the art, strategically placed along the palmar portion of the glove body, thus providing very high grip capabilities to a user, especially to football quarterbacks and golfers.

In the illustrated embodiment, the glove palmar portion further comprises of a grip enhancing means comprised of a plurality of discreet tackified locations. More specifically, a grip enhancing means comprises a grip enhancing panel overlaying the forefinger distal and middle phalanges, whereby said grip enhancing panel is a tackified material 550, such as a impregnating a synthetic leather 550 with a tackifier resin 550; said grip enhancing panel is configured to overlay a finger segment, in part or in its entirety, but not to extend beyond a finger segment.

In addition, the entire palmar portion of the thumb digital segment comprises a tackified material 540, such as impregnating a leather with a tackifier 540 and then affixing said material onto the rest of the palmar portion of the glove body.

This particular configuration provides for maximum grip capabilities for a user, such as a golfer by providing a glove uniquely configured to meet the needs of a golfer's strong hand. The less flexible thumb segment is not of importance to a golfer because the weak hand's thumb does not need to bend at any time during a golf swing. In addition, the completely uncovered pinkie finger provides the continued high tactile sensitivities when overlaying the strong hand's (and usually glove-less) pinkie finger on top of the weak-hand's forefinger.

A golfer may have similar grip enhancing preferences as those discussed. An individual using the overlapping grip method may additionally desire a grip enhancing means overlaying the palmar surface areas. The resulting grip enhancing configurations would offer the golfer added control on the dominant hand's thumb and forefinger. Additionally, the partially uncovered fingers as well as the aperture along the forefinger segment offer maximum retention of tactile sensation. The uncovered finger portions allow the user to maximize hand coordination, for example, while the aperture allows the user to maintain maximum feel ability on the golf club—both crucial aspects in completing a successful golf swing. This unique offering will significantly increase the golfer's ability to control a golf club and also therefore a golf swing and golf ball.

A plurality of micro recesses 532 of about 0.120 millimeters in diameter may be randomly disposed about the front, back and finger and thumb stalls of the glove, thereby providing added comfort and more ventilation. In addition or alternatively, the glove body may be coated with a moisture repellent 533 such as a synthetic resin 533.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

I claim:

1. A hand cover comprising a body comprising a palmar portion, a dorsal portion, and a distal end;

a first digital segment projecting from said distal end of said body, said first digital segment being adapted to overlay and cover an entire thumb of a user's hand including a fingertip of a thumb of the user; and a second digital segment projecting from said distal end of said body and being adapted to overlay and cover a fingertip of a forefinger of said user;

wherein said second digital segment comprises a dorsal portion, a palmar portion, and a side portion, and wherein said second digital segment comprises an aperture adapted to leave at least a portion of a proximal phalangeal of said forefinger uncovered; and a third digital segment projecting from said distal end of said body, said third digital segment being adapted to overlay and cover an entire middle finger of the user's hand including a fingertip of said middle finger;

a fourth digital segment projecting from said distal end of said body, said fourth digital segment being adapted to overlay and cover an entire pinkie finger of the user's hand including a fingertip of said pinkie finger; and, wherein said forefinger digital segment side portion is adjacent said middle finger digital segment; and, wherein said hand cover body has a wrist end portion, said wrist end portion comprising;

a flap and flap capture mechanism for fastening the glove body secure about a wrist area of the user when the glove is worn.

2. The hand cover as claimed in claim 1, wherein said aperture is adapted to be located along the side portion and dorsal portion of said forefinger digital segment thereby exposing at least a portion of the proximal phalanx of the user's forefinger when the glove is worn; and wherein said aperture is adapted to enable skin-to-skin contact between the exposed portion of said at least proximal phalanx of said forefinger of the gloved hand and a portion of a pinkie finger of an opposing ungloved hand when gripping a golf club using a conventional interlocking grip of a golf club.

3. The hand cover as claimed in claim 1, wherein said aperture is adapted to enable skin-to-skin contact between a skin exposed portion of said proximal phalanx of the user's forefinger and a portion of a pinkie finger of the user's opposing ungloved hand when the user grips a golf club using a conventional overlapping grip method; and wherein said aperture is adapted to be primarily located along the dorsal portion of said forefinger digital segment and extends to expose said side portion forefinger digital segment when the glove is worn.

4. The hand cover as claimed in claim 1, wherein said aperture is adapted to be located along the dorsal portion of said second digital segment; and wherein said aperture is adapted to be of substantial size to enable skin-to-skin contact between an exposed portion of said at least proximal phalanx of said forefinger and a portion of a pinkie finger of an opposing ungloved hand when gripping a golf club using a conventional overlapping grip of a golf club; and wherein said second digital segment is the only digital segment having an aperture that is adapted to be of substantial size to enable skin-to-skin contact along an exposed proximal phalanx when the glove is worn.

5. The hand cover as claimed in claim 1, wherein said aperture is adapted to be located along the dorsal portion of said forefinger digital segment, and wherein said aperture is adapted such that it does not extend to expose a distal interphalangeal or a metacarpophalangeal of said user's forefinger when the glove is worn.

6. The hand cover as claimed in claim 1, wherein said wrist end portion comprises of a slit that is adapted to be positioned such that said flap can extend over said slit when the glove is worn.

7. The hand cover as claimed in claim 1, wherein said aperture is adapted to enable skin-to-skin contact between an exposed portion of said at least proximal phalanx of said forefinger and a portion of a pinkie finger of an opposing ungloved hand when gripping a golf club using a conventional interlocking golf grip method.

8. The hand cover as claimed in claim 1, wherein said thumb digital segment further comprises of a grip enhancing means consisting of a panel, a plurality of projections, a plurality of depressions, a tackifier, or a non-slip coating.

9. The hand cover as claimed in claim 1, wherein said glove body palmar portion comprises of a grip enhancing panel.

10. A hand cover comprising a glove body comprising a palmar portion, a dorsal portion, and a distal end;

a first digital segment projecting from said distal end of said body, said first digital segment being adapted to overlay and cover an entire thumb of a user's hand including a fingertip of the thumb of the user; and a second digital segment projecting from said distal end of said body and being adapted to overlay and cover a fingertip of a forefinger of said user;

wherein said second digital segment comprises a dorsal portion, a palmar portion, and a side portion, and wherein said second digital segment comprises an aperture adapted to leave a portion of a proximal phalangeal of said forefinger uncovered; and wherein said aperture is adapted such that it does not extend to expose the distal interphalangeal or the metacarpophalangeal of said user's forefinger when the glove is worn;

a third digital segment projecting from said distal end of said body, said third digital segment being adapted to overlay and cover an entire middle finger of the user's hand including a fingertip of said middle finger;

a fourth digital segment projecting from said distal end of said body, said fourth digital segment being adapted to overlay and cover an entire pinkie finger of the user's hand including a fingertip of said pinkie finger; and, wherein said forefinger digital segment side portion is adjacent said middle finger digital segment; and, wherein said hand cover body has a wrist end portion, said wrist end portion comprising;

a flap and flap capture mechanism for fastening the glove body secure about the user's wrist area when the glove is worn.

11. The hand cover as claimed in claim 10, further comprising of a textured portion or portions and a non-textured portion, said textured portion or portions are adapted to create a higher coefficient of friction than said non-textured portion when the glove is worn, wherein said textured portion consists of a plurality of projections.

12. The hand cover as claimed in claim 10, comprising of a textured portion or portions and a non-textured portion, said textured portion or portions are adapted to create a higher coefficient of friction than said non-textured portion when the glove is worn, wherein said textured portion consists of at least one grip enhancing panel.

13. The hand cover as claimed in claim 10, comprising a textured portion or portions and a non-textured portion, said textured portion or portions are adapted to create a higher coefficient of friction than said non-textured portion when the glove is worn.

14. The hand cover as claimed in claim 10, wherein said aperture is adapted such that it does not extend to expose a distal interphalangeal or a metacarpophalangeal of said user's forefinger when the glove is worn; and, wherein said aperture is adapted to extend across a substantial portion of the forefinger digital segment dorsal portion thereby enabling skin-to-skin contact with an exposed portion of the user's forefinger proximal phalanx.

15. The hand cover as claimed in claim 10, comprising of a textured portion or portions and a non-textured portion, said textured portion or portions are adapted to create a higher coefficient of friction than said non-textured portion when the glove is worn, wherein said textured portion comprises of the plurality of depressions.

16. A hand cover comprising a body comprising a palmar portion, a dorsal portion, and a distal end;

a first digital segment projecting from said distal end of said body, said first digital segment being adapted to overlay and cover an entire thumb of a user's hand including a fingertip of the thumb of the user's hand; and a second digital segment projecting from said distal end of said body and being adapted to overlay and cover a fingertip of a forefinger of said user;

wherein said second digital segment comprises a dorsal portion, a palmar portion, and a side portion, and wherein said second digital segment comprises an aperture adapted to leave at least a portion of a proximal phalangeal of said forefinger uncovered; and wherein said aperture is adapted such that it does not extend to expose the distal interphalangeal or the metacarpophalangeal of said user's forefinger when the glove is worn;

a third digital segment projecting from said distal end of said body, said third digital segment being adapted to overlay and cover an entire middle finger of the user's hand including a fingertip of said middle finger;

a fourth digital segment projecting from said distal end of said body, said fourth digital segment being adapted to overlay and cover an entire pinkie finger of the user's hand including a fingertip of said pinkie finger; and, wherein said forefinger digital segment side portion is adjacent said middle finger digital segment; and, wherein said hand cover body has a wrist end portion, said wrist end portion comprising;

a flap and flap capture mechanism for fastening the glove body secure about the wrist area, and an expandable opening means formed by a slit positioned along said hand cover dorsal portion; said flap adapted to be positioned on said wrist end portion such that said flap overlays said slit to enable glove securement about the user's wrist area; and wherein said palmar portion of said body comprises of a grip enhancing means that is adapted to provide a higher coefficient of friction than the surrounding area of the glove surface and thereby provide increased grip capabilities when gripping a sports ball or device during sports play.

17. The hand cover as claimed in claim 16, wherein said aperture is adapted to extend along the dorsal portion of the forefinger's proximal and middle phalanges, but does not extend to expose the distal interphalangeal or the metacarpophalangeal, defining the aperture on the forefinger segment.

18. The hand cover as claimed in claim 10, wherein said aperture is adapted to extend along the side portion the forefinger digital segment and primarily along dorsal portion of the forefinger digital segment.

19. The hand cover as claimed in claim 10, wherein said grip enhancing means is formed on the glove body palmar portion that is adapted to overlay a forefinger of the user's hand when the glove is worn.

20. The hand cover as claimed in claim 10, wherein said grip enhancing means is formed on the glove body palmar portion that is adapted to overlay a forefinger digital segment of the user's hand when the glove is worn; and, wherein said aperture is adapted to extend along the forefinger digital segment dorsal and side portion.

* * * * *